US007913738B2

(12) United States Patent
Fraser et al.

(10) Patent No.: US 7,913,738 B2
(45) Date of Patent: Mar. 29, 2011

(54) SELECTIVE TILTING FOR BLINDS—VARIABLE RADIUS WRAP DOUBLE PITCH

(75) Inventors: Donald E. Fraser, Owensboro, KY (US); Richard Anderson, Louisville, KY (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 777 days.

(21) Appl. No.: 11/755,904

(22) Filed: May 31, 2007

(65) Prior Publication Data

US 2007/0261797 A1 Nov. 15, 2007

Related U.S. Application Data

(63) Continuation-in-part of application No. PCT/US2006/033619, filed on Aug. 28, 2006.

(60) Provisional application No. 60/714,139, filed on Sep. 2, 2005.

(51) Int. Cl.
*E06B 9/303* (2006.01)

(52) U.S. Cl. ..... 160/115; 160/176.1 R

(58) Field of Classification Search ..... 160/115, 160/176.1 R, 177 R, 168.1 R
See application file for complete search history.

(56) References Cited

U.S. PATENT DOCUMENTS

| | | | | |
|---|---|---|---|---|
| 1,365,919 | A | 1/1921 | Jones | |
| 2,116,356 | A | 5/1938 | Laborda et al. | |
| 2,117,953 | A * | 5/1938 | Grau | 160/114 |
| 2,250,106 | A | 7/1941 | Lorentzen | |
| 2,427,266 | A | 9/1947 | Ewing | |
| 2,506,507 | A | 5/1950 | Kiatta | |
| 2,673,607 | A | 3/1954 | Rulfs | |
| 2,719,586 | A | 10/1955 | Graham | |
| 2,723,716 | A * | 11/1955 | Berni | 160/168.1 R |
| 2,747,662 | A | 5/1956 | Reiners et al. | |
| 2,751,000 | A | 6/1956 | Mahan | |
| 3,111,164 | A | 11/1963 | Lombard | |
| 3,633,646 | A | 1/1972 | Zilver | |
| 3,918,513 | A * | 11/1975 | Englund et al. | 160/176.1 R |
| 4,143,699 | A | 3/1979 | Marotto | |
| 4,557,159 | A * | 12/1985 | Gross | 74/665 GA |
| 4,572,267 | A | 2/1986 | Stein et al. | |
| 4,593,738 | A * | 6/1986 | Chi Yu | 160/176.1 R |
| 4,628,979 | A * | 12/1986 | Hsu | 160/115 |
| 4,697,629 | A * | 10/1987 | Anderson | 160/177 R |
| 4,708,188 | A * | 11/1987 | Bytheway, Jr. | 160/174 R |
| 4,921,032 | A | 5/1990 | May | |
| 4,940,070 | A | 7/1990 | Warden | |
| 5,119,868 | A | 6/1992 | Werner | |
| 5,205,335 | A | 4/1993 | Horton et al. | |

(Continued)

FOREIGN PATENT DOCUMENTS

| | | |
|---|---|---|
| AU | 410797 | 2/1971 |

(Continued)

*Primary Examiner* — David Purol

(74) *Attorney, Agent, or Firm* — Camoriano and Associates; Theresa Fritz Camoriano; Guillermo Camoriano

(57) ABSTRACT

A tilter system for a window blind permits the slats of the blind to be tilted open or closed in a number of different configurations, including a double pitch configuration, depending on the routing of tilt cables or actuator cords.

5 Claims, 51 Drawing Sheets

U.S. PATENT DOCUMENTS

| | | | | |
|---|---|---|---|---|
| 5,232,037 | A | 8/1993 | Fraser | |
| 5,309,974 | A | 5/1994 | Fraser | |
| 5,402,840 | A | 4/1995 | Jortner et al. | |
| 5,472,035 | A | 12/1995 | Biba et al. | |
| 5,485,874 | A | 1/1996 | Whitmore | |
| 5,638,882 | A * | 6/1997 | Morris | 160/176.1 R |
| 5,901,767 | A | 5/1999 | Ralton et al. | |
| 5,934,350 | A | 8/1999 | Ciuca | |
| 6,076,587 | A | 6/2000 | Pastor | |
| 6,105,652 | A | 8/2000 | Judkins | |
| 6,318,439 | B1 | 11/2001 | Matsubara | |
| 6,422,288 | B1 | 7/2002 | Dekker et al. | |
| 6,581,665 | B2 | 6/2003 | Lin | |
| 6,644,377 | B1 * | 11/2003 | Lewis | 160/176.1 R |
| 6,648,048 | B2 | 11/2003 | Lai | |
| 6,845,802 | B1 | 1/2005 | Anderson et al. | |
| 7,159,636 | B2 | 1/2007 | Liang | |
| 7,424,905 | B2 * | 9/2008 | Lai | 160/168.1 R |
| 2001/0052397 | A1 | 12/2001 | Matsubara | |
| 2003/0127197 | A1 * | 7/2003 | Lai | 160/115 |
| 2005/0274465 | A1 * | 12/2005 | Hsu | 160/168.1 R |
| 2006/0169420 | A1 * | 8/2006 | Liang | 160/168.1 R |

FOREIGN PATENT DOCUMENTS

| | | |
|---|---|---|
| DE | 134151 | 8/1901 |
| EP | 0620 355 | 1/1994 |
| EP | 0609541 | 5/1997 |
| EP | 0887507 | 12/1998 |
| GB | 1093756 | 12/1967 |
| GB | 2158 137 | 11/1985 |
| JP | 6355595 | 11/1988 |
| JP | 8210060 | 8/1996 |
| JP | 9021282 | 1/1997 |
| JP | 11270253 | 10/1999 |
| WO | WO 98/27307 | 6/1998 |

* cited by examiner

SELECTIVE TILTING FOR BLINDS—VARIABLE RADIUS WRAP DOUBLE PITCH

This application is a continuation-in-part of, and claims priority from, International Application PCT/US2006/033619 filed Aug. 28, 2006, which is hereby incorporated by reference and which claims priority from U.S. Provisional Application Ser. No. 60/714,139 filed Sep. 2, 2005, which is hereby incorporated by reference.

BACKGROUND OF THE INVENTION

The present invention relates to coverings for architectural openings, and, more specifically, to horizontal blinds, such as Venetian blinds, designed to tilt open at double the standard pitch, while having the look of a conventional blind when tilted closed with either the room-side up or the room-side down, or to selectively tilt open or tilt closed portions of the blind.

Typically, a Venetian blind has a top head rail or other frame member, which both supports the blind and hides the mechanisms used to raise and lower or open and close the blind. The raising and lowering is done by a lift cord attached to the bottom rail (or bottom slat). The slats, which are supported from the head rail, may be allowed to tilt so as to open the blind to allow a maximum of light through the blind, or to close the blind with the room-side down (the edges of the slats which are closest to the room are facing down, which means that the other edges of the slats, the edges which are closest to the window or the wall, will be facing up), or to close the blind with the room-side up.

In some instances it is desirable to "tilt open" the blind as much as possible in order to allow more light through the blind or to allow more unhindered viewing area. In this instance, it is possible to achieve this using standard width slats wherein adjacent pairs of slats move together to stack against each other when tilted open, resulting in a "double pitch" arrangement. In this double pitch arrangement, the open area between adjacent pairs of slats is essentially twice the open area that would be achieved if the slats were spaced apart equally in the normal arrangement, thus the "double pitch" designation.

Tilting the blind closed may be done for the purpose of blocking out light, or for obtaining privacy, or both. In order to obtain the optimum performance from the blind, it may be desirable to open one portion of the blind while closing another portion of the blind. For instance, it may be desirable, in an office setting, to tilt closed the lower portion of the blind in order to block the glare of sunlight on a computer screen, or to provide privacy so someone standing outside the window cannot stare through the window and see what is on going on inside the room. However, at the same time, it may be desirable to have the upper portion of the blind tilted open to allow some natural light and/or ventilation into the room. Another instance of an application for such a "split" blind design may be in a home where the floor of the house is at a higher elevation than the ground outside. A person standing in the house could freely see outside, but a person from the outside could not effectively see inside except for the uppermost reaches as allowed by the open section of the blind.

In addition to the issue of privacy and glare elimination, the light control feature of the split blind design (also referred to as selective tilt design) is also beneficial in that it minimizes the ultraviolet light deterioration resulting from sunlight impacting on interior furnishings, rugs, hardwood floors, etc. while still maintaining indirect lighting from the outside as well as a clear view of the outside. This is particularly practical and applicable in buildings with a roof overhang over the window area or where the windows are recessed into the wall, creating an overhang.

In still other instances, it is desirable to tilt a slat closed in one direction (say, room-side up) while the slats immediately adjacent this slat are closed in the other direction (room-side down). This results in an aesthetically-pleasing "pleated look" (also sometimes referred to as a Tiffany look) of the blind when in the closed position.

SUMMARY

In one embodiment, a blind system allows the user to tilt open or tilt closed the entire blind, as well as to selectively tilt open one portion of the blind while another portion of the blind is tilted closed.

In another embodiment, a blind system allows the user to tilt closed the slats as in a conventional blind (either room-side up or room-side down), but tilt open to double the standard pitch.

In another embodiment, a blind system allows the user to tilt the slats open as in a conventional blind but tilt the slats closed in alternating directions (one is room-side up while the next slat is room-side down) to create a "pleated" look.

Various embodiments of the present invention provide drum portions with tilt cables and/or actuator cords connected to the various drum portions. Since both the tilt cables and the actuator cords serve to actuate the slats of the blind, the terms "tilt cable" and "actuator cord" are sometimes used interchangeably in this specification.

One tilt mechanism uses two drums that are co-axially aligned, mounted in a housing, and with a tilt rod extending through the axis of rotation of the drums. The tilt rod engages a drum driver which, in turn, engages one or the other of the two drums of the spool.

Another tilt mechanism uses two drums that are substantially parallel but not co-axial to each other. These two drums are independently driven by separate tilt rods extending through the axes of rotation of their respective drums.

Yet another tilt mechanism uses a single drum with two offset portions.

Various securing and routing arrangements of the tilt cables (or actuator cords) to the drums result in the first two types of tilt mechanisms being able to achieve any of the desired capabilities, including the double pitch blind configuration, while the third tilt mechanism is preferred for the double pitch blind configuration.

DESCRIPTION

Single Tilt Rod, Co-axial Drum Design

Figure 1:
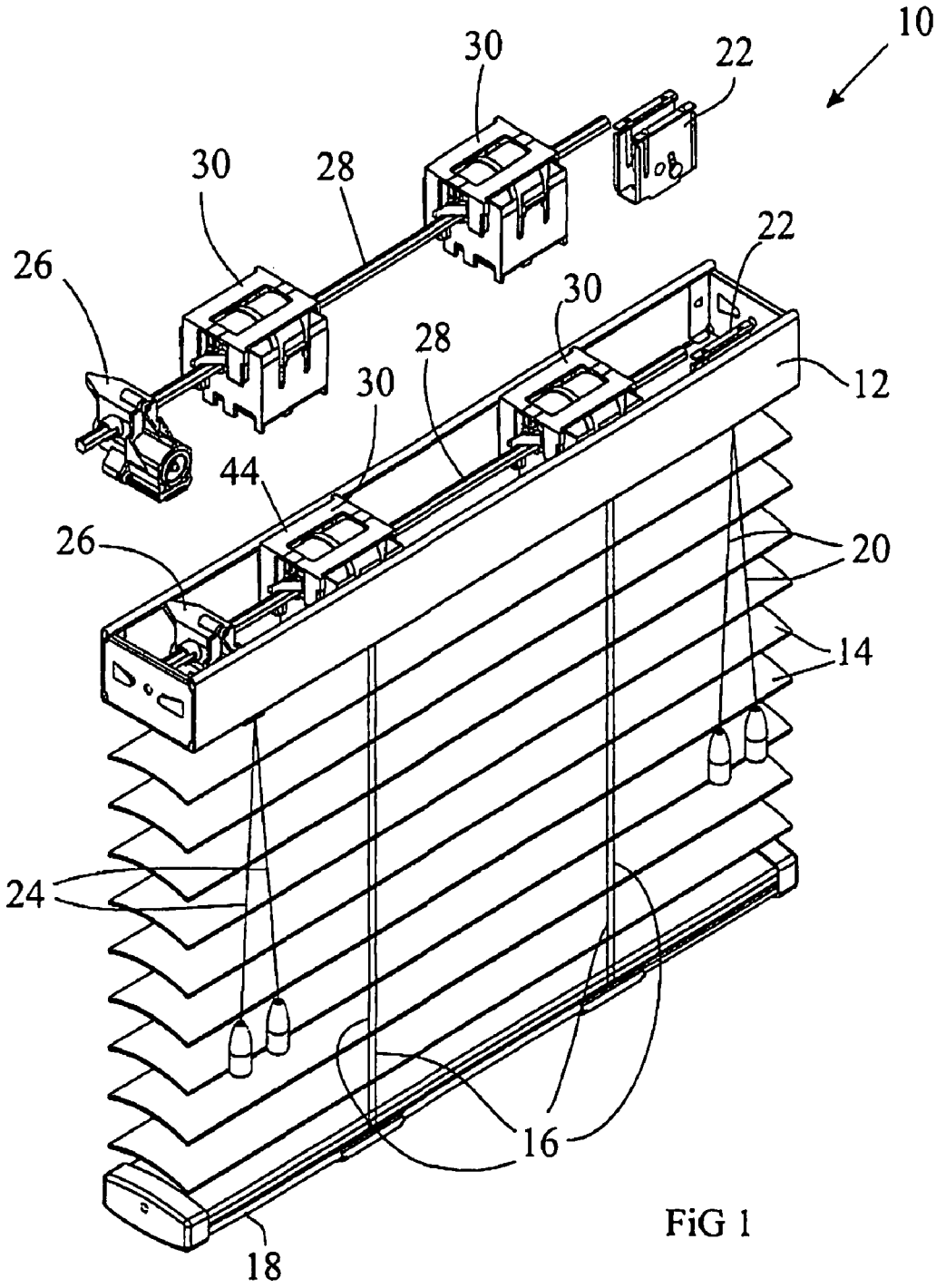
FIG. 1 is a perspective view of a first embodiment of a blind system made in accordance with the present invention, with a partially exploded perspective view of the mechanism inside the head rail also shown above the blind.

The blind 10 of FIG. 1 includes a head rail 12 and a plurality of slats 14 suspended from the head rail 12 by means of tilt cables 16 and their associated cross cords **16*t* (See FIG. 20), which together comprise the ladder tapes. Lift cords 20 are fastened at the bottom of the bottom slat (or bottom rail) 18, which typically is heavier than the other slats 14. As is well-known in the art, the lift cords 20 are routed through rout holes in the slats 14, through the head rail 12, and out through a cord lock mechanism 22. Tilt cords 24 operate a cord tilter 26, which is used to rotate a tilt rod 28 about its longitudinal axis in order to actuate the tilt stations 30. In this embodiment, there are two sets of tilt cables 16, which are given more specific designations in FIG. 20** as follows:

16 is the generic designation for tilt cables the suffix "a" is used for the first set and "b" is used for the second set of tilt cables the additional suffix "f" or "r" is used to indicate front (room side) or rear (wall side or window side)

Note that in some instances, there is no second set of tilt cables. An actuator cord also may be used in some instances (such as in FIG. 23) and designated as **16*x*. The actuator cord 16*x* runs parallel to the tilt cables 16 and attaches to one of the tilt cables 16 via a knot 32 (See FIG. 23) or other fixing means such as via a clip attachment 32, which is described in detail in U.S. Pat. No. 6,845,802, Selective Tilting Arrangement for a Blind System for Coverings for Architectural Openings, which is hereby incorporated herein by reference. While the tilt rod 28 in this embodiment is actuated by a cord tilter 26** (which is described in detail in Canadian Patent No. 2,206, 932 "Anderson", dated Dec. 4, 1997 (1997 Dec. 4), which is hereby incorporated herein by reference), it is understood that other types of actuators may be used, such as a wand tilter or a motorized tilter.

Figure 2:
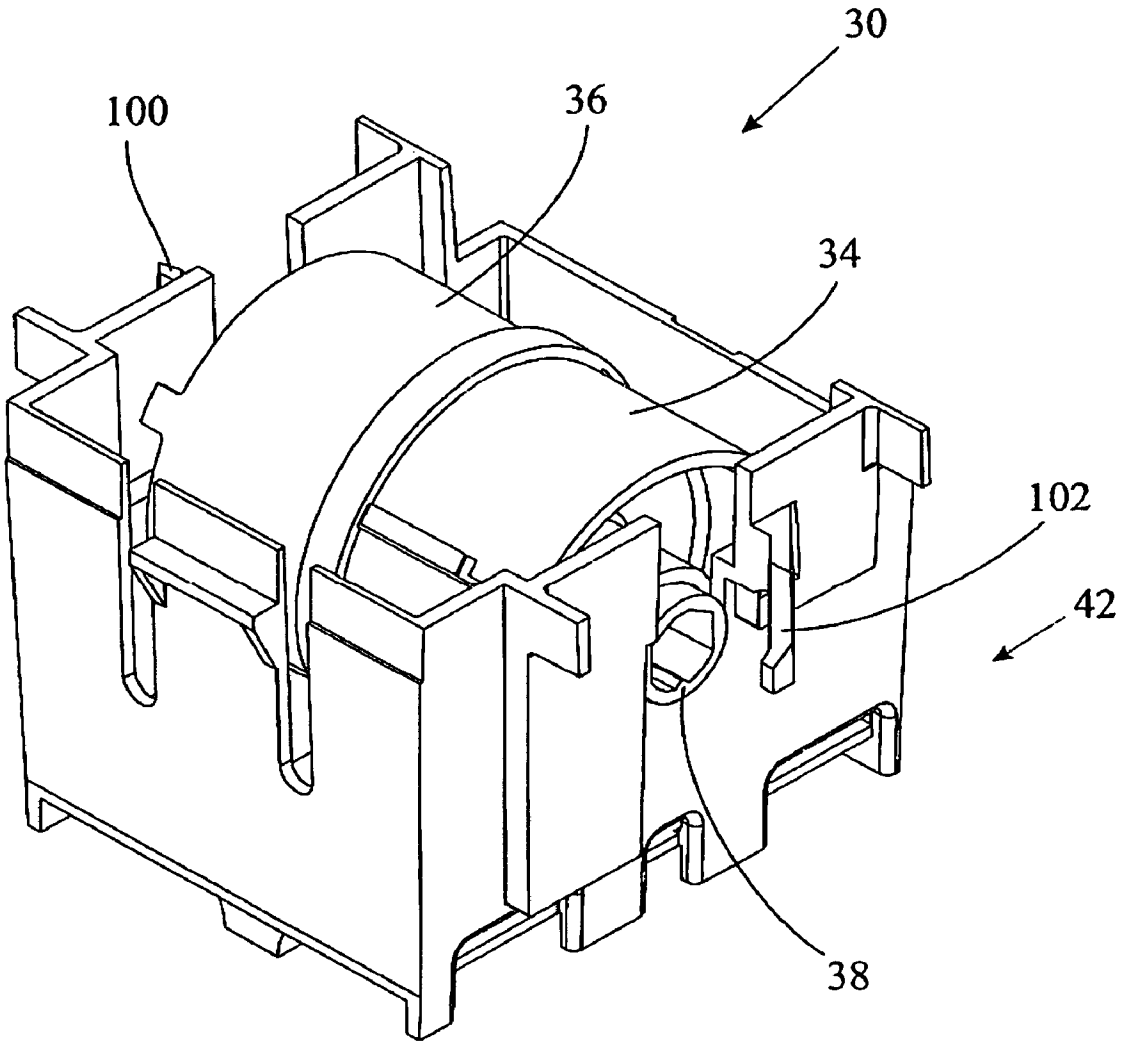
FIG. 2 is a perspective view of one of the tilt stations of FIG. 1, with the housing cover removed for clarity.
Figure 3:
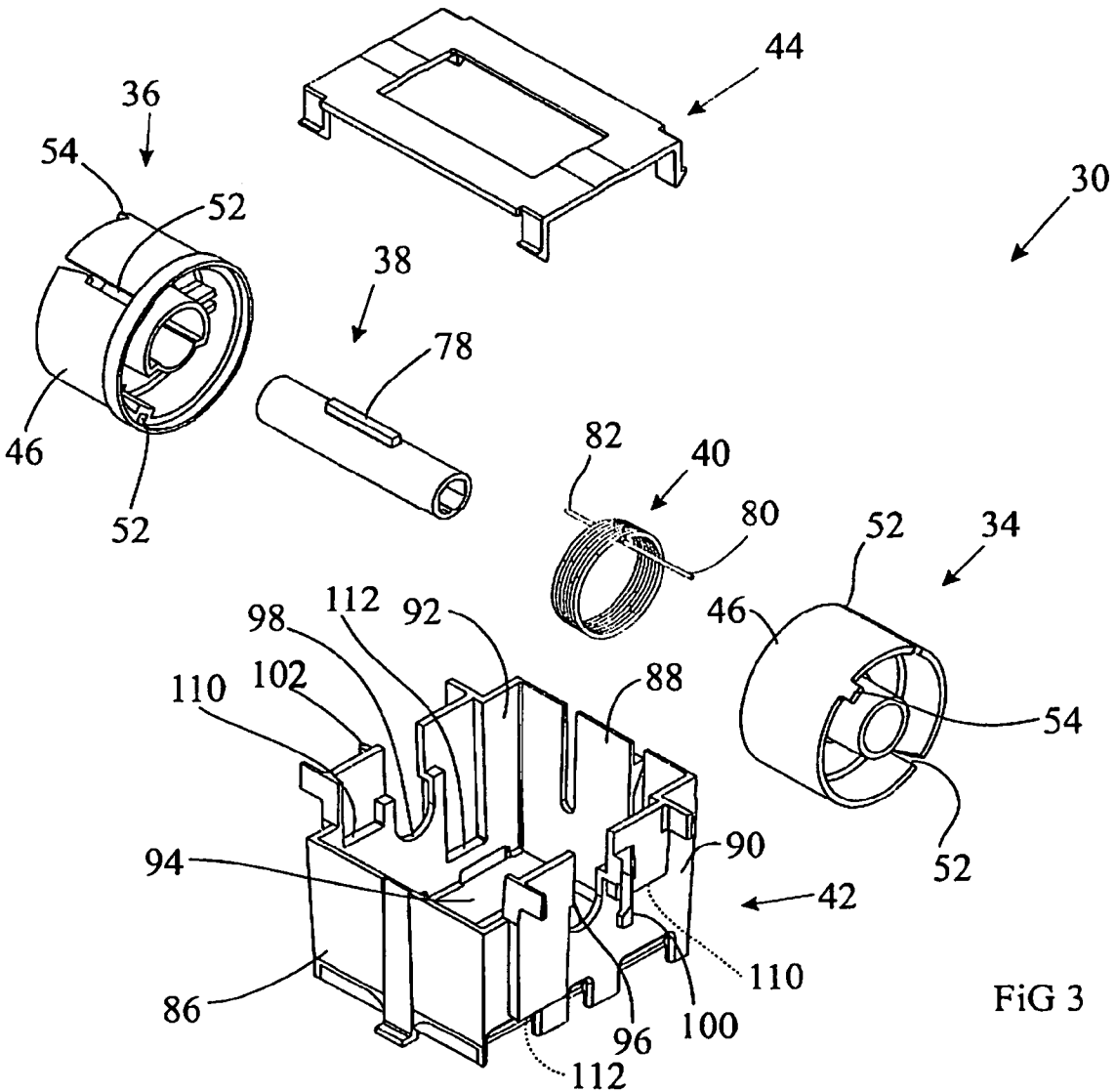
FIG. 3 is an exploded, perspective view of the tilt station of FIG. 2.

Referring briefly to FIGS. 2 and 3, the tilt station 30 includes a first drum 34, a second drum 36, a drum driver 38, a lash spring 40, a housing 42, and a housing cover 44.

Referring to FIGS. 4, 5, 6, and 16, the first drum 34 includes two concentric cylinders 46, 48 interconnected by a centrally located web 50. The outer cylinder 46 defines two axially-extending slotted openings 52 approximately one hundred twenty (120) degrees apart, as well as an axially-projecting limit stop 54 approximately sixty (60) degrees from one of the two slotted openings 52.

Approximately halfway through its axial dimension, the inner cylinder 48 expands abruptly to a larger diameter inner cylinder 58 throughout a substantial portion of its circumference. This results in a crescent-shaped flange 56 (See FIG. 6) extending for approximately two hundred twenty (220) degrees around the circumference of the inner cylinder 48, and this flange 56 terminates at radially-extending shoulders 60, 62. As explained in more detail below, the flange 56 acts to position and contain the drum driver 38 within the tilt station 30, and the shoulders 60, 62 allow the drum driver 38 to rotationally drive each of the drums 34, 36. The web 50 defines a through opening 64 (See FIG. 6) which is used to attach the lash spring 40 to the drums 34, 36, as explained in more detail below.

Figure 8:
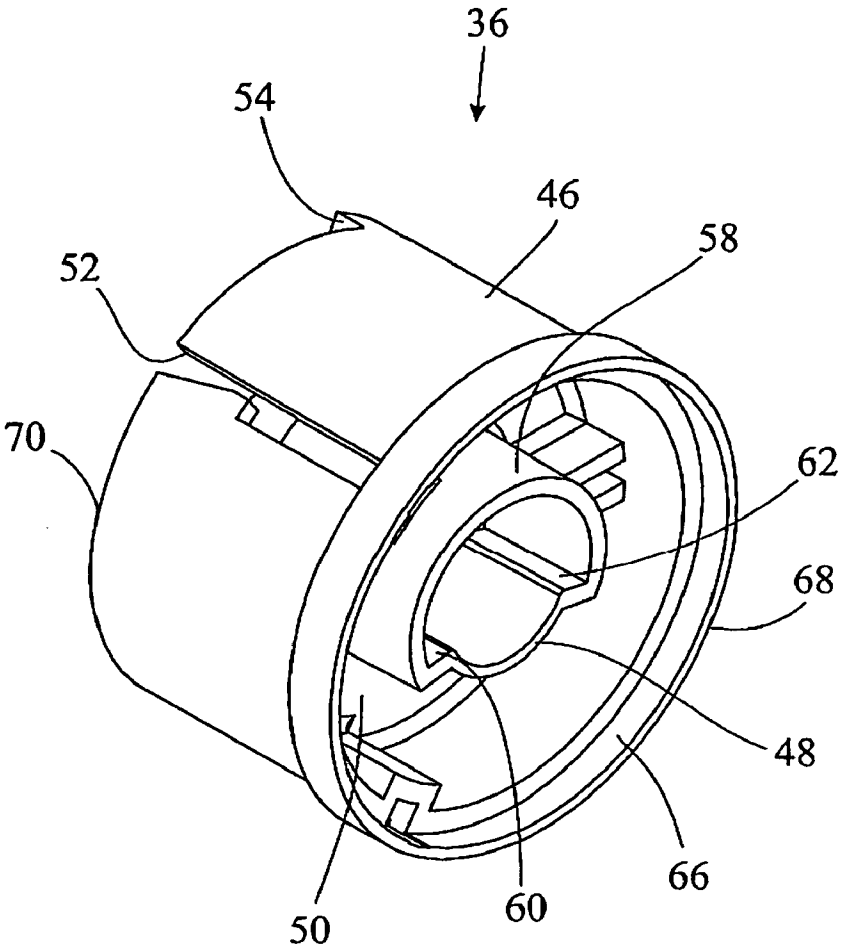
FIG. 8 is an opposite end, perspective view of the drum of FIG. 7.
Figure 7:
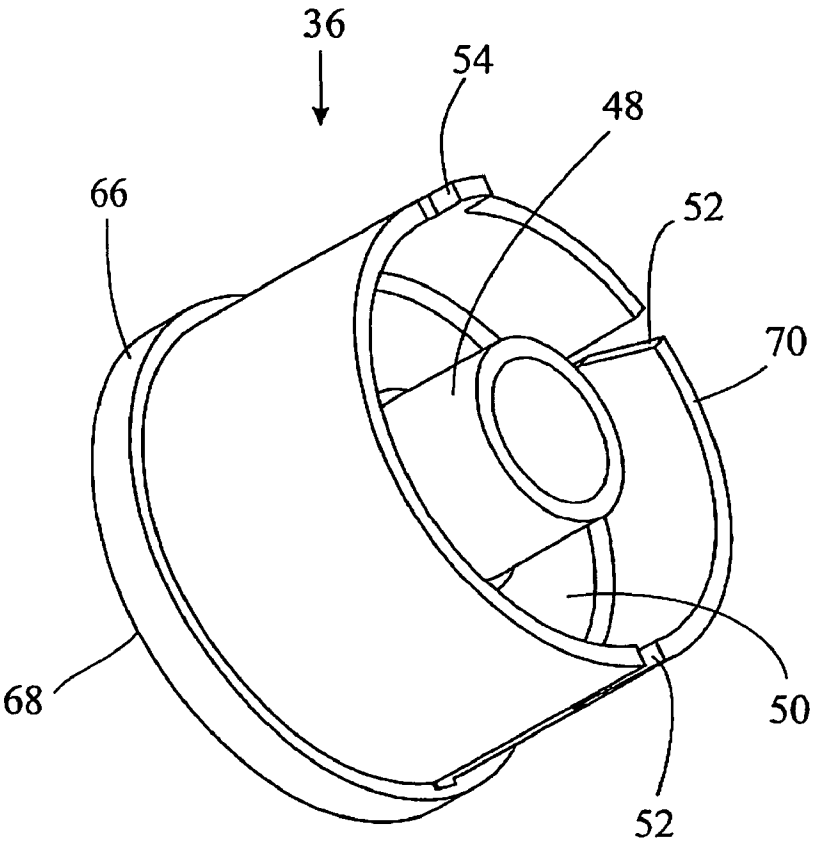
FIG. 7 is a perspective view of the other drum of FIG. 3.

Referring to FIGS. 7 and 8, the second drum 36 is identical to the first drum 34, except that the second drum 36 includes an axially-extending, circumferential ring 66 with an inner diameter which is slightly larger than the outer diameter of the outer cylinder 46. This ring 66 is found only on the end of the drum 36 opposite the end defining the slotted openings 52 and the limit stop 54, and this end where the ring 66 is located is referred to as the inner end 68 of the second drum 36, making the other end the outer end 70. Similarly, the first drum 34 has an inner end 72, and an outer end 74. When the drums 34, 36 are assembled together, the ring 66 of the second drum 36 overlaps the inner end 72 of the first drum 34 to prevent any of the tilt cables 16 from falling in between the first and second drums 34, 36, as will become apparent below.

Figure 12:
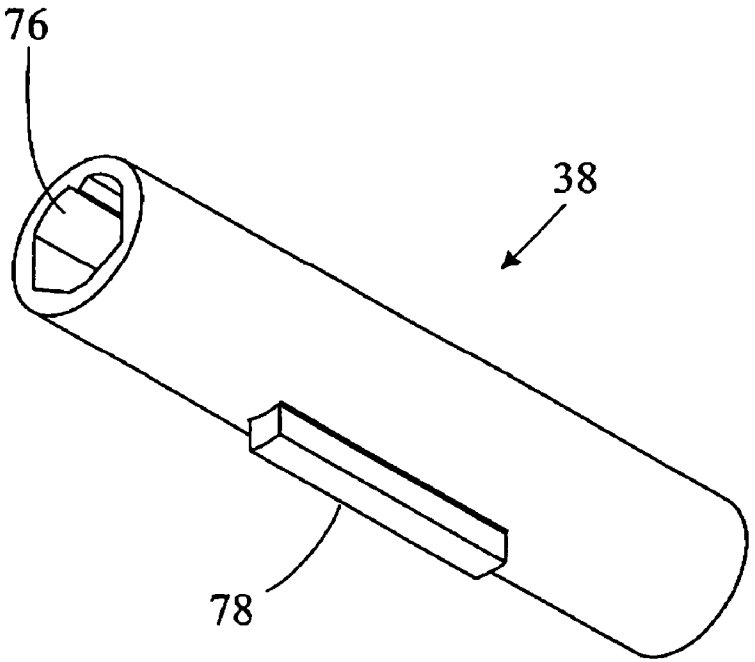
FIG. 12 is an opposite end, perspective view of the drum driver of FIG. 11.
Figure 11:
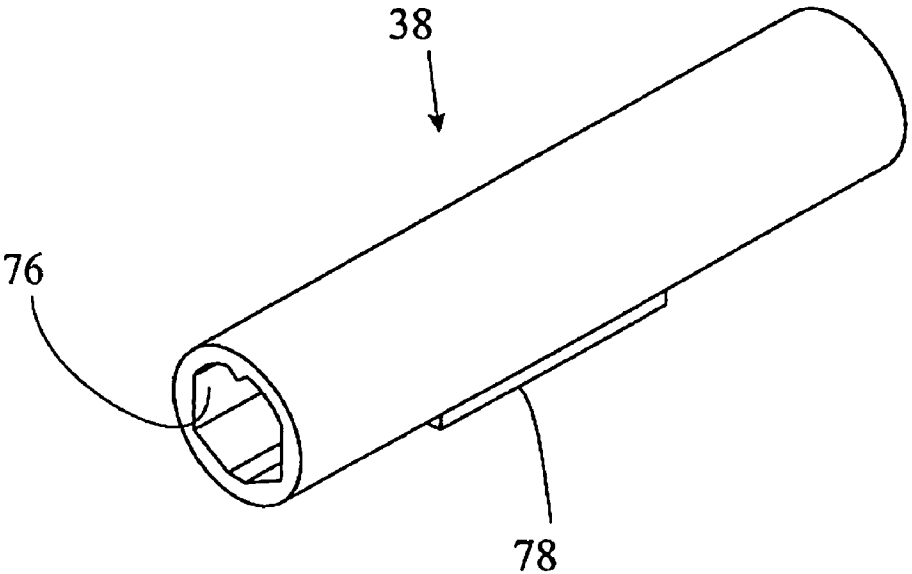
FIG. 11 is a perspective view of the drum driver of the tilt station of FIG. 3.

Referring to FIGS. 11 and 12, the cylindrically-shaped drum driver 38 defines a non-cylindrically profiled, inner, hollow shaft 76 designed to engage the tilt rod 28 such that rotation of the tilt rod 28 causes rotation of the drum driver 38. The drum driver 38 also includes an axially-extending, rectangular key 78 located halfway between the ends of the drum driver 38. The length of the drum driver 38 is slightly longer than the length of the two drums 34, 36 when assembled together, such that the ends of the drum driver 38 extend beyond the drum assembly, and these ends may be used for rotational support of the drum assembly on the saddles 96, 98 of the housing 42, as described in more detail below. The length of the key 78 is substantially equal to the distance from the flange 56 of the first drum 34 to the flange 56 of the second drum 36 when the two drums 34, 36 are assembled together. The outside diameter of the drum driver 38 is slightly smaller than the diameter of the inner cylinder 48 of the first and second drums 34, 36. When the drum driver 38 is inserted into the two drums 34, 36, as described in more detail below, the drum driver 38 lies inside of, and is co-axially aligned with, the two drums 34, 36. The key 78 selectively engages the shoulders 60, 62 of the drums 34, 36 depending on the direction of rotation of the tilt rod 28, as explained in more detail below.

As shown in FIG. 3, the lash spring 40 includes two axially-extending ends 80, 82 which, as explained in more detail below, extend through the openings 64 in the webs 50 of the drums 34, 36, respectively, which ties the first and second drums 34, 36 together and preloads them against the key 78 of the drum driver 38. As shown also in FIG. 3B, the coils of the lash spring 40 lie in the cavity formed between the outer cylinders 46, the larger diameter portions 58 of the inner cylinders 48 and the webs 50 of the drums 34, 36.

Figure 13:
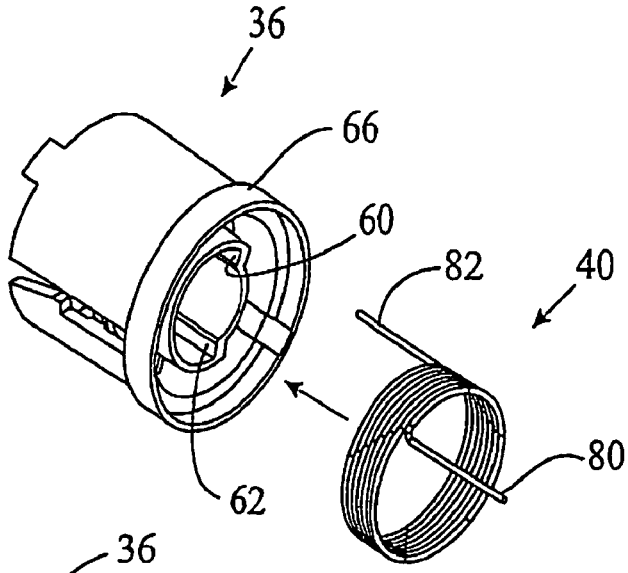
FIGS. 13-15 are a series of perspective views depicting the assembly process of the two drums, the drum driver, and the spring of FIG. 3.
Figure 14:
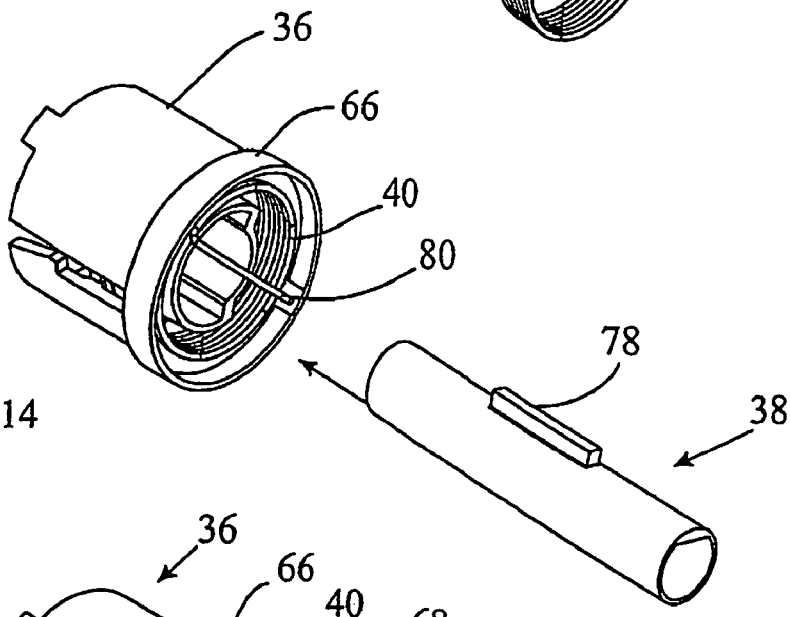
Figure 15:
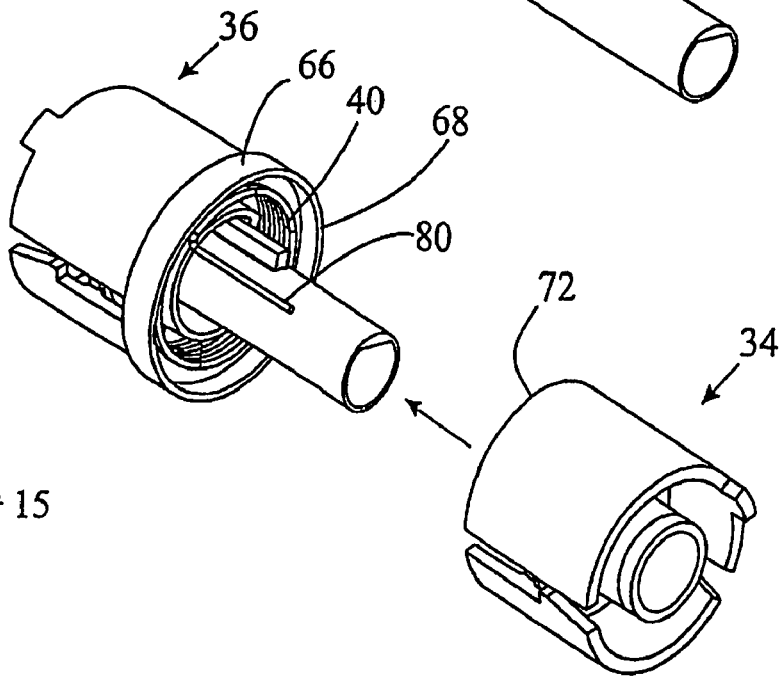

FIGS. 13-15 and 17-19 depict the process of assembling the two drums 34, 36, the drum driver 38, and the spring 40. FIG. 13 indicates that the first step is to insert the end 82 of the spring 40 through the opening 64 (see FIG. 6) in the second drum 36. The next step (FIG. 14) is to insert the drum driver 38 into the inner cylinder 48 of the second drum 36, with one end of the key 78 pushed in (See FIG. 15) until it abuts the flange 56 of the second drum 36. Next, the first drum 34 is assembled by inserting the second end 80 of the spring 40 through the opening 64 in the first drum 34, and then bringing the two drums 34, 36 together until their corresponding inner ends 72, 68 meet, and the ring 66 on the second drum 36 overlaps the inner end 72 of the first drum 34 (See FIG. 17).

Figure 17:
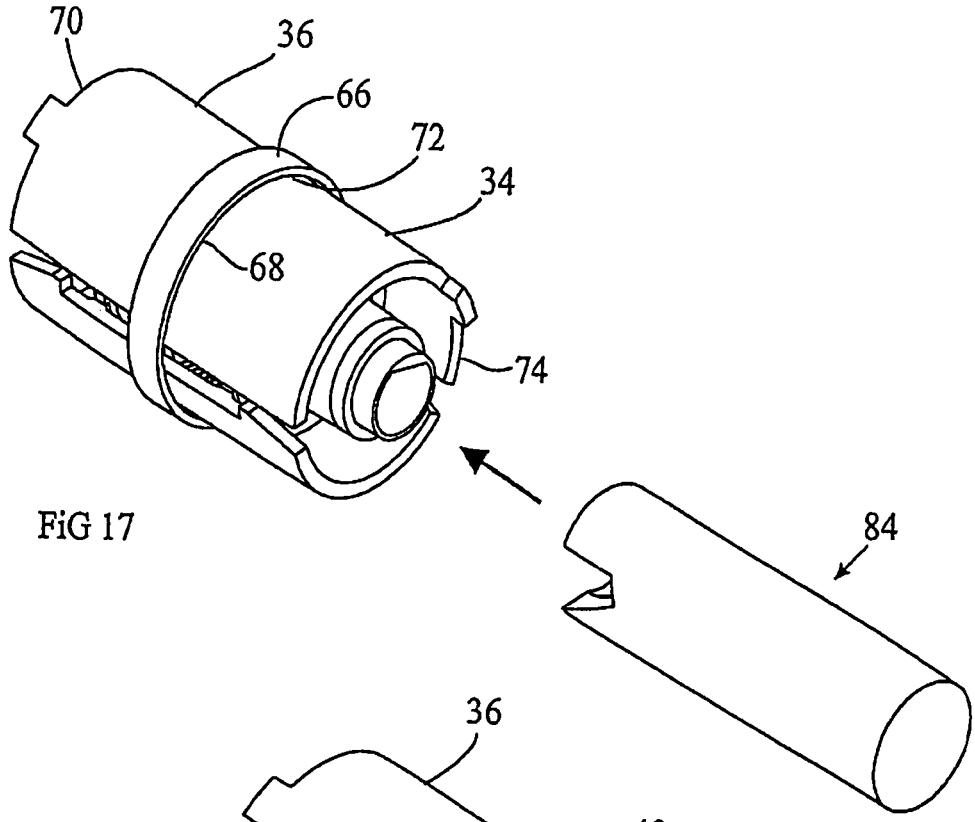
FIGS. 17-19 are a continuation of the series of perspective views depicting the assembly process of the two drums, the drum driver, and the spring of FIG. 3.
Figure 18:
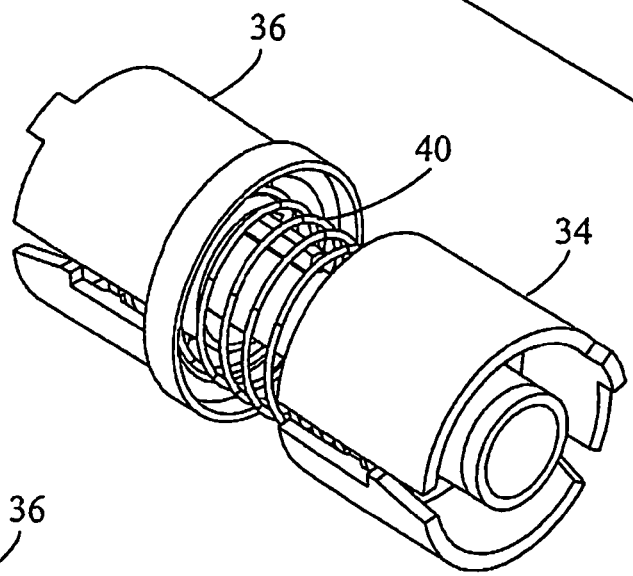

The next step is to bend the ends 80, 82 of the spring 40 which project through the respective openings 64 of the drums 34, 36 in order to secure the ends 80, 82 onto their respective drums 34, 36. A tool 84 (as shown in FIG. 17) may be used for this purpose, or the ends may simply be bent using needlenose pliers, a flathead screwdriver, or other known means. The drums 34, 36 are now assembled with the lash spring 40 and the drum driver 38 inside the assembly. The spring 40 holds the drums 34, 36 together (because the ends 80, 82 of the spring 40 have been bent sideways so they will not slide back out of the drums 34, 36).

The next step (See FIG. 18) is to preload the drums 34, 36 against the key 78 of the drum driver 38. This is accomplished by grabbing each drum 34, 36 and separating them just enough for one of the drums 34, 36 to move axially away far enough to clear the key 78 of the drum driver 38. The drum 34 is then rotated counterclockwise 360 degrees relative to the drum 36, and the drums are brought back together once again, and are then released. Both drums 34, 36 immediately rotate in opposite directions, urged by the biasing force of the lash spring 40, until the first shoulder 60 of the first drum 34 and the second shoulder 62 of the second drum 36 both impact against the key 78 of the drum driver 38. The two drums 34, 36 are now preloaded against the key 78 of the drum driver 38.

Figure 19:
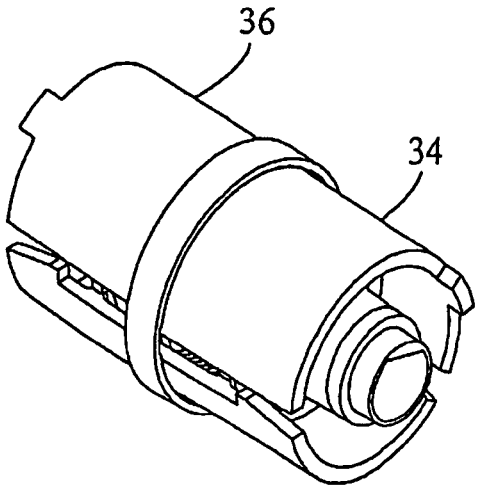

As indicated in FIG. 19, either drum 34, 36 may be rotated about their common axis of rotation (which also corresponds to the axis of rotation of the drum driver 38). If the first drum 34 is rotated clockwise (as seen from the vantage point of FIG. 19) while holding the second drum 36 stationary, the second shoulder 62 of the first drum 34 impacts against the key 78 of the drum driver 38, causing the drum driver 38 to rotate clockwise as well. This key 78 in turn impacts against the second shoulder 62 of the second drum 36 such that the second drum 36 is also caused to rotate clockwise, and the entire assembly rotates as a unit unless and until something impedes such rotation (which, as is discussed below, is precisely what may happen when the limit stop 54 on the drums 34, 36 hits against one of the limit stops on the housing 42).

On the other hand, if the first drum 34 is rotated counterclockwise, its second shoulder 62 is moving away from the key 78, such that the first drum 34 may rotate relative to the second drum 36 which may thus remain stationary. However, in order to rotate the first drum 34, one must overcome the preload force of the spring 40.

The same situation is true of the second drum 36, provided that the vantage point is the opposite end of that of FIG. 19. That is, as seen from the rear of FIG. 19, the second drum 36 can be rotated clockwise only if the entire assembly rotates with it, and it can be rotated counterclockwise while the first drum 34 remains stationary, provided that the user overcomes the preload force of the spring 40. Throughout the rest of this specification, we will refer to the position of the drums 34, 36 where no external force is acting to overcome the preload force of the spring 40 as the neutral position for the tilt station 30. That is the position in which the first drum 34 has its second shoulder 62 against the key 78 and the second drum 36 has its second shoulder 62 against the key 78.

Figure 10:
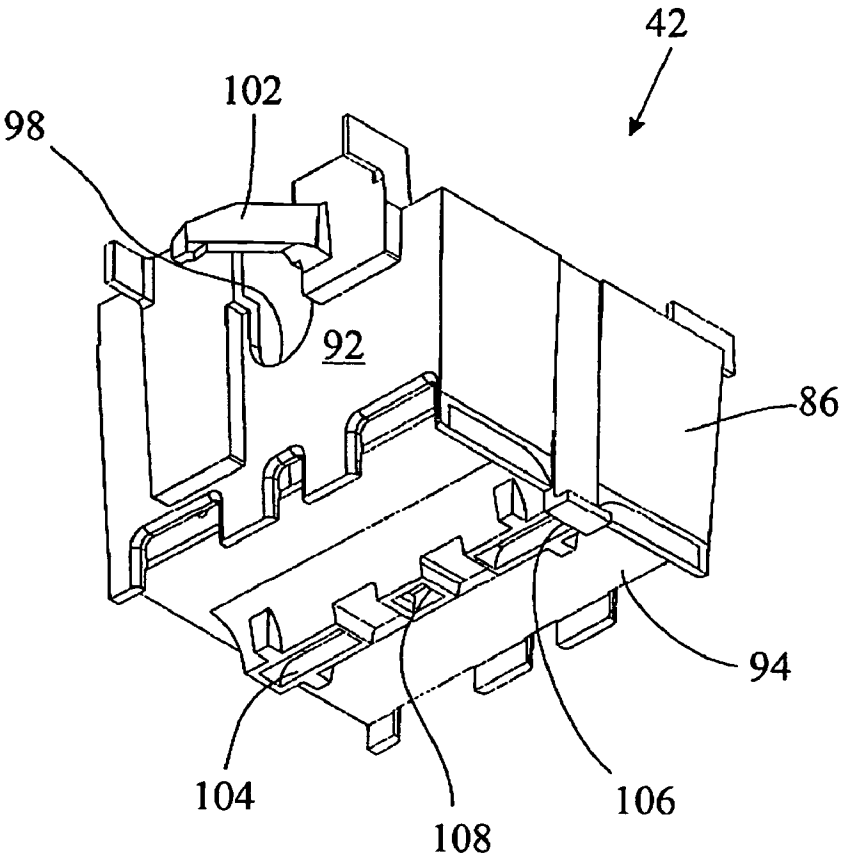
FIG. 10 is a lower angle, opposite end, perspective view of the housing of FIG. 9.
Figure 9:
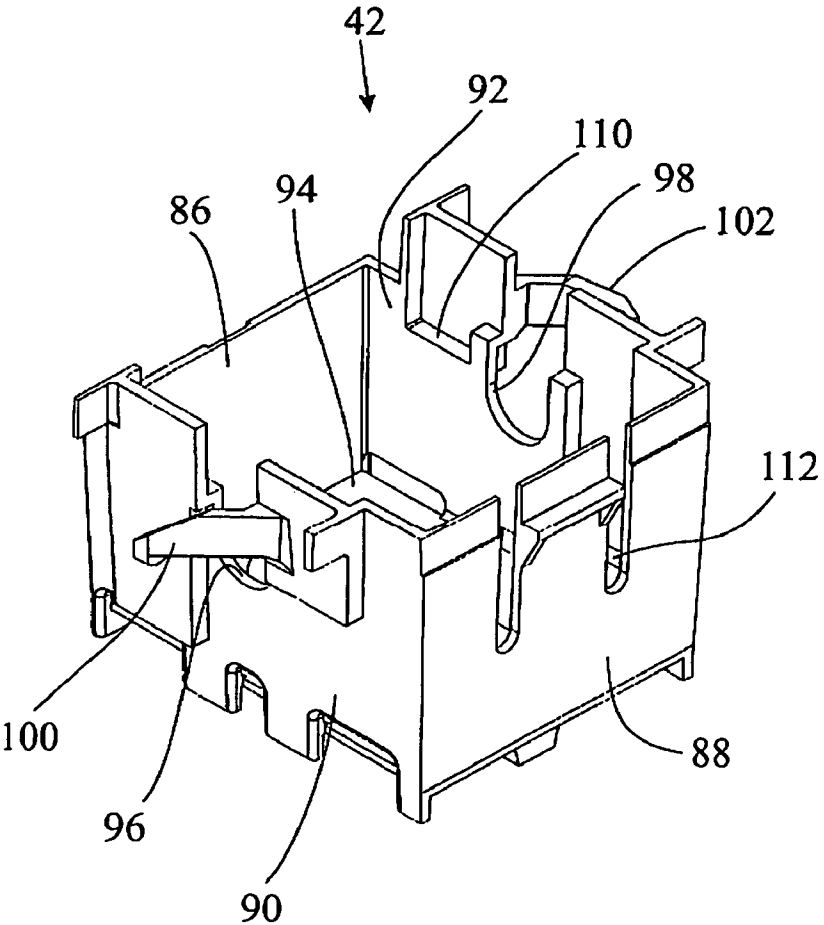
FIG. 9 is a perspective view of the housing of the tilt station of FIG. 3.

Referring now to FIGS. 3, 9, and 10, the housing 42 includes two side walls 86, 88, two end walls 90, 92, and a bottom wall 94. The end walls 90, 92 define "U"-shaped saddles 96, 98 respectively, which provide rotational support of the drum assembly by supporting the ends of the drum driver 38. Arms 100, 102 extend at approximately a 45 degree angle from the planes defined by the end walls 90, 92, and they project over and above the centerline of the tilt rod 28 as it passes through the drum driver 38, thus preventing the drum assembly from lifting up out of the housing 42. The ends of the inner cylinders 48 of the drums 34, 46 are larger in diameter than the saddles 96, 98, and the distance between the ends of the inner cylinders 48 is just slightly less than the distance between the saddles 96, 98, so the inner cylinders 48 will abut one of the saddles 96, 98 if the drums 34, 36 are shifted in an axial direction, thus preventing the drums 34, 36 from shifting very much in the axial direction.

On either side of each saddle 96, 98 there are two shelves 110, 112 (best seen in FIG. 3, against the end wall 92, but also present in the opposite end wall 90), with the upper shelf 110 being less recessed (at a higher elevation) than the lower shelf 112. These shelves 110, 112 act as limit stops by cooperating with the limit stop 54 on their respective drums 34, 36 to limit the degree to which the drums 34, 36 are free to rotate in either direction. This limit stop feature is explained in more detail below.

The bottom wall 94 of the housing 42 defines two elongated slotted openings 104, 106, and a shorter rectangular opening 108. The elongated slotted openings 104, 106 are for the front and rear tilt cables to pass through the housing 42 and through corresponding openings (not shown) in the head rail 12. The shorter rectangular opening 108 is for the lift cords 20.

Figure 3B:
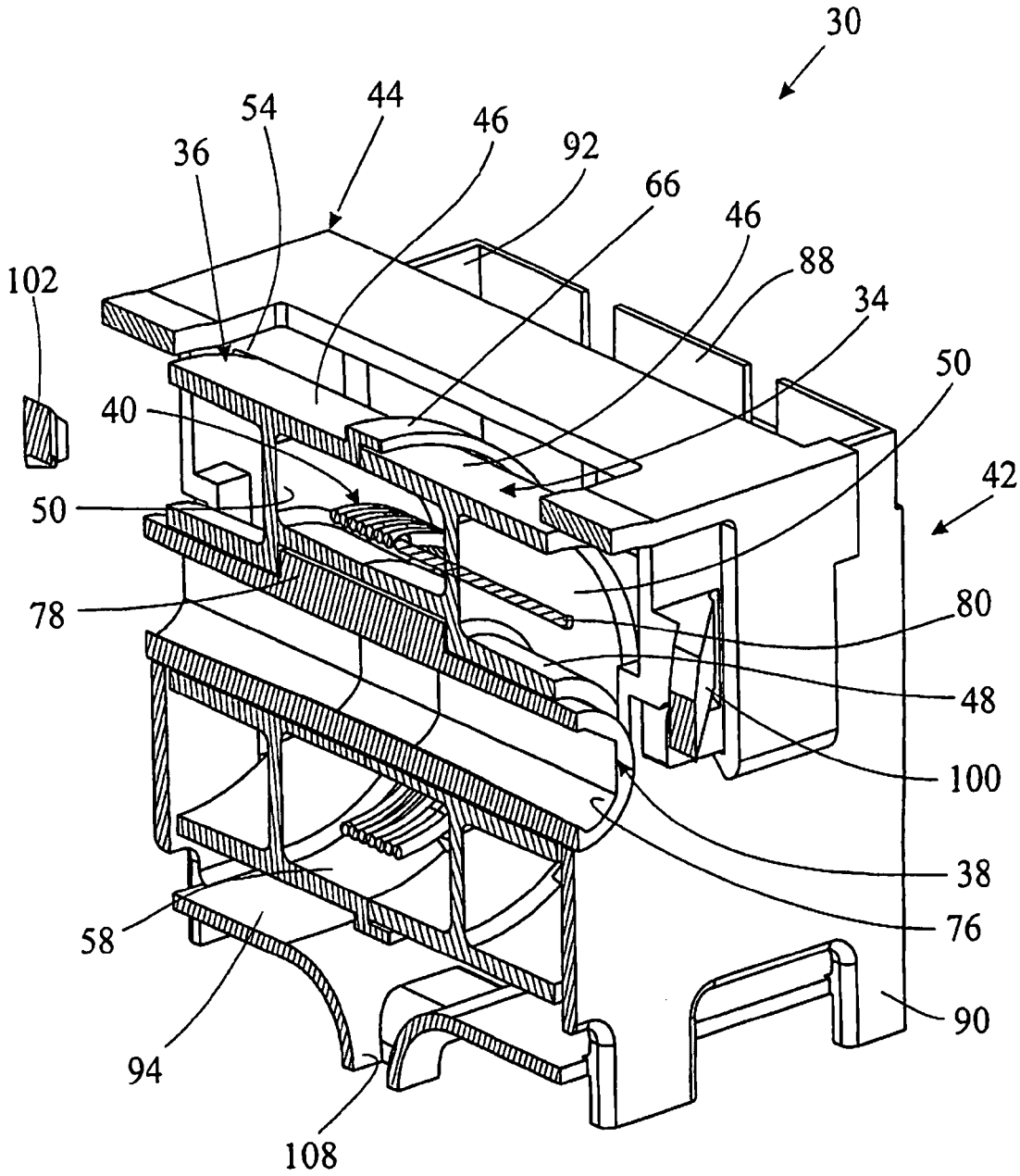
FIG. 3B is a perspective view of a vertical section taken along the axis of rotation, of the tilt station of FIG. 2.
Figure 5:
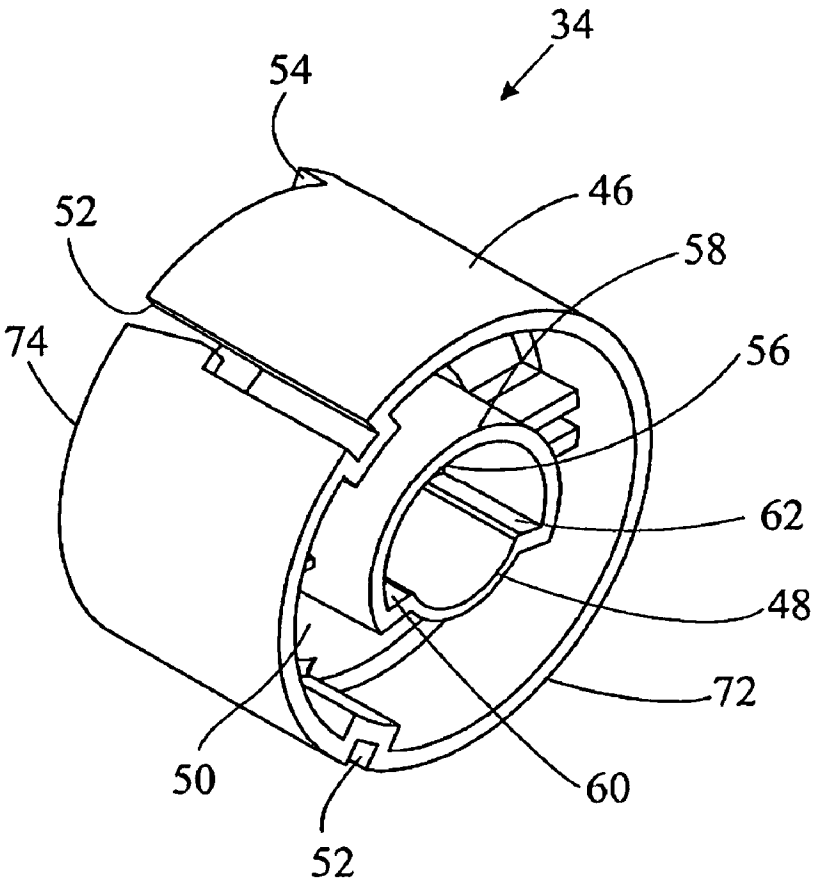
FIG. 5 is an opposite end, perspective view of the drum of FIG. 4.
Figure 4:
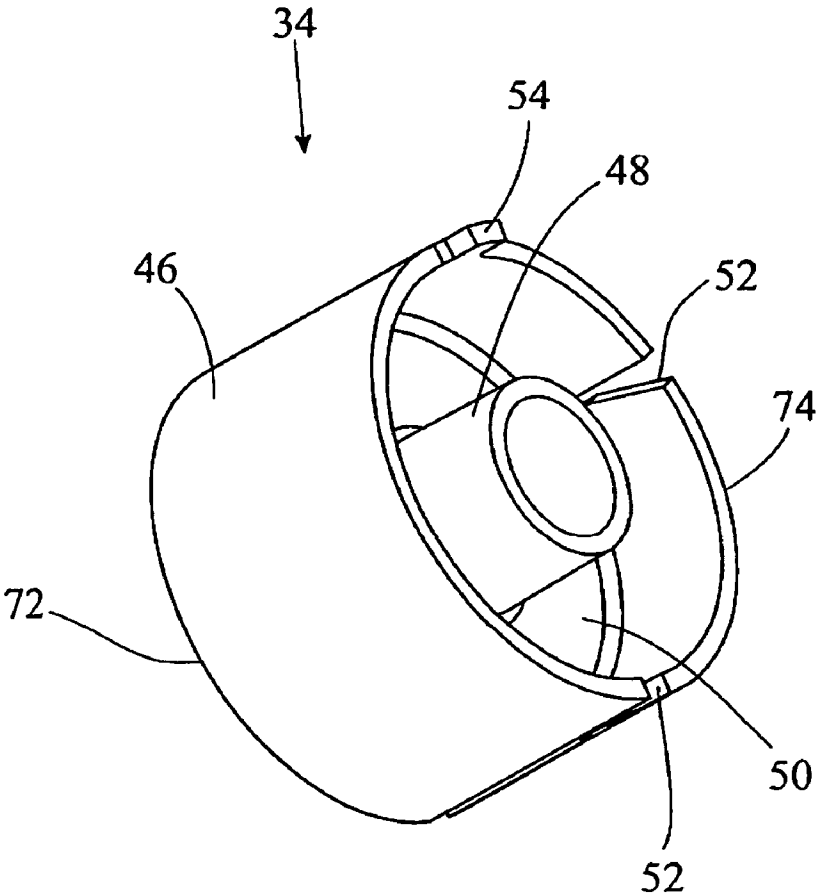
FIG. 4 is a perspective view of one of the drums of FIG. 3.
Figure 16:
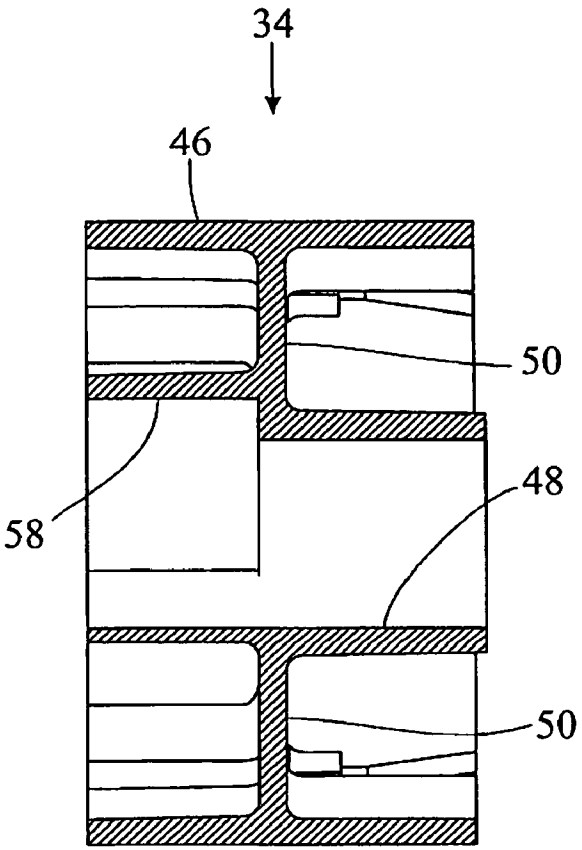
FIG. 16 is a section view through the drum of FIG. 5.
Figure 6:
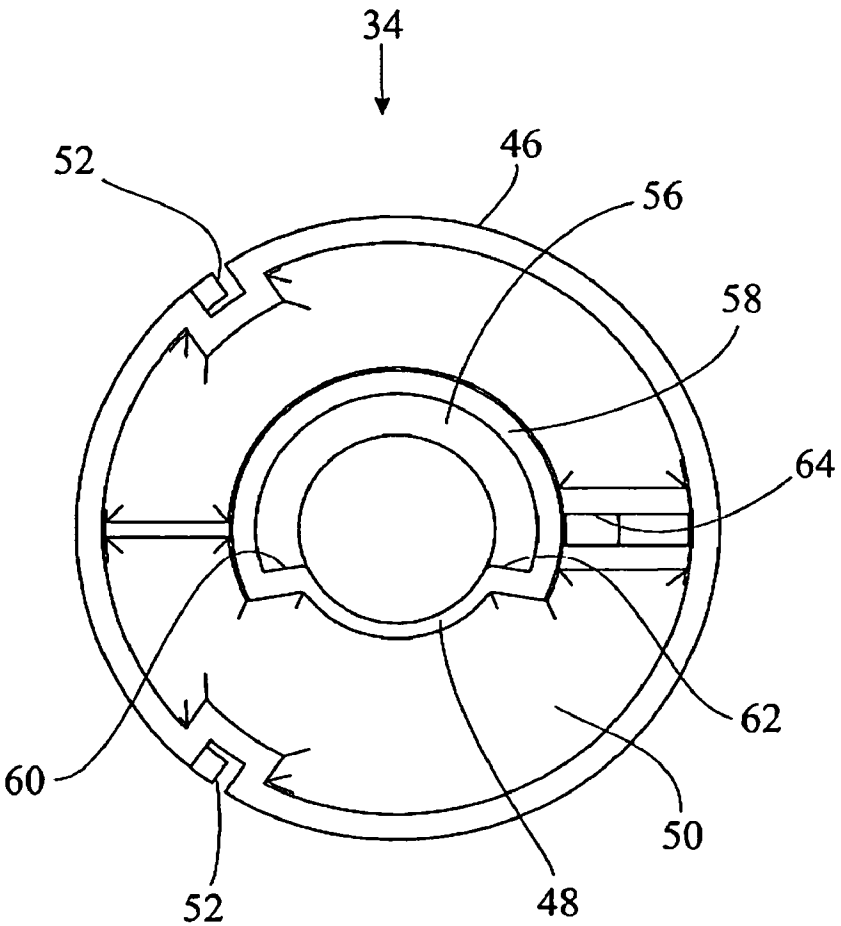
FIG. 6 is a front end view of the drum of FIG. 5.

Referring to FIGS. 3 and 3B, a housing cover 44 snaps over and onto the housing 42 to add dimensional integrity to the housing 42 and to prevent the tilt cables 16 from getting tangled or falling off of the drums 34, 36 in the event of a slack condition on the cables 16 (such as when someone physically picks up some of the slats 14 of the blind 10).

Referring to FIGS. 1 and 3, once the drum assembly has been assembled and preloaded as described in FIGS. 13-19, it is dropped into the housing 42, with the ends of the drum driver 38 being rotationally supported by the saddles 96, 98 of the housing 42. The tilt rod 28 is inserted through the hollow shaft 76 of the drum driver 38, and one end of the tilt rod 28 is connected to the cord drive tilter mechanism 26, as shown in FIG. 1. Typically, two or more tilt stations 30 are mounted to the tilt rod 28, and the entire tilt drive assembly is installed in the head rail 12 of the blind 10.

At some point either before or after the installation of the tilt drive assembly onto the head rail 12, the tilt cables 16 are attached to the drums 34, 36 according to the required routing to obtain the desired configuration as explained in more detail below. To attach the tilt cables 16 to the drums 34, 36, an enlargement (such as a knot or bead) is tied to the end of the tilt cable which is to be secured, and this enlargement is inserted behind the desired slotted opening 52 in the outer cylinder 46 of the desired drum 34, 36, with the rest of the tilt cable 16 extending through that slotted opening 52. The enlargement prevents the tilt cable 16 from pulling out of the respective drum 34, 36 and thereby quickly and effectively attaches the tilt cable 16 to its respective drum 34, 36.

Double Pitch Configuration for the Co-axial Drum Design

Figure 20:
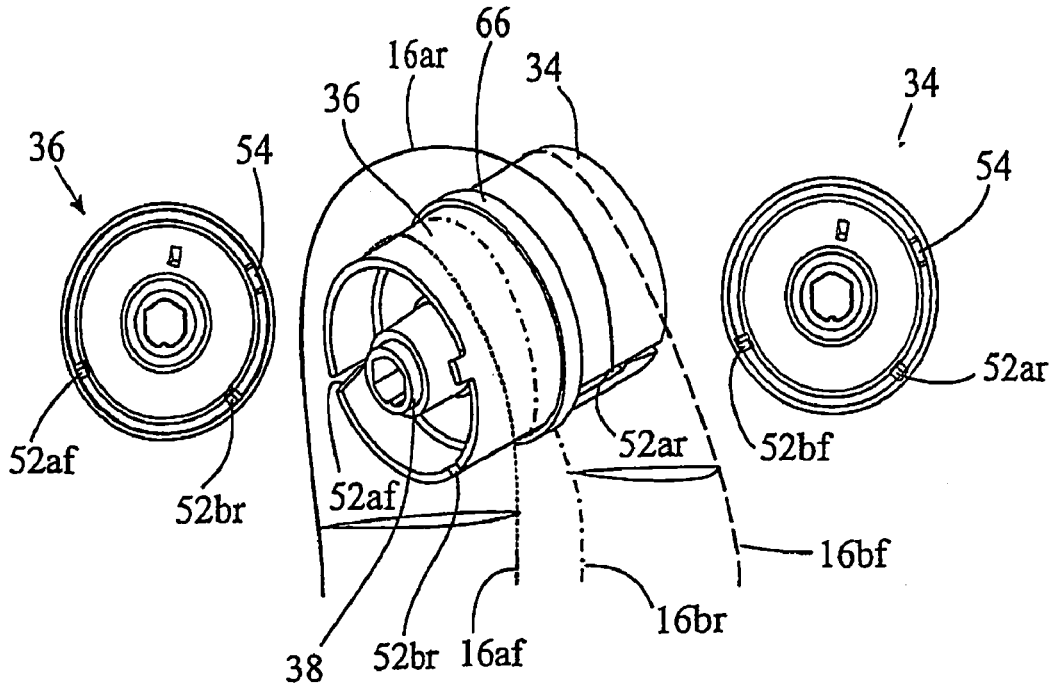
FIG. 20 is schematic, perspective view, partially broken away, of the blind of FIG. 1, showing the position of the drums and the routing of the tilt cables for a double pitch configuration, as well as corresponding end views of the drums to more clearly indicate the relative rotational positions of the drums.
Figure 20:
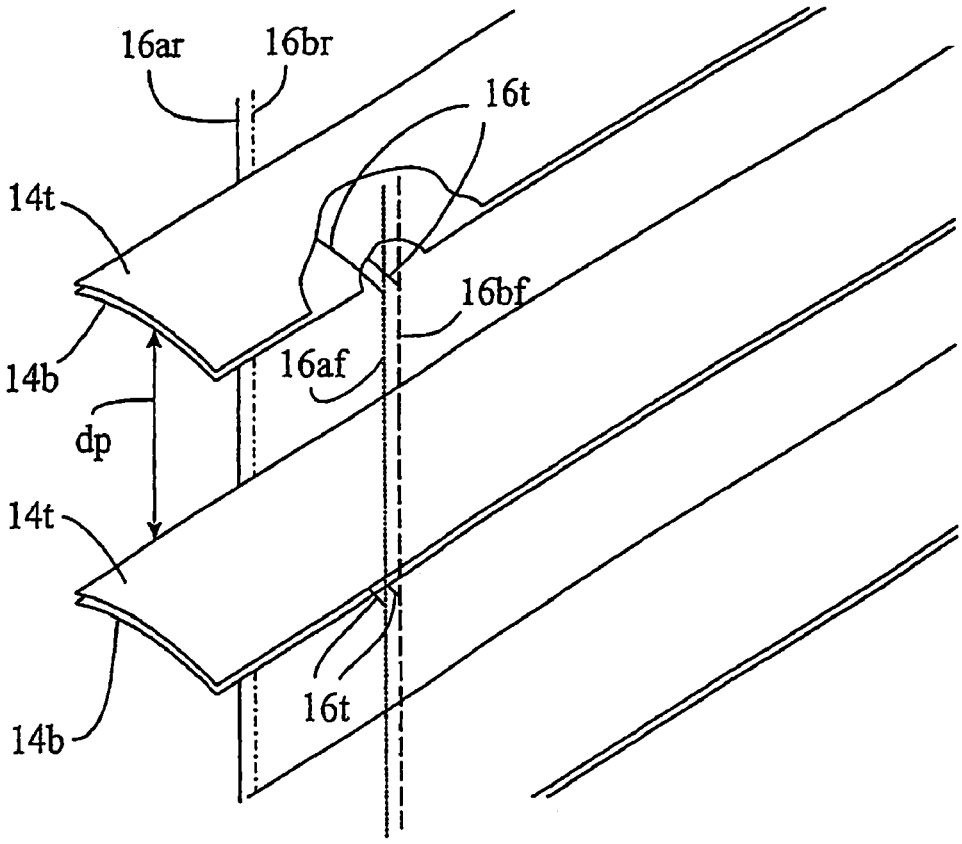
Figure 21:
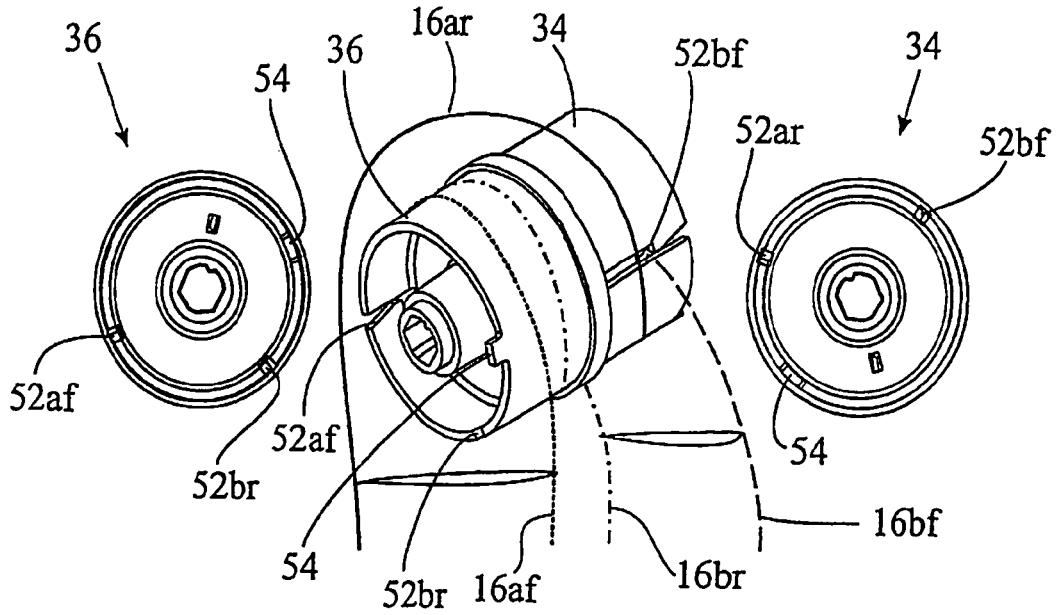
FIG. 21 is similar to FIG. 20 but showing the positions of the slats of the blind and of the drums when the blind is closed room-side down.
Figure 21:
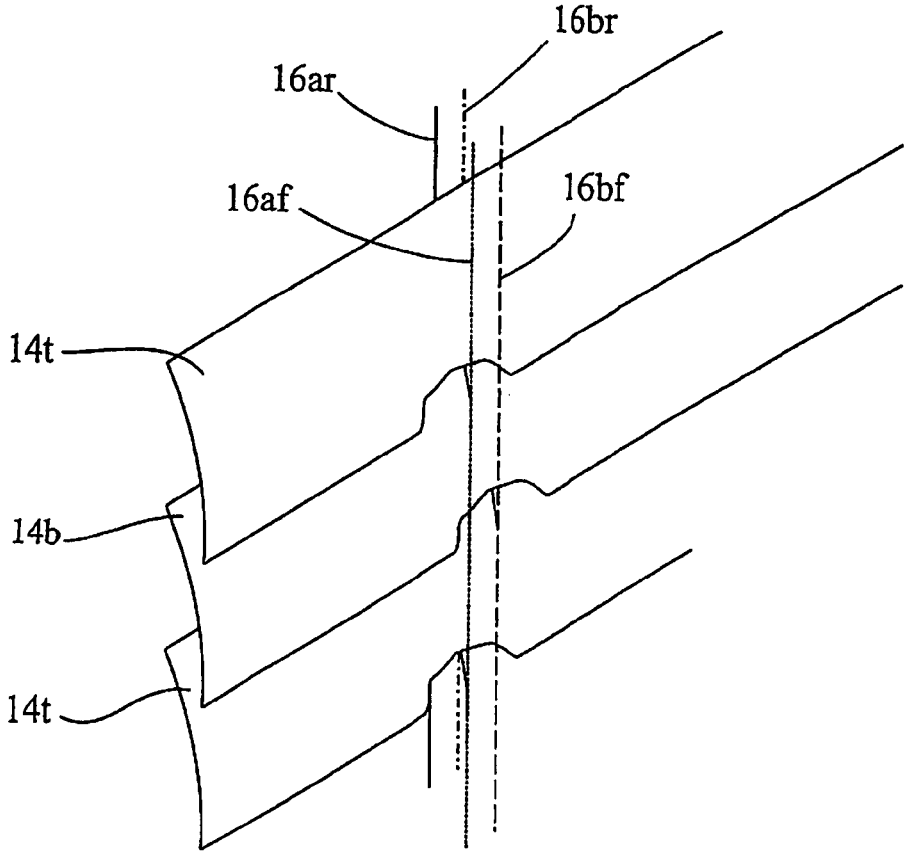
Figure 22:
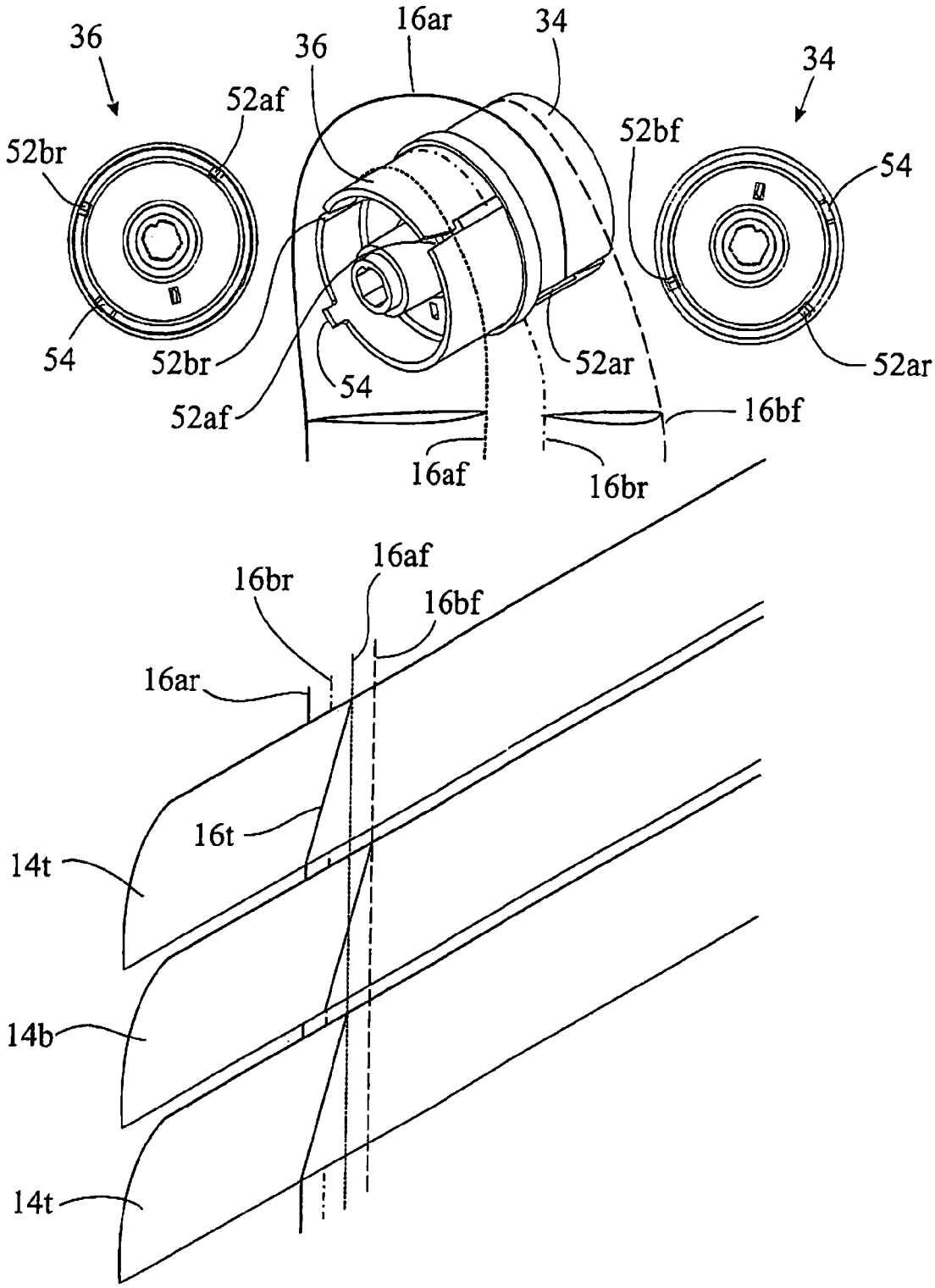
FIG. 22 is similar to FIG. 20 but showing the positions of the slats of the blind, and of the drums when the blind is closed room-side up.

FIGS. 20-22 depict the routing of the tilt cables for a typical double pitch blind configuration. In these three figures, and in all similar figures to follow, the routing of the tilt cables 16 and the position of the drums 34, 36 (particularly to depict the relative location of the tie-off points of the ends of the tilt cables 16 to the drums 34, 36) are shown relative to the corresponding position of the slats 14 of the blind 10. For greater clarity, end views of the corresponding drums 34, 36 are included as part of these views in order to help show the location of the tie-off point for each of the tilt cables 16 (tied off at the slotted openings 52 of the drums 34, 36), or the location of the limit stop 54.

As was explained earlier, the tilt cables are generically designated as item 16, but are further identified by the following suffixes:

- "a" is for the first set of tilt cables, those supporting the upper (or top) slat 14*t* in each pair of top and bottom slats 14*t*, 14*b*
- "b" is for the second set of tilt cables, those supporting the lower (or bottom) slat 14*b* in each pair 14*t*, 14*b*
- "f" is for the front tilt cables, those on the room side of the blind
- "r" is for the rear tilt cables, those on the wall side (also referred to as the window side) of the blind
- "x" is for an actuator cord which is typically secured to one of the tilt cables 16

Referring briefly to FIG. 1, note that the tilter mechanism 26 is a worm gear cord drive mechanism, as taught in U.S. Pat. No. 6,561,252, which is hereby incorporated herein by reference. The cord pulley is directly connected to a worm which drives a gear to which the tilt rod 28 is connected. As is well known in the art, in a worm gear mechanism, the worm is able to drive the gear in either clockwise or counterclockwise directions. However, the gear is unable to back drive the worm; the mechanism locks up the moment the gear begins to back drive the worm. While a worm gear is a very convenient and expedient manner for ensuring that the tilter mechanism 26 cannot be back driven, other means (such as ratchets, one way brakes, or clutches, all with suitable release mechanisms) may be employed in alternative embodiments to ensure this same condition.

The ability to drive the tilt rod 28 in either direction (clockwise or counterclockwise) from the input end (using the cord tilter 26), but not to be able to back drive the tilt rod 28 from the output end is a useful characteristic for the operation of the tilt station 30, as is discussed in more detail below.

Referring to FIG. 20, the drums 34, 36 are in their neutral position (again, this neutral position refers to the position of the drums 34, 36 where no external force is acting to overcome the preload force of the spring 40, and thus when the first drum 34 has its second shoulder 62 against the key 78, and the second drum 36 has its second shoulder 62 against the key 78). The slats 14 are open in a double pitch configuration, wherein each pair of adjacent slats 14*t*, 14*b* is stacked right up against each other, and there is a large empty space between this pair of adjacent slats 14*t*, 14*b* and the next pair of adjacent slats 14*t*, 14*b*. This large empty space is approximately twice the standard distance, or double the pitch (dp) between slats of a conventional blind having evenly-spaced slats.

The top slat 14*t* of each pair of top and bottom slats 14*t*, 14*b* is supported by a cross cord 16*t* extending between the first set of front and rear tilt cables 16*af*, 16*ar*. (For expediency, we will sometimes refer to the tilt cables when we mean the entire associated ladder tape including both the front and rear tilt cables and cross cords connecting those front and rear tilt cables, and this usage will be obvious within the context in which it used). The first rear tilt cable 16*ar* is routed over the first drum 34 of the tilt station 30 and is secured to one of the slotted openings 52*ar* in the first drum 34 (note that the generic designation of the slotted opening is 52, as shown, for instance, in FIG. 5, but this designation has been modified with the suffix ar, which corresponds to the suffix of the tilt cable 16*ar* which is secured to this particular slotted opening. This nomenclature will be followed throughout this specification). The first front tilt cable 16*af* is routed over the second drum 36 and is secured to the slotted opening 52*af* on the second drum 36. The ring 66 of the second drum 36 prevents the tilt cables from falling in between the two drums 34, 36.

Similarly, the bottom slat 14*b* of each pair of slats 14*t*, 14*b* is supported by the cross cords 16*t* extending between the second set of front and rear tilt cables 16*bf*, 16*br*. The rear tilt cable 16*br* of the second set is routed over the second drum 36 and is secured to the slotted opening 52*br* in the second drum 36. Finally, the front tilt cable 16*bf* of the second set of tilt cables is routed over the first drum 34 and is secured to the slotted opening 52*bf* on that first drum 34.

All of the tilt cables 16 are tied off to the drums 34, 36 such that, when the drums are in their "neutral" position, as shown in FIG. 20, the slats 14 are arranged in the double pitch configuration, wherein the pairs of adjacent top and bottom slats 14*t*, 14*b* are stacked up against each other, creating a large, double pitch gap "dp" between the sets of paired slats 14*t*, 14*b*.

Referring now to FIGS. 1 and 21, one of the tilt cords 24 is pulled so as to cause rotation of the tilt rod 28 in the clockwise direction (as seen from the vantage point of FIGS. 1 and 21). The clockwise rotation of the tilt rod 28 causes clockwise rotation of the drum driver 38 (and of the key 78) in the tilt station 30. As the key 78 rotates, it pushes against the first shoulder 60 (See FIG. 5) of the first drum 34, thus causing the first drum 34 to rotate clockwise as well. The second drum 36 also wants to follow the key 78, since the lash spring 40 is preloading the second drum 36 against the key 78. However, very shortly after the second drum 36 begins to rotate clockwise, its limit stop 54 impacts against the upper shelf limit stop 110 (See FIG. 3) on its end of the housing 42, stopping any further clockwise rotation of the second drum 36, despite the urging of the lash spring 40. Naturally, since the second drum 36 has stopped rotating, the user now must exert enough force to overcome the biasing force of the lash spring in order to continue rotating the tilt rod 28, the drum driver 38, and the first drum 34. As the user continues to rotate the tilt rod 28 in the clockwise direction, the first drum 34 continues to rotate until its limit stop 54 impacts against the lower shelf limit stop 112 on its respective end wall 90 of the housing 42. At this point, the slats are in the closed position, room side down, as shown in FIG. 21. The change in positions of the drums 34, 36 can be seen more clearly by comparing the starting position of the limit stop 54 on the first drum 34, shown in FIG. 20 (at the neutral position), with the ending position of the limit stop 54 on the first drum 34 shown in FIG. 21, which indicates that the first drum 34 has rotated clockwise through almost a full 180 degrees of travel.

The slotted openings 52*ar* and 52*bf* on the first drum 34, which are connected to the first rear tilt cable 16*ar* and the second front tilt cable 16*bf*, also have rotated the same distance of approximately 180 degrees of travel. As a result, the rear tilt cable 16*ar* of the top slat 14*t* has been pulled up a distance approximately equal to $\pi \times r$ (where r is the radius of the drum 34), and the front tilt cable 16*bf* of the bottom slat 14*b* has been extended the same distance. The other two tilt cables 16*af*, 16*br*, which are connected to the second drum 36, remain practically motionless. As a result, the front (room side) edges of the top slats 14*t* do not move, while the rear (wall side) edges of these top slats 14*t* swing up for a room-side down tilted closed orientation (as seen in FIG. 21). Similarly the rear (wall side) edges of the bottom slats 14*b* move up only a very short distance, while the front (room side) edges of these bottom slats 14*b* swing down to complete the room-side down tilted closed orientation of the blind as shown in FIG. 21.

To summarize, in FIG. 21, the second drum 36 does not rotate (or rotates a very short distance of just a few degrees of travel before the limit stops prevent its further rotation), and the first drum 34 rotates clockwise (as seen from the left FIG. 21) in order to move the double pitch fully open blind of FIG. 20 to the closed room-side down blind of FIG. 21. The very short rotation of the second drum 36 allow the edges of adjacent pairs of slats 14 to overlap each other so that there is no light gap visible when the blind is closed.

Note that the limit stops 110, 112 (See FIG. 3) are designated upper limit stop 110 and lower limit stop 112 as this is how they are depicted in the figures and this designation makes it easier to distinguish the two stops 110, 112. However, the limit stops 110, 112 may both be at the same height relative to each other, so it may be more accurate simply to refer to them as a first stop 110 and a second stop 112.

The lash spring 40 urges the drums 34, 36 back to the neutral position, urging the first drum 34 to rotate counterclockwise and urging the second drum 36 to rotate clockwise. However, there are mechanisms in place that prevent both of these rotations, as explained below. The second drum 36 cannot rotate clockwise any further due to the interaction of its limit stop 54 with the limit stop 110 of the housing 42. The first drum 34 cannot rotate counterclockwise, because it is stopped by the cord tilter 26. In order for the first drum 34 to rotate counterclockwise, it would have to push the drum driver 38 in the counterclockwise direction, since the key 78 of the drum driver 38 is in contact with the first shoulder 60 of the first drum 34. Rotating the drum driver 38 would also require rotation of the tilt rod 28, since the mating non-circular cross-sections of the drum driver 38 and the tilt rod 28 cause them to rotate together. However, in order for the tilt rod 28 to be driven counterclockwise by the drum 34, it would have to drive the worm gear of the tilter 26 (as indicated earlier, this tilter 26 is described in Canadian Patent No. 2,206,932 "Anderson", dated Dec. 4, 1997 (1997 Dec. 4), which is hereby incorporated by reference). However, as was explained earlier, the worm gear cannot be back driven, so any attempt by the tilt rod 28 to drive the tilter 26 causes the tilter mechanism 26 to lock up. Therefore, the slats 14 of the blind 10 remain in the position desired by the user unless and until the user drives them to a new position by pulling on one of the tilt cords 24 on the input end of the tilter 26. To return the blind from this position to the neutral position of FIG. 20, the user would pull on the other tilt cord 24, driving the tilt mechanism, tilt rod 28, and the drum driver 38 in the counterclockwise direction. This allows the spring 40 to bring the first drum 34 back to the neutral position, while the second drum 36 remains in the same position.

FIG. 22 depicts the same double pitch blind as FIG. 20 but with the tilt mechanism having moved the blind to the position in which the slats are tilted closed room-side up. To achieve this from the neutral position of FIG. 20, the user pulls on the other tilt cord 24 (See FIG. 1) (not the one that was pulled to obtain the tilted closed room-side down position of FIG. 21). This causes counterclockwise rotation of the tilt rod 28, as well as the counterclockwise rotation of the drums 34, 36. However, the limit stop 54 on the first drum 34 almost immediately impacts the upper shelf limit stop 110 on its respective wall 90 of the housing 42, bringing further rotation of the first drum 34 to a stop. The second drum 36 continues to rotate counterclockwise until eventually its limit stop 54 impacts against the lower shelf limit stop 112 at its respective end 92 of the housing 42, bringing this second drum 36 to a stop. The second drum 36 will have rotated counterclockwise approximately 180 degrees (as evidenced by comparing the positions of the limit stop 54 on the second drum 36, in FIGS. 20 and 22).

The first rear tilt cable 16*ar* and the second front tilt cable 16*bf*, which are secured to the first drum 34, remain practically stationary, while the ends of the first front and second rear tilt cables 16*af* and 16*br* rotate counterclockwise with the second drum 36. The first front tilt cable 16*af* winds onto the second drum 36, pulling the room-side edges of the top slats 14*t* up a distance of approximately $\pi \times r$. At the same time, the second rear tilt cable 16*br* unwinds from the second drum 36, dropping the wall-side edges of the bottom slats 14*b* by the same $\pi \times r$ distance. The end result is the tilted closed room-side up blind of FIG. 22.

Selective Tilt Configuration for the Co-axial Drum Design

Figure 23:
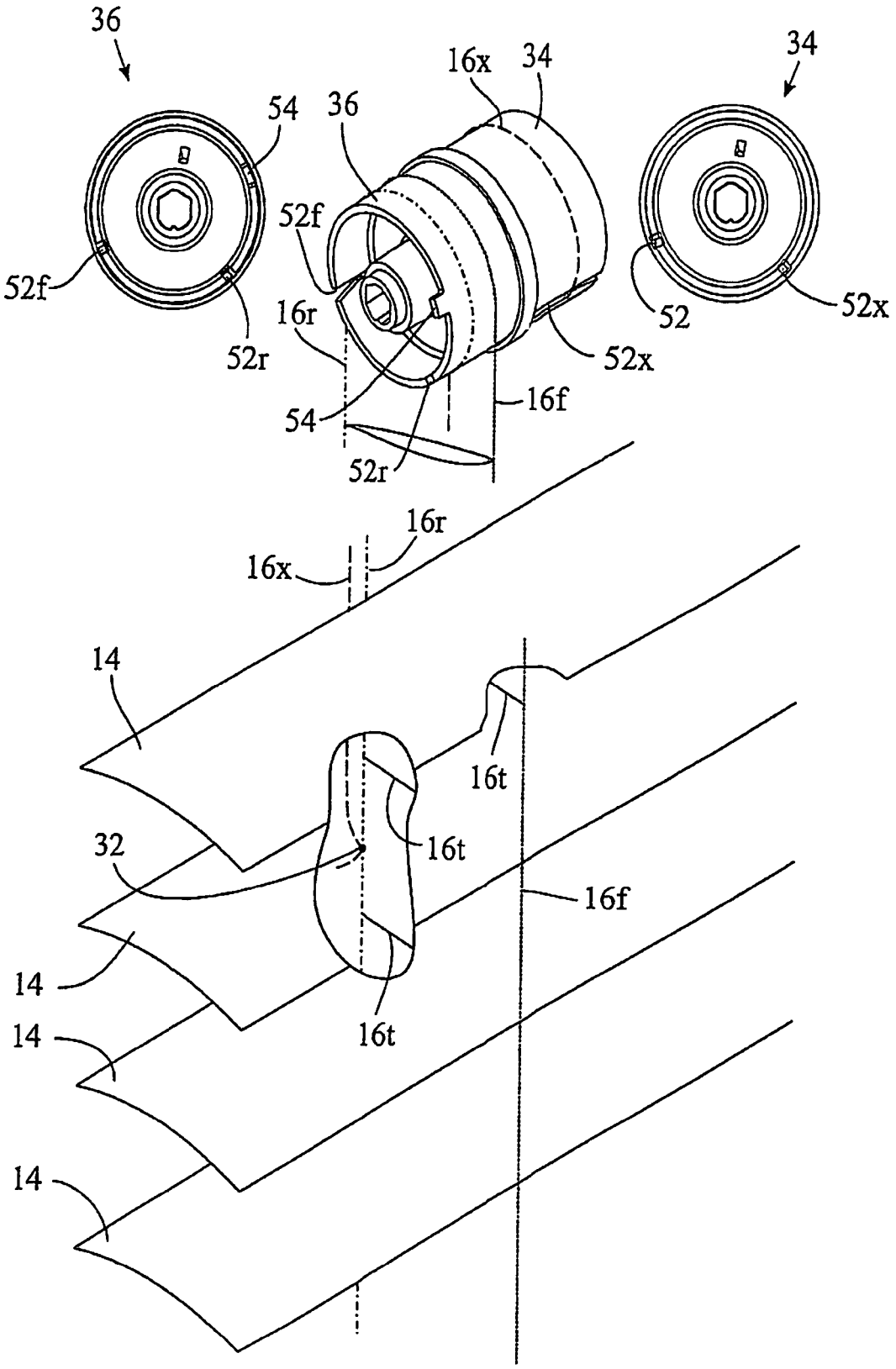
FIG. 23 is schematic, perspective view, partially broken away, of the blind of FIG. 1, showing the position of the drums and the routing of the tilt cables for a tilting configuration that permits opening of one portion of the blind while another is closed, as well as corresponding end views of the drums to more clearly indicate the relative rotational positions of the drums.
Figure 24:
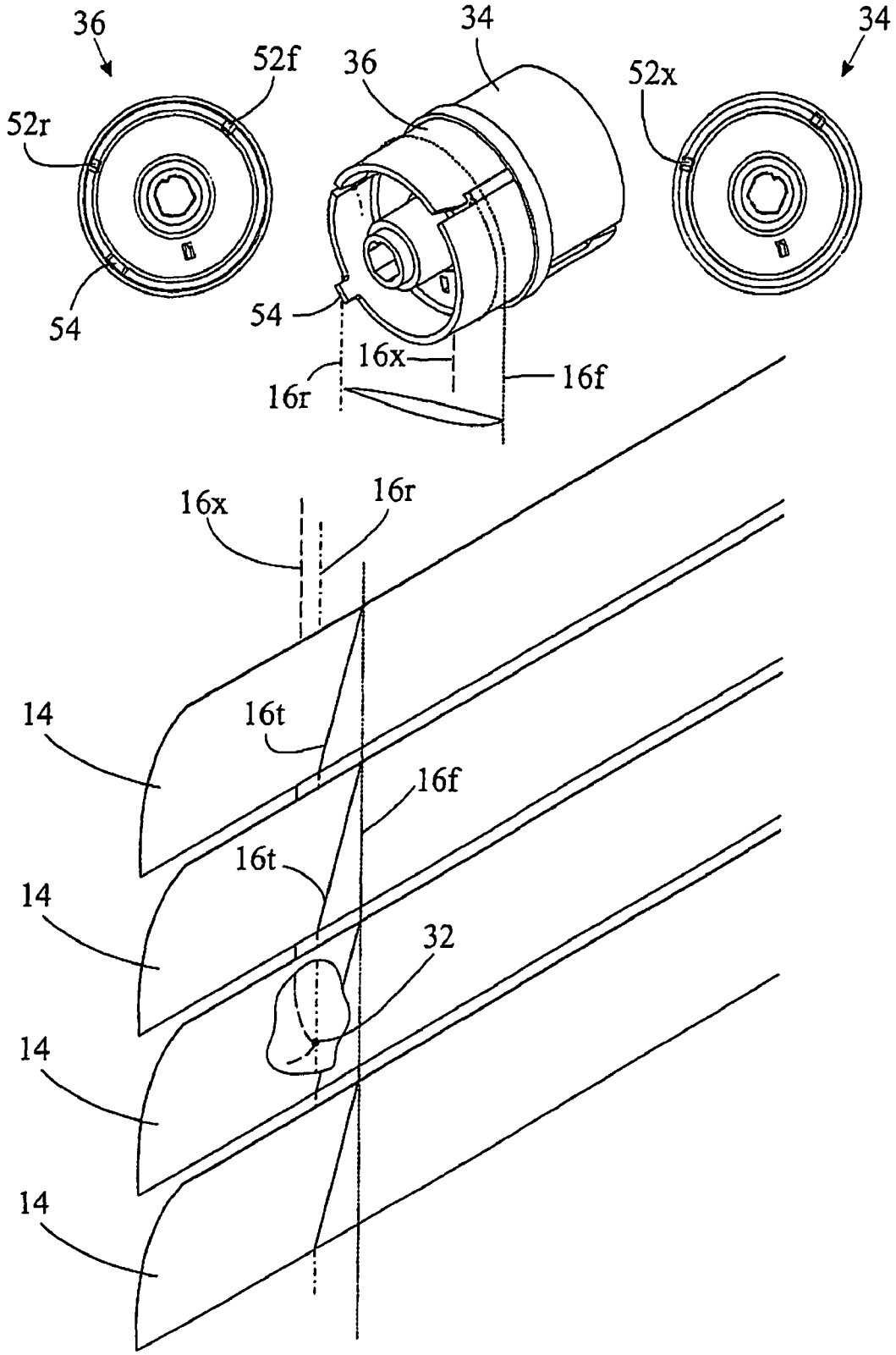
FIG. 24 is similar to FIG. 23 but showing the positions of the slats of the blind and of the drums when the blind is closed room-side up.
Figure 25:
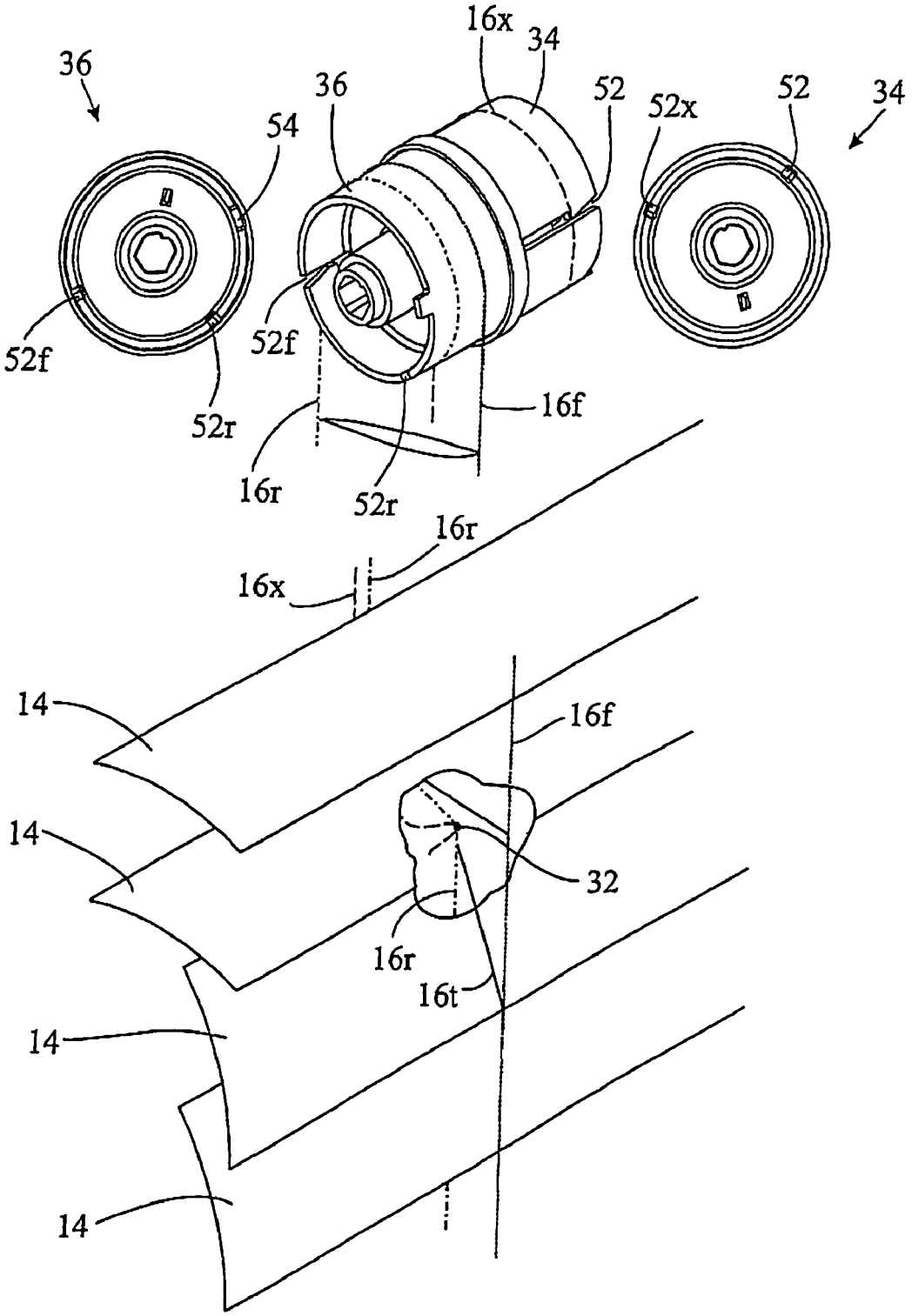
FIG. 25 is similar to FIG. 23 but showing the positions of the slats of the blind, and of the drums when the lower portion of the blind is closed room-side down while the upper portion of the blind remains tilted open.

FIGS. 23-25 depict a routing of tilt cables 16 on a mechanism very similar to that described above in order to achieve an arrangement in which one part of the blind can be closed while another part remains open. Referring to FIG. 23, there are a few hardware differences between this configuration the configuration shown in FIG. 20. First, instead of having two sets of double-pitch ladder tapes, this blind has one standard single-pitch ladder tape with a rear tilt cable 16*r*, a front tilt cable 16*f*, and cross cords 16*t* extending between the front and rear tilt cables 16*f*, 16*r*. Second, another tilt cable or actuator cord 16*x* is secured to the rear tilt cable 16*r* at the knot 32 or other fixing means such as a cord attachment clip 32. Third, the first drum 34 does not have a limit stop 54 (the limit stop 54 simply may be cut off from a standard first drum 34 to accommodate this configuration).

In this configuration, the rear tilt cable 16*r* wraps counterclockwise around the second drum 36 and attaches to the second drum 36 at the slotted opening 52*r*. The front tilt cable 16*f* wraps clockwise around the second drum 36 and attaches to the second drum 36 at the slotted opening 52*f*. The third tilt cable or actuator cord 16*x* wraps clockwise around the first drum 34 and attaches to the first drum 34 at the slotted opening 52*x*. The other slotted opening 52 of the first drum 34 is not used for anchoring a cord in this embodiment. In FIG. 23, the drums 34, 36 are shown in their neutral position, with the slats 14 are all tilted open in a single pitch configuration, with all the slats 14 evenly spaced apart.

In FIG. 24, one of the tilt cords has been pulled, causing the tilter 26 to drive the tilt rod 28 counterclockwise, which also drives the drum driver 38 and both drums 34, 36 counterclockwise. The second drum 36 is driven counterclockwise by the key 78 on the drum driver 38, stopping when its limit stop 54 reaches the lower shelf limit stop 112 on the wall 92. Since the limit stop 54 on the first drum 34 has been removed, there is nothing to prevent the spring 40 from driving the first drum 34 counterclockwise along with the second drum 36. As the second drum 36 rotates counterclockwise, it raises the front cable 16*f* and lowers the rear cable 16*r*. As the first drum 34 rotates counterclockwise, it lowers the actuator cable 16*x* the same distance as the rear tilt cable 16*r*. Thus, the entire blind tilts closed room-side up. When the tilt cord 24 is released, the worm gear on the tilt drive 26 locks the tilt rod 28 in position, which causes both drums 34, 36 to remain in the position they were in when the tilt cord 24 was released.

To rotate back to the neutral position and beyond, the other tilt cord 24 is pulled, causing the tilt rod 28 to rotate clockwise. FIG. 25 shows the position of the blind when the tilt rod 28 has been rotated clockwise beyond the neutral position of FIG. 23. As the tilt rod 28 is driven clockwise by the tilt drive 26, it drives the drum driver 38 clockwise, and the key 78 of the drum driver 38 contacts a shoulder on the first drum 34, driving the first drum 34 clockwise. The spring 40 begins to cause the second drum 36 to rotate clockwise along with the first drum 34, but its limit stop 54 impacts the upper shelf limit stop 110 on the wall 92 of the housing 42 at the neutral position, preventing any further clockwise rotation of the second drum 36. The first drum 34 continues to rotate clockwise, causing the actuator cable 16*x* to wind up onto the first drum 34, which raises the actuator cord 16*x*. Since the actuator cable 16*x* is connected to the rear tilt cable 16*r* at the point 32, it lifts the rear tilt cable 16*r* at that point 32. All the slats 14 supported by cross cords 16*t* below the point 32 are affected as the rear tilt cable 16*r* raises the wall-side edges of those slats 14. The result is that all the slats 14 below the tie off point 32 of the actuator cable 16*x* to the rear tilt cable 16*r* are tilted closed room-side down, and the balance of the slats 14 remain tilted open, as shown in FIG. 25.

The location of the tie-off point 32 relative to the rear tilt cable 16*r* determines the point at which the "break" occurs between the slats which are tilted closed and those which remain tilted open. If the actuator cable 16*x* alternatively were tied to the front tilt cable 16*f* instead of the rear tilt cable 16*r*, then the portion of the blind below the tie-off point 32 would close in the room-side up position rather than room-side down as shown here. It also follows that, by reversing the position of the drums 34, 36 in the housing 42, the action of the blind 10 can be reversed from the previous description. For instance, in going from FIG. 23 to FIG. 24, the slats 14 would close room-side up instead of the room-side down shown.

Pleated Look Configuration for the Co-axial Drum Design

Figure 26:
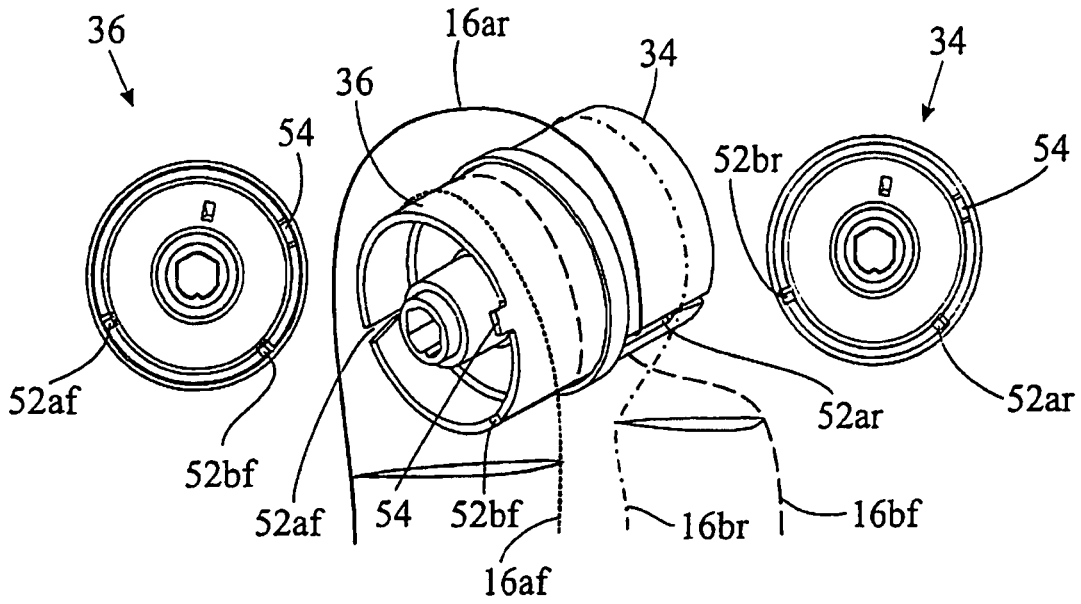
FIG. 26 is schematic, perspective view, partially broken away, of the blind of FIG. 1, showing the position of the drums and the routing of the tilt cables for a pleated look and double pitch configuration, as well as corresponding end views of the drums to more clearly indicate the relative rotational positions of the drums.
Figure 26:
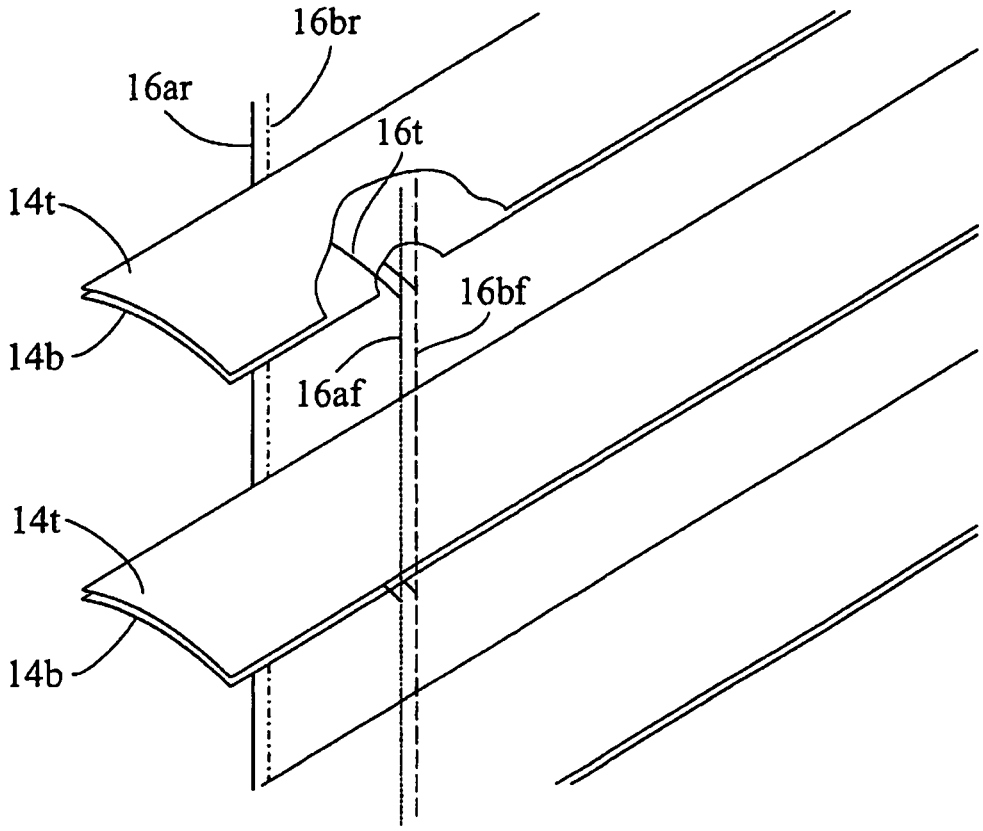
Figure 27:
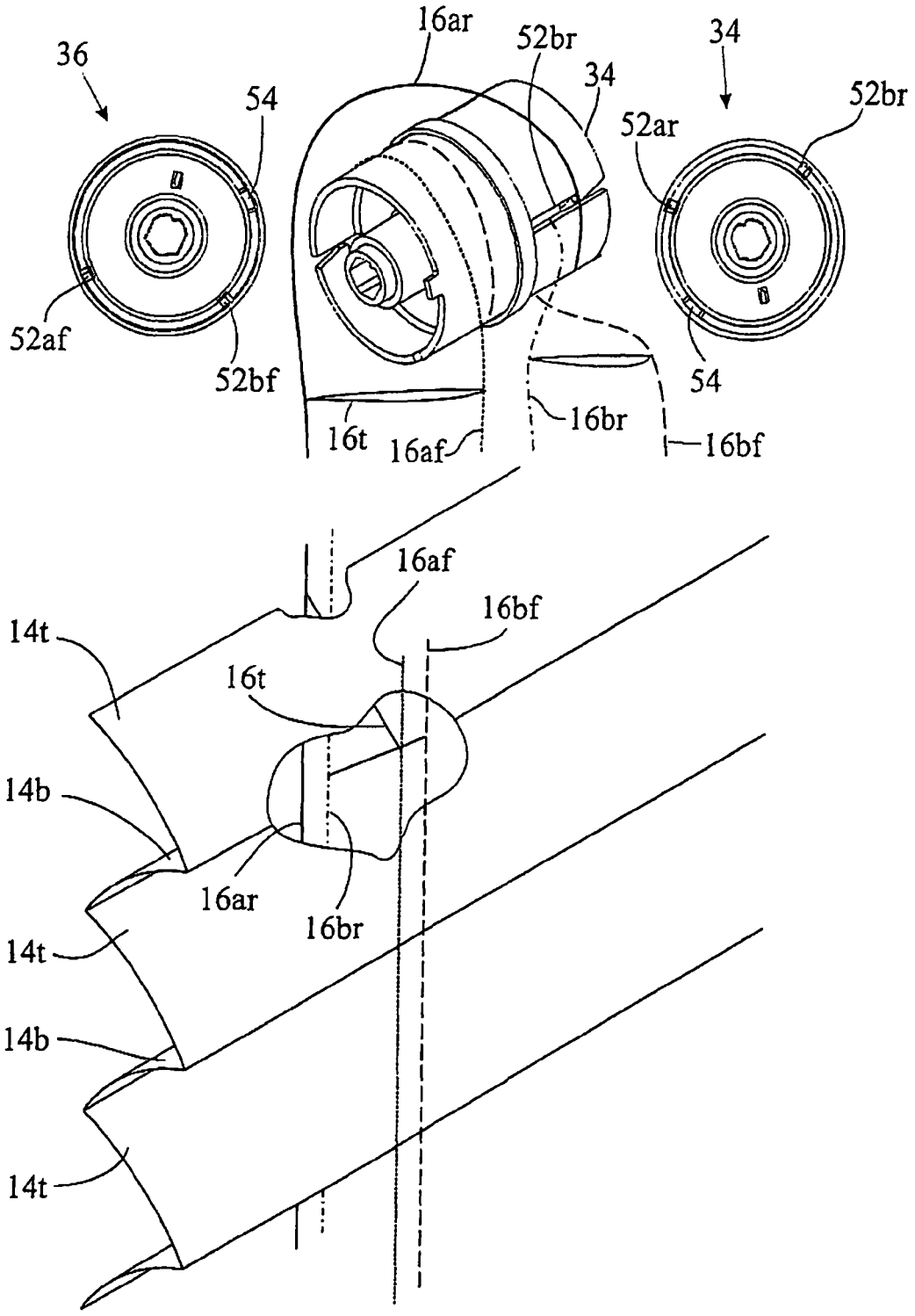
FIG. 27 is similar to FIG. 26 but showing the positions of the slats of the blind, and of the drums when the blind is pleated closed in one direction.
Figure 28:
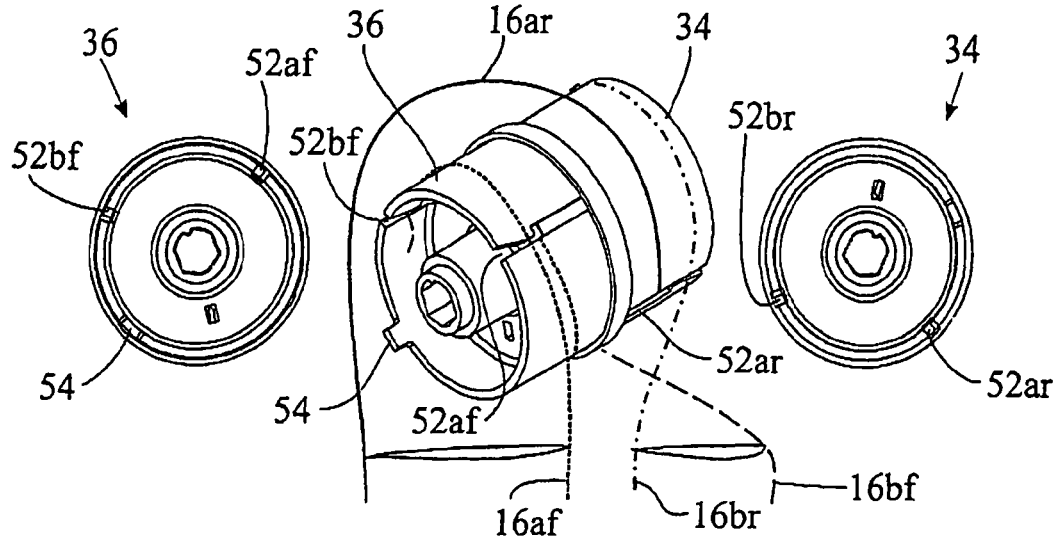
FIG. 28 is similar to FIG. 27 but showing the positions of the slats of the blind, and of the drums when the blind is pleated closed in an opposite direction.
Figure 28:
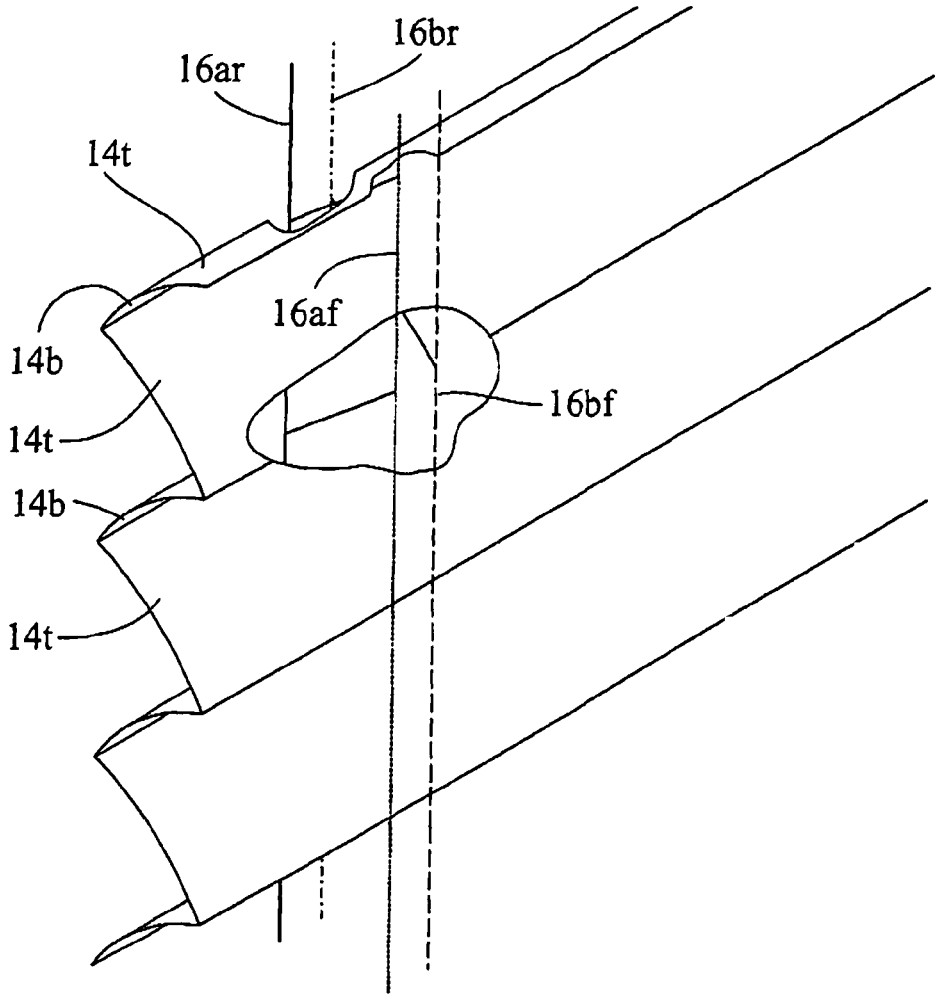

FIGS. 26-28 depict the routing of the tilt cables for a typical pleated look blind configuration. Referring to FIG. 26, there are no hardware differences between this pleated look configuration and the double pitch configuration of FIG. 20. In both instances, the two sets of tilt cables 16*af*, 16*ar* and 16*bf*, 16*br* are double the standard pitch. The only differences are in the routing of the tilt cables 16.

In this arrangement, again, there are two sets of tilt cables. The first front tilt cable 16*af* of the top slats 14*t* wraps counterclockwise around the second drum 36 and attaches to the second drum 36 at the slotted opening 52*af*. The first rear tilt cable 16*ar* of the top slats 14*t* wraps clockwise around the first drum 34 and attaches to the first drum 34 at the slotted opening 52*ar*. The second front tilt cable 16*bf* of the bottom slats 14*b* wraps clockwise around the second drum 36 and attaches to the second drum 36 at the slotted opening 52*bf*. Finally, the second rear tilt cable 16*br* of the bottom slats 14*b* wraps counterclockwise around the first drum 34, and attaches to the first drum 34 at the slotted opening 52*br*.

As in the case of the double pitch blind depicted in FIG. 20, the pleated look configuration of FIG. 26 also starts with the slats 14 in a double pitch configuration when the drums 34, 36 are in the neutral position. Referring now to FIG. 27, as the tilt drive 26 drives the tilt rod 28 in the clockwise direction, the key 78 contacts the first drum 34, driving it clockwise, and the spring 40 urges the second drum 36 to rotate clockwise as well. However, the limit stop 54 on the second drum 36 almost immediately impacts against the upper shelf limit stop 110 at the end 92 of the housing 42, preventing any further clockwise rotation of the second drum 36 beyond the neutral position. The first drum 34 continues to rotate until its limit stop 54 impacts against the lower shelf limit stop 112 in the wall 90 of the housing 42.

Since the front (or room-side) tilt cables 16*af*, 16*bf* of both top and bottom slats 14*t*, 14*b*, respectively, are tied off to the second drum 36, and this second drum 36 rotates only a very few degrees before its limit stop impedes further clockwise rotation, the front (or room-side) edges of these slats 14*t*, 14*b* remain nearly stationary. On the other hand, the rear tilt cable 16*ar* and 16*br* are tied off to the first drum 34, which is rotating. When the first drum 34 rotates clockwise, the first rear tilt cable 16*ar* winds up onto the first drum 34, lifting up the rear (or wall-side) edges of the top slats 14*t* to the position shown in FIG. 27. At the same time, the rear tilt cable 16*br* of the bottom slat 14*b* is unwrapping from the first drum 34, dropping the rear (or wall-side) edges of the bottom slats 14*b* to the position shown in FIG. 27, resulting in a pleated look tilted closed blind, with the top slats 14*t* tilted room-side down, and the bottom slats 14*b* tilted room-side up.

FIG. 28 depicts the pleated look blind of FIG. 26 but tilted closed in the opposite direction from that of FIG. 27. In this instance the tilt rod 28 is rotated counterclockwise and only the second drum 36 rotates counterclockwise with it (the first drum 34 only starts to rotate and is immediately stopped by its limit stop 54 contacting the upper shelf limit stop 110 on the wall 90 of the housing 42). In this instance, since the first and second rear tilt cables 16*ar* and 16*br* are attached to the first drum 34, and the first drum 34 does not rotate, then the rear (wall-side) edges of the top and bottom slats 14*t*, 14*b* remain essentially stationary. At the same time, the first and second front tilt cables 16*af*, 16*bf* rotate with the second drum 36, with the first front cable 16*af* wrapping up on the second drum 36 as the drum 36 rotates counterclockwise, thereby lifting the front (room-side) edges of the top slats 14*t*. The second front tilt cable 16*bf* of the bottom slats 14*b* unwraps from the second drum 36 as the drum 36 rotates counterclockwise, and this drops the front (room-side) edges of the bottom slats 14*b*. The result is a pleated look tilted closed blind, with the top slats 14*t* tilted room-side up, and the bottom slats 14*b* tilted room-side down, as shown in FIG. 28.

It may be noted that, in order to get closure of the slats 14 when tilted in opposite directions, as is the case in the pleated look configuration described above, it may be advantageous to notch both front and back edges of one of each pair of slats 14 in order to allow clearance for the cross ladder 16*t*. This notch can be on the bottom slats 14*b* only, or on the top slats 14*t* only, or it could be on both top and bottom slats 14*t*, 14*b*, or it could be on just one edge of each slat 14 (opposite edges).

Twin Tilt Rod, Parallel Drum Design

Figure 29:
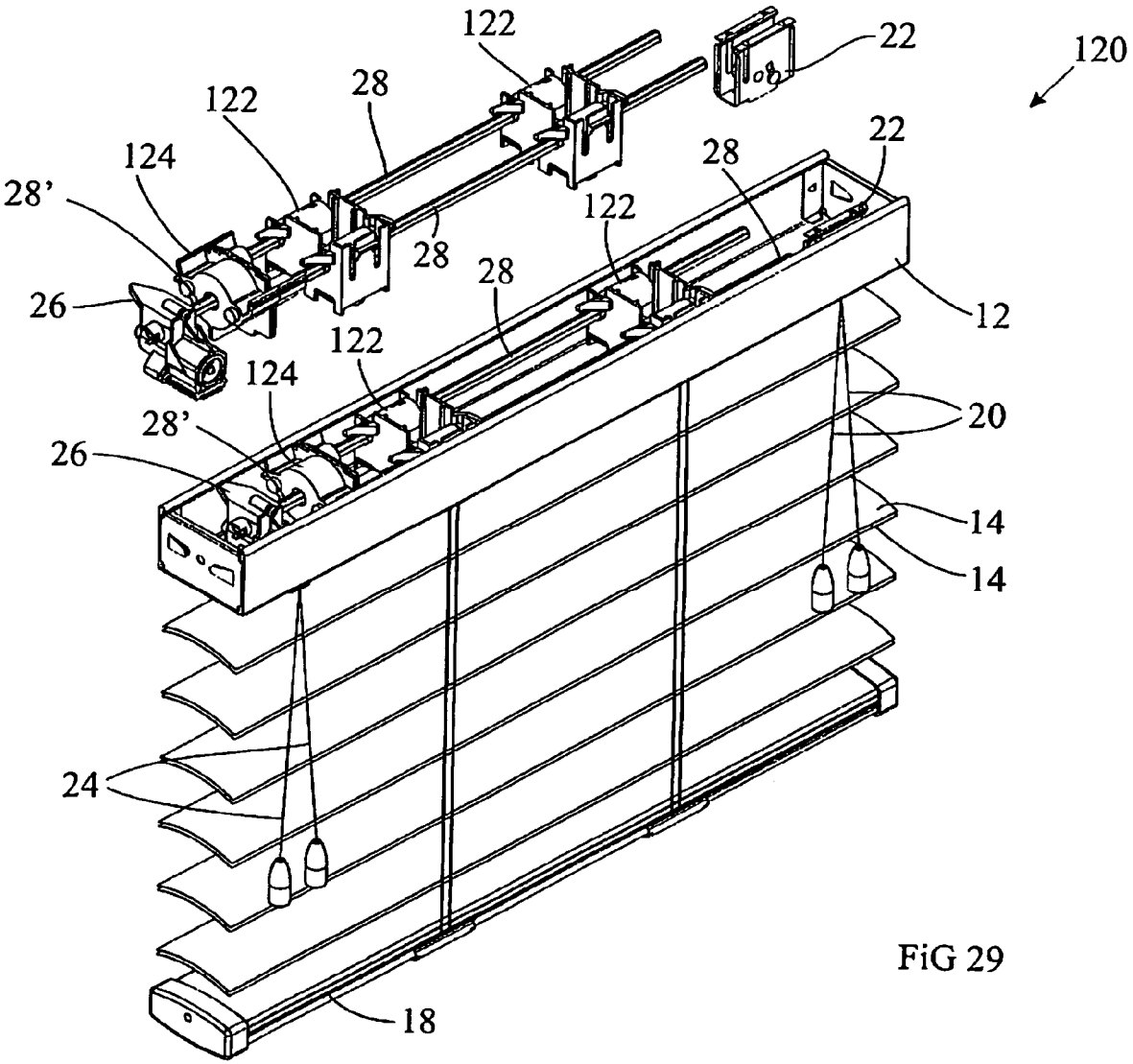
FIG. 29 is a perspective view of another embodiment of a blind system made in accordance the present invention, with a partially exploded perspective view of the mechanism inside the head rail also shown above the blind.
Figure 30:
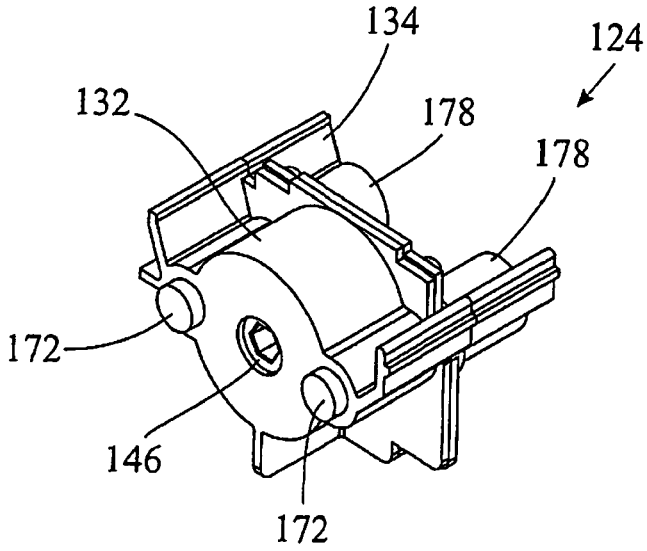
FIG. 30 is a perspective view of the indexing gear mechanism of the blind of FIG. 29.

Referring now to FIG. 29, the blind 120 is very similar to the blind 10 of FIG. 1 except that, instead of using the tilt stations 30, the tilting function is accomplished using twin tilt rods 28 which functionally interconnect the parallel-drum tilt stations 122 with the indexing gear mechanism 124, as described in more detail below. The indexing gear mechanism 124 is in turn connected to a tilter mechanism, such as the worm gear tilter 26, via a short tilt rod 28'.

Referring briefly to FIGS. 30-33, the indexing gear mechanism 124 includes an indexing gear 126, a room-side driven gear 128, a wall-side driven gear 130, an indexing gear housing 132, and a housing cover 134.

Figure 36:
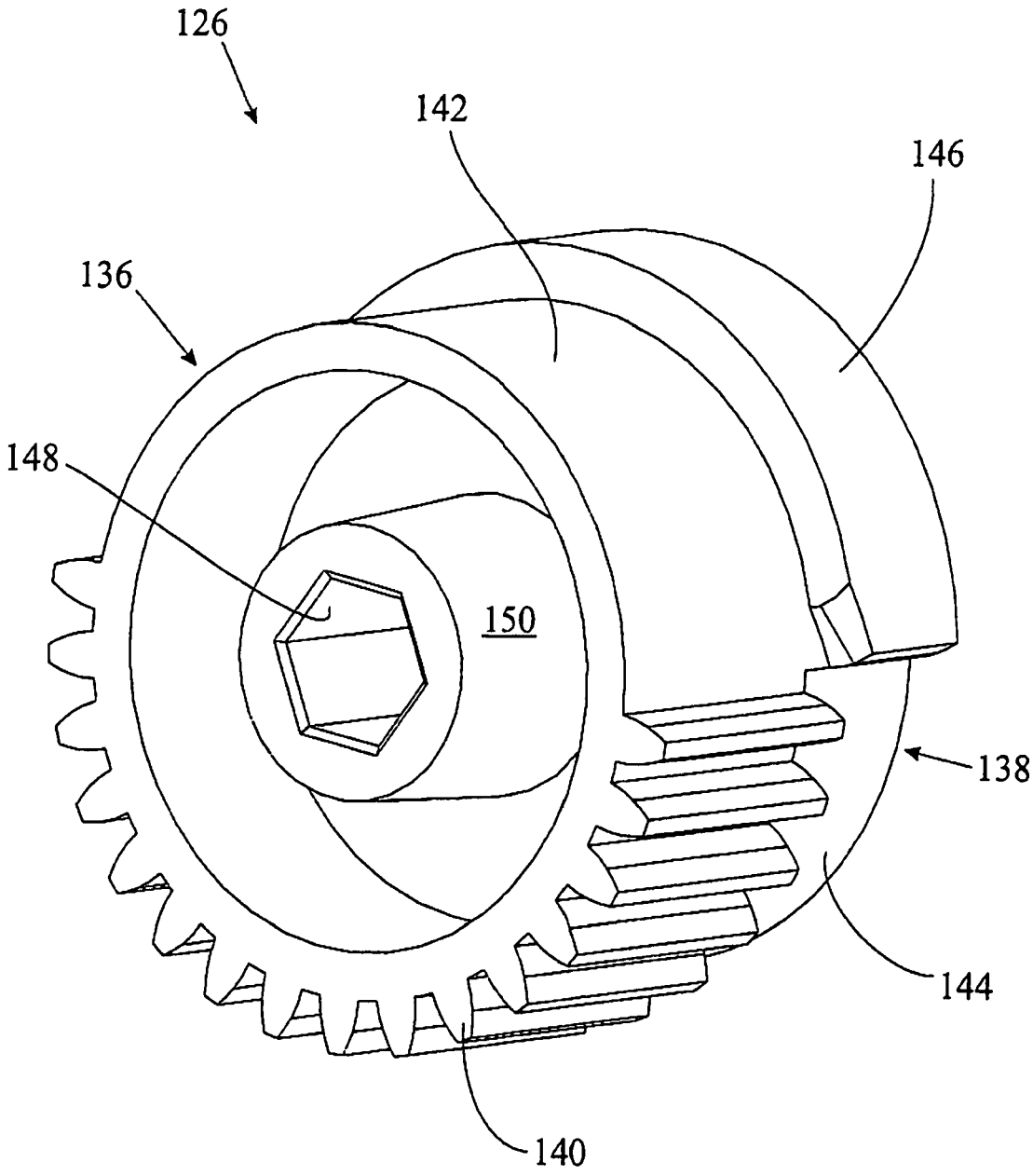
FIG. 36 is a perspective view of the indexing gear of the indexing gear mechanism of FIG. 31.

Referring to FIG. 36, the indexing gear 126 is a generally cylindrical gear defining a left portion 136 and a right portion 138. The left portion 136 includes a toothed portion 140 extending in an arc of approximately 200 degrees, with the balance of the left portion 136 being a smooth, toothless portion 142. Similarly, the right portion 138 defines a smooth, toothless portion 144 which extends through the same arc of approximately 200 degrees, corresponding to the toothed portion 140. However, a solid boss 146 extends along the balance of the right portion 138. The indexing gear 126 also defines a non-cylindrically profiled hollow shaft 148 sized to receive the similarly-profiled tilt rod 28'. The outside of this shaft 148 defines a cylindrical axle 150.

Figure 35:
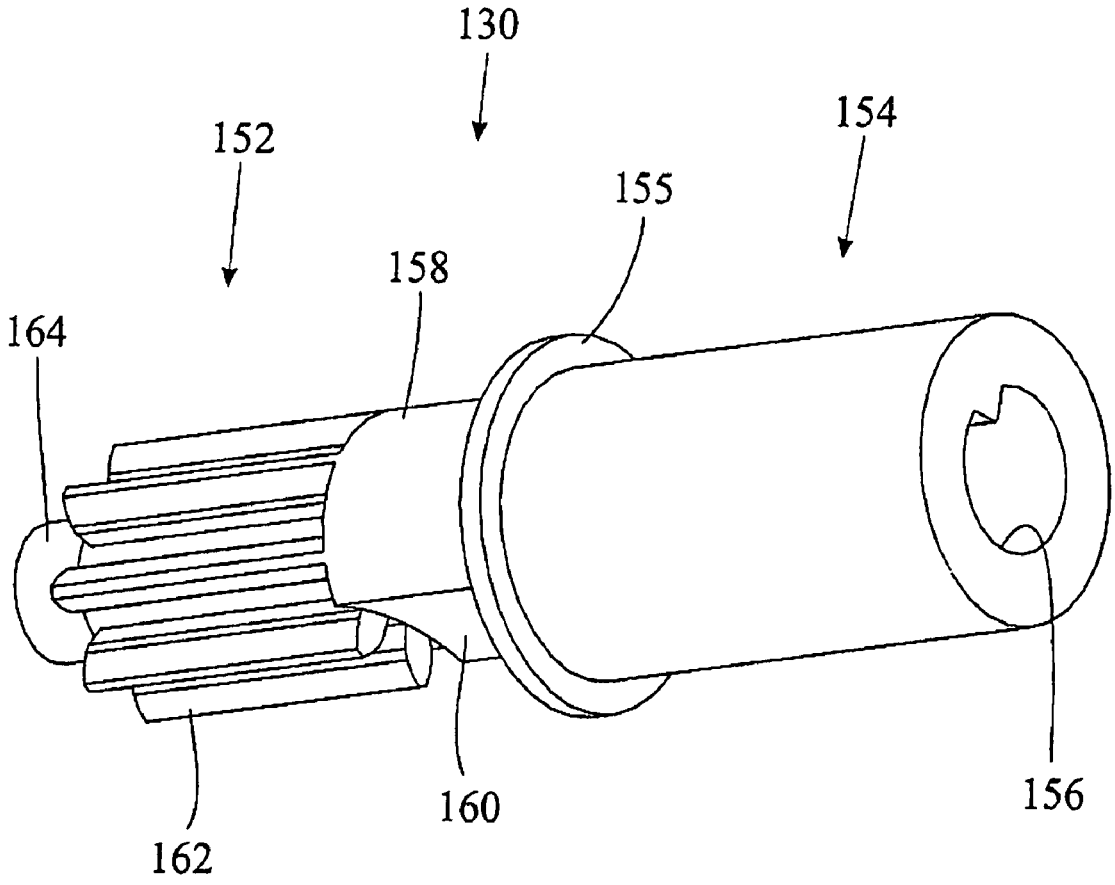
FIG. 35 is a perspective view of one of the driven gears of the indexing gear mechanism of FIG. 31.

Referring now to FIG. 35, the wall-side driven gear 130 is a generally cylindrical element defining a left portion 152 and a right portion 154, and these portions 152, 154 are separated by a radially projecting flange 155. The right cylindrical portion 154 defines a non-cylindrically profiled hollow shaft 156 sized to receive the similarly-profiled tilt rod 28. The left portion 152 includes a first smooth portion 158 with a concave section 160 (See also FIG. 31) precisely manufactured to mate with the locking hub or boss 146 on the indexing gear 126, to prevent movement of the driven gear 130 during dwell, as is explained in more detail below. The left portion 152 also includes a toothed portion 162 which engages the toothed portion 140 of the indexing gear 126. Finally, a short axle 164 projects leftwardly from the toothed portion 162. The room-side driven gear 128 is identical to the wall-side driven gear 130.

Figure 34:
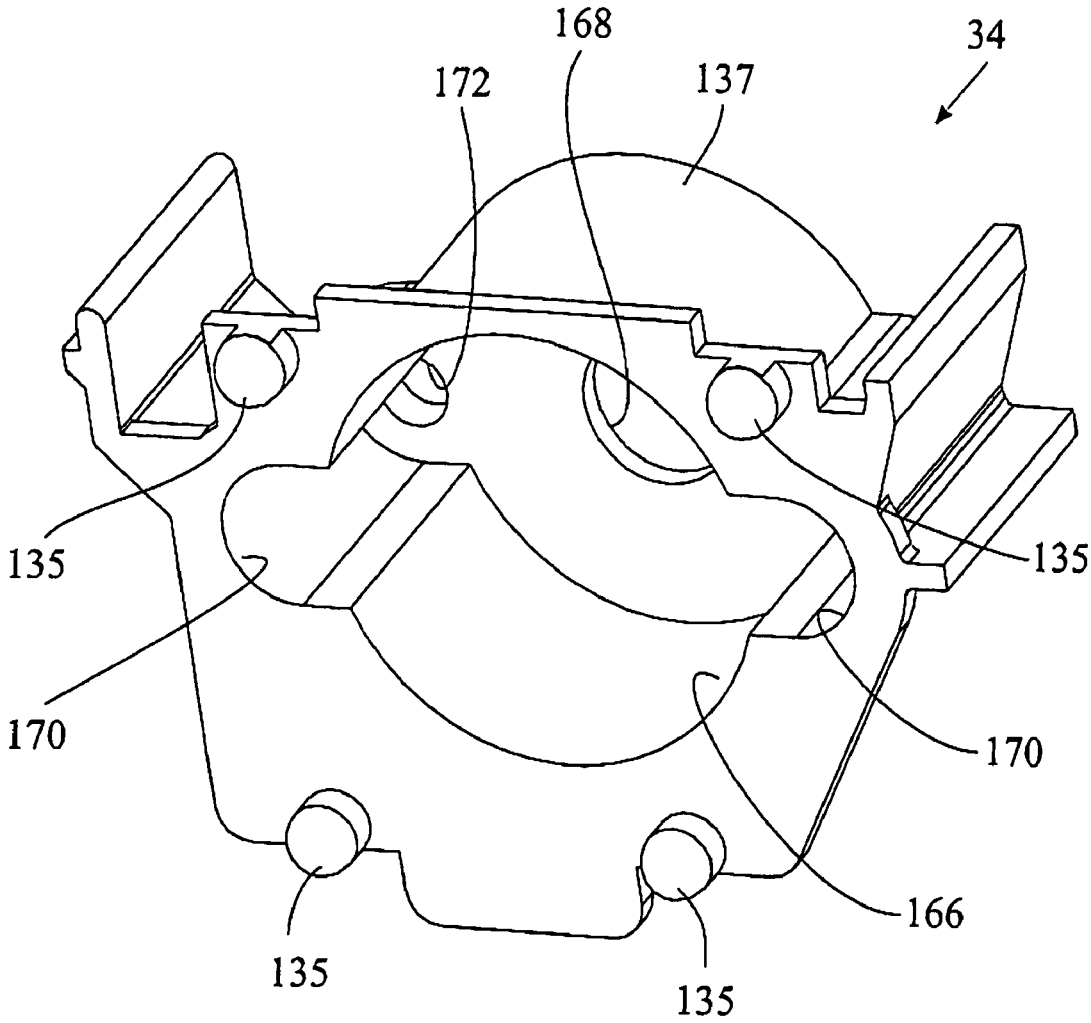
FIG. 34 is a perspective view of the housing cover for the indexing gear mechanism of FIG. 31.

Referring to FIG. 34, the housing 132 defines a main cavity 166 which accommodates the indexing gear 126. A through opening 168 (See also FIG. 31) rotationally supports the axle 150 of the indexing gear 126, which projects leftwardly beyond the toothed portion 140. Two smaller diameter cavities 172 on either side of the through opening 168 receive and rotationally support the left ends 164 of the driven gears 128, 130.

Figure 31:
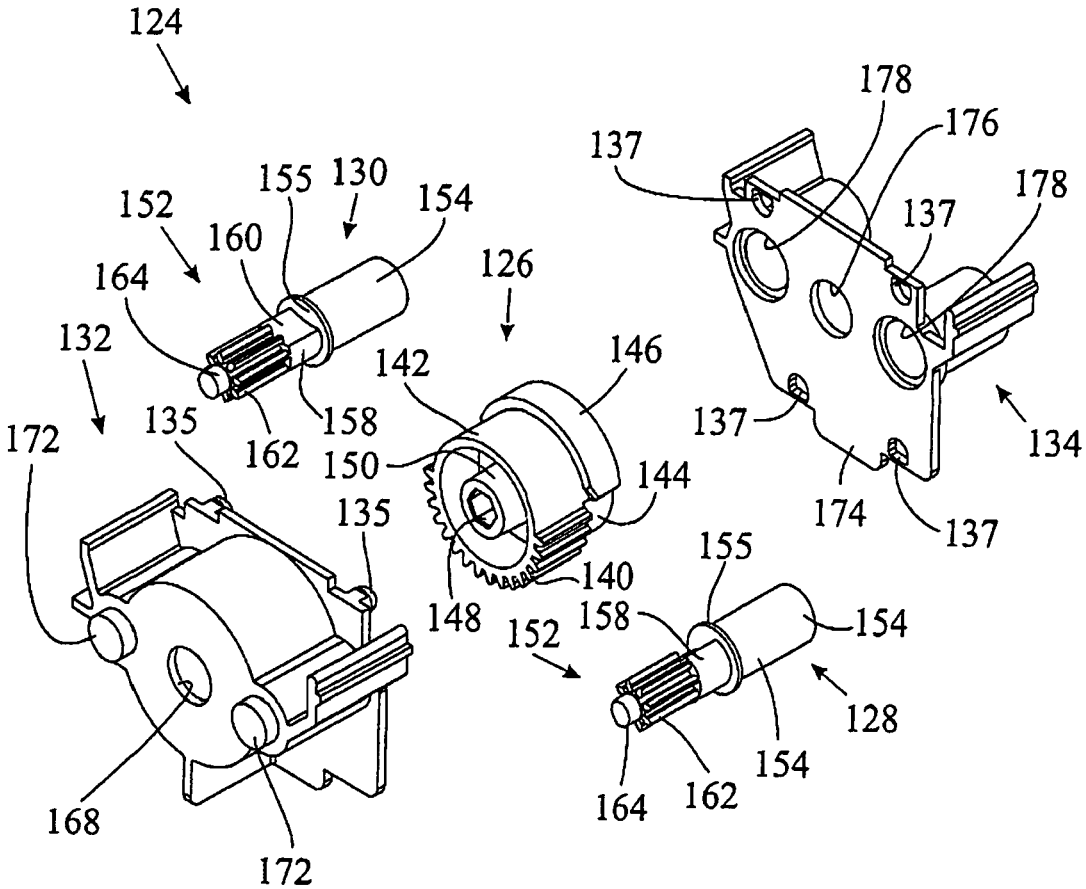
FIG. 31 is an exploded perspective view of the indexing gear mechanism of FIG. 30.

Referring to FIG. 31, the housing cover 134 includes a plate 174 defining a through opening 176 which rotationally supports the right end of the axle 150 of the indexing gear 126. The plate 174 also defines two hollow cylindrical projections 178 sized to rotationally accommodate and support the right ends 154 of the driven gears 128, 130.

Figure 32:
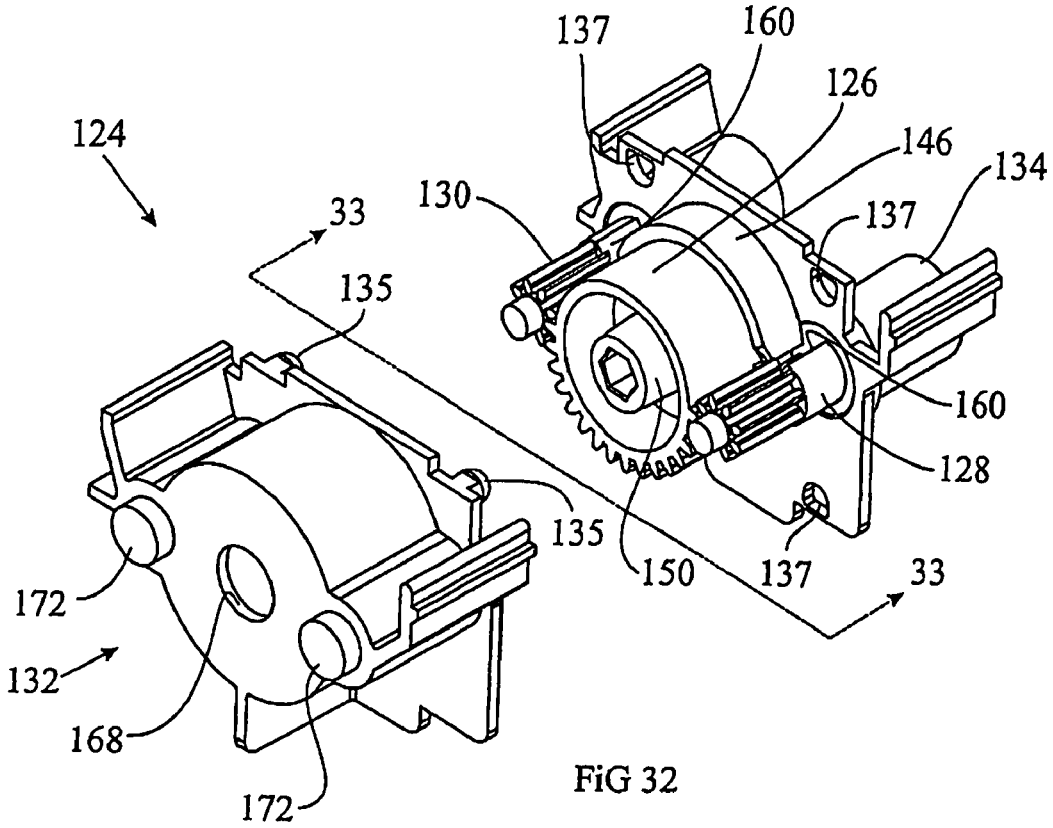
FIG. 32 is a partially exploded perspective view of the indexing gear mechanism of FIG. 30.
Figure 33:
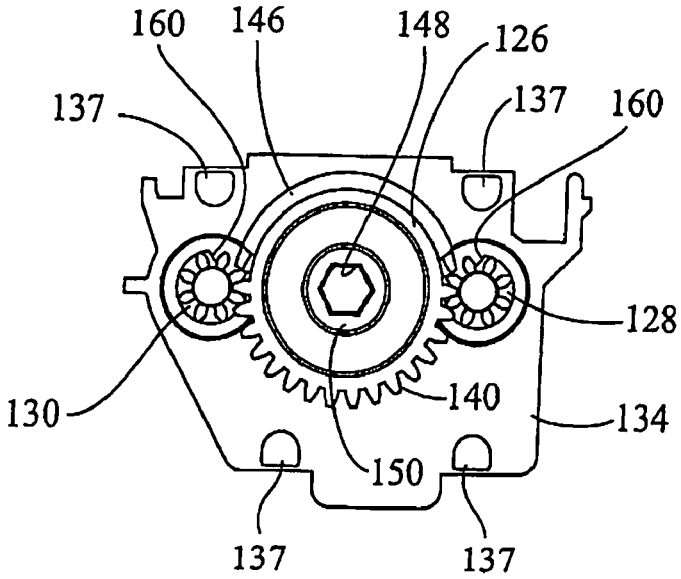
FIG. 33 is a view along line 33-33 of FIG. 32.

To assemble the indexing gear mechanism 124, the indexing gear 126 and the driven gears 128, 130 are inserted into their respective cavities 166, 170 of the housing 132 (see FIG. 34) such that the left end of the axle 150 of the indexing gear 126 extends through the opening 168 in the housing 132, and the axles 164 of the driven gears 128, 130 are received in the recesses 172 in the housing 132. The housing cover 134 then is snapped onto the housing 132 (with projections 135 on the housing 132 snap-fitting into openings 137 on the cover, such that the right end of the axle 150 of the indexing gear 126 extends through the opening 176 in the housing cover 134, and the right end portions 154 of the driven gears 128, 130 extend into the two hollow cylindrical projections 178 of the housing cover 134. The driven gears 128, 130 are aligned with the indexing gear 126 as shown in FIGS. 32 and 33, with the concave sections 160 of the driven gears 128, 130 just about to engage the boss 146 of the indexing gear 126. We will refer to this position of the driven gears 128, 130 relative to the indexing gear 126 (and the corresponding position of the tilt drums 184, 182 as described below) as the neutral position.

The indexing gear mechanism 124 works using the principle of a Geneva indexing drive which converts continuous rotational motion into intermittent motion, providing repeatable indexing to the same position. In this instance, as the indexing gear 126 rotates clockwise from the neutral position (as seen from the vantage point of FIGS. 31-33) the room-side driven gear 128 briefly rotates counterclockwise until its concave section 160 mates with the boss 146 of the indexing gear 126. The toothed portion 162 of the room-side driven gear 128 then encounters the smooth, toothless portion 142 of the indexing gear 126. The indexing gear 126 can thus continue to rotate clockwise while the room-side driven gear 128 remains stationary, prevented from rotation by the boss 146 of the indexing gear 126 abutting the concave section 160 of the room-side driven gear 128.

However, as the indexing gear 126 continues to rotate clockwise, the wall-side driven gear 130 rotates counterclockwise and continues to do so for several rotations before its concave section 160 abuts the boss 146 of the indexing gear 126, bringing further rotation to a stop.

If the indexing gear 126 rotates counterclockwise from the neutral position, the opposite situation occurs. Namely, the wall-side driven gear 130 rotates clockwise very briefly before it is prevented from further rotation by its concave section 160 abutting the boss 146 of the indexing gear 126. The room-side driven gear 128 also rotates clockwise and continues to do so for several rotations before its concave section 160 abuts the boss 146 of the indexing gear 126, bringing further rotation to a stop. Of course, tilt rods 28 extend into the hollow cylindrical projections 178 and are received in the hollow shafts 156 of the right portions 154 of the driven gears 128, 130, so the tilt rods 28 rotate with their respective driven gears 128, 130.

Figure 37:
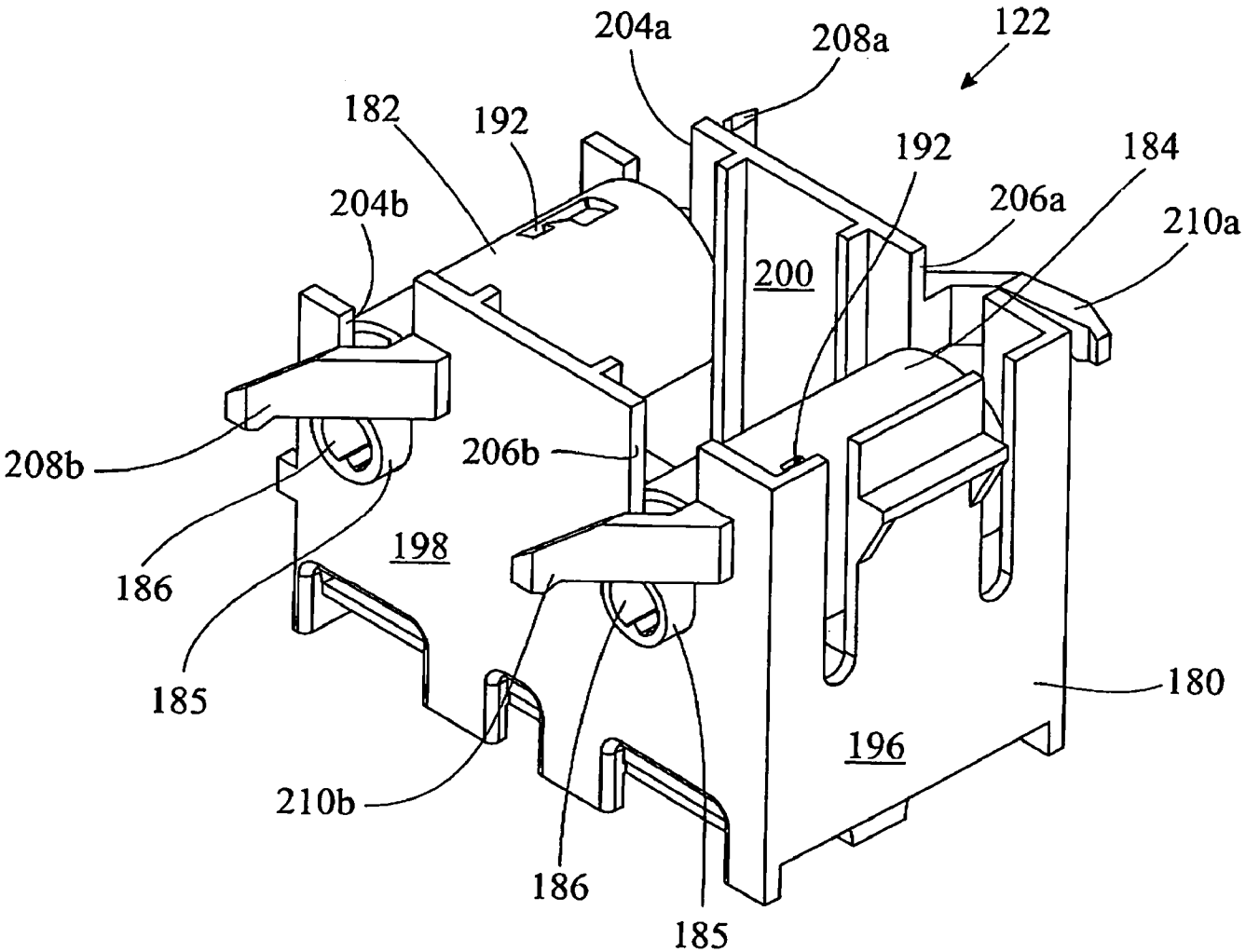
FIG. 37 is a perspective view of one of the tilt stations of the blind of FIG. 29.
Figure 38:
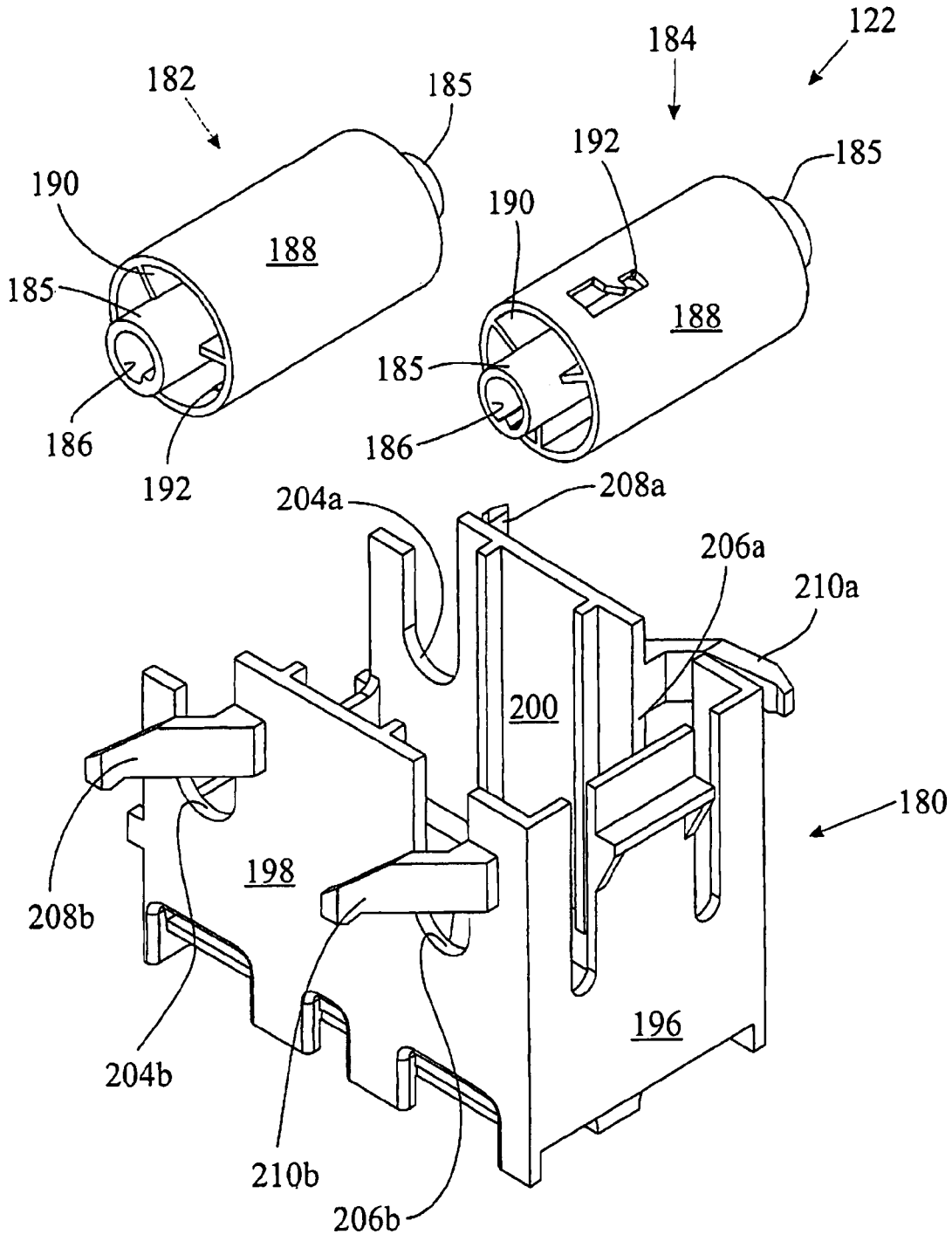
FIG. 38 is an exploded perspective view of the tilt station of FIG. 37.

Referring now to FIGS. 37 and 38, each tilt station 122 includes a housing 180, a wall-side tilt drum 182, and a room-side tilt drum 184.

Figure 39:
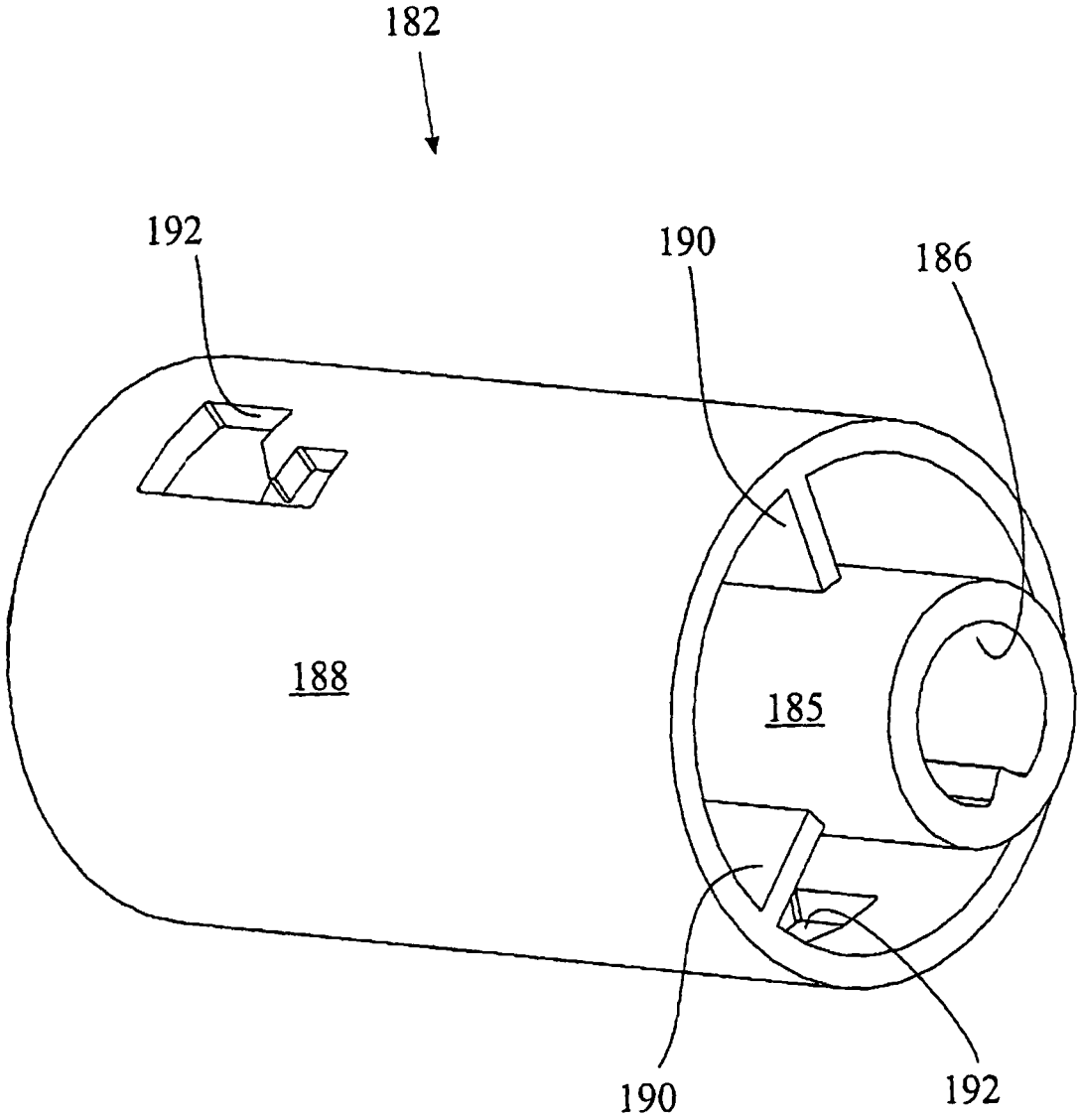
FIG. 39 is a perspective view of one of the drums of the tilt station of FIG. 37.

FIG. 39 depicts a wall side tilt drum 182 which is a cylindrical element defining cylindrical axles 185 projecting from both ends, each cylindrical axle 185 defining a non-cylindrical, inner, hollow shaft 186 sized to receive and engage the similarly-profiled tilt rod 28. The wall side tilt drum 182 also defines an outer cylindrical surface 188 which is connected to the inner, cylindrical axle 185 via webs 190. Two elongated openings 192 are defined through the outer cylindrical surface. One of the openings 192 is located near one end of the cylinder 188, and the other near the other end, with the two openings 192 lying about 180 degrees apart from each other. Both of the openings 192 can be seen in FIG. 39. The tilt cables 16 are secured to these openings as described in more detail below. The room-side tilt drum 184 is identical to the wall-side tilt drum 182.

Figure 40:
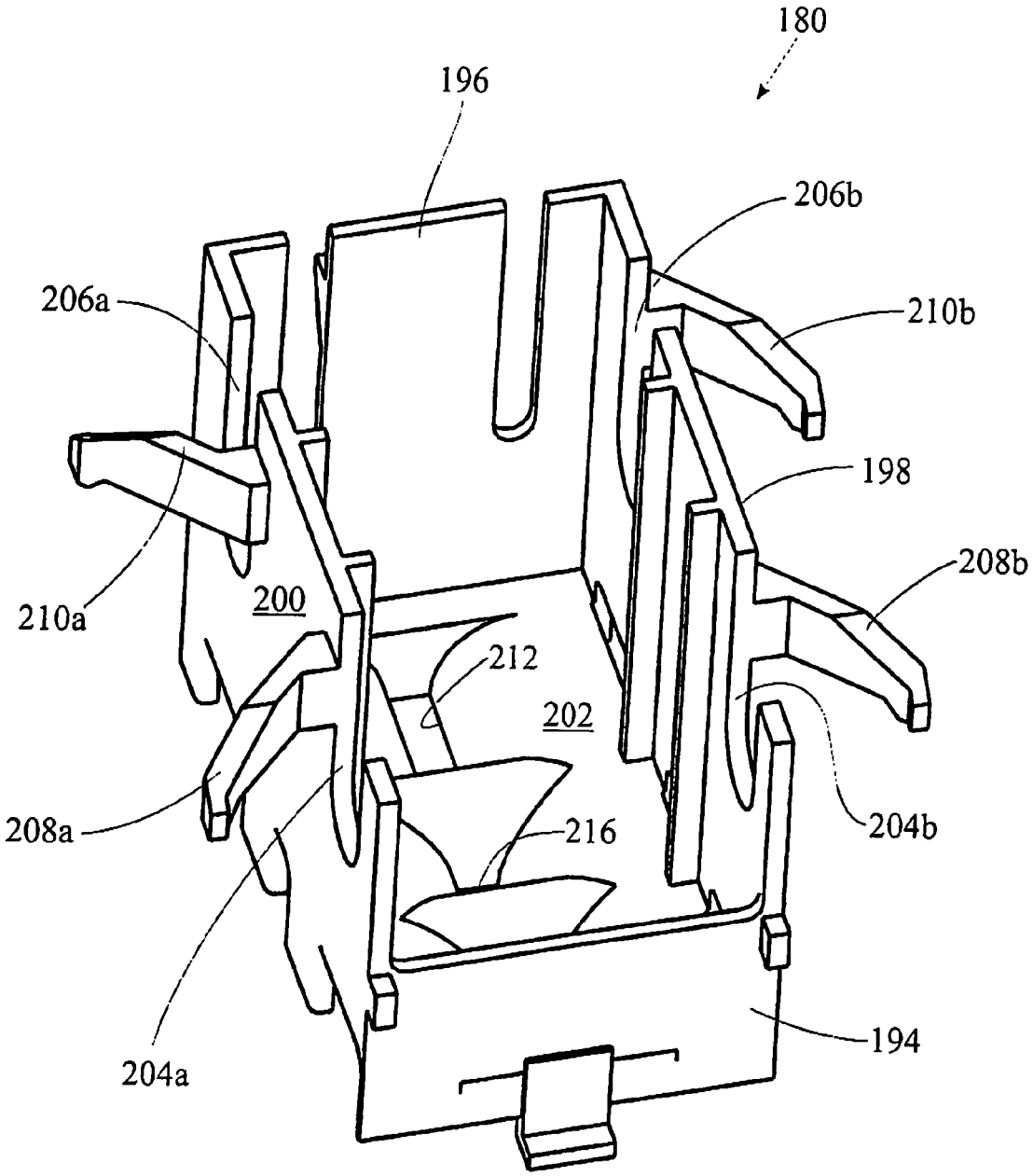
FIG. 40 is a perspective view of the housing of the tilt station of FIG. 37.

FIG. 40 is a perspective view of the housing 180 of the tilt station 122 of FIGS. 37 and 38. The housing 180 includes two side walls 194, 196, two end walls 198, 200, and a bottom wall 202. The end walls 198, 200 each define two "U"-shaped saddles 204*a*, 204*b*, and 206*a*, 206*b*, respectively, which provide rotational support of the axles 185 of the drums 182, 184 as seen in FIG. 37. Arms 208*a*, 208*b* and 210*a*, 210*b* extend at approximately a 45 degree angle from the planes defined by the end walls 198, 200, and they project across and above the centerline of the tilt rods 28 which extend through the hollow shafts 186 of the drums 182, 184, thus serving to prevent the drums 182, 184 from lifting out of the housing 180.

The bottom wall 202 of the housing 180 defines two longitudinally aligned slotted openings 212, with a shorter rectangular opening 216 between the two slotted openings 212. The slotted openings 212 are for the front and rear tilt cables to pass through the housing 180 and through corresponding openings (not shown) in the head rail 12. The rectangular opening 216 provides a passageway for the lift cords 20.

To assemble the tilt mechanism shown in FIG. 29, first the tilt stations 122 are assembled. The tilt cables 16 are routed through the slotted openings 212 in the bottom surface 202 of the housing 180. The ends of the tilt cables 16 are secured to their respective drums 182, 184 at their respective slotted openings 192. The routing and attachment of these tilt cables 16 is done in accordance with the explanation below in order to obtain the desired tilting configuration.

The drums 182, 184 are installed in their respective U-shaped saddles 204*a*, 204*b* and 206*a*, 206*b*, respectively. The tilt rods 28 are inserted through the hollow shafts 186 of the tilt drums 182, 184, and the ends of these tilt rods 28 are inserted into the hollow shafts 156 of the driven gears 130, 128 respectively. The driven gears 130, 128 will already have been assembled onto the indexing gear mechanism 124 as described earlier. A short tilt rod 28' is used to connect the output from the cord tilter mechanism 26 to the hollow shaft 148 of the indexing gear 126. Note that the cord tilter mechanism 26 shown here is just one type of many tilter mechanisms which may be used for this application. While a cord tilter 26 is shown, it is understood that the tilt rod 28' may be rotated by other means such as a wand tilter or a motorized tilter. It is even possible to have the indexing gear mechanism 124 be an integral part of the tilter mechanism 26, such that no tilt rod 28' is needed.

Double Pitch Configuration for the Parallel Drum Design

Figure 41:
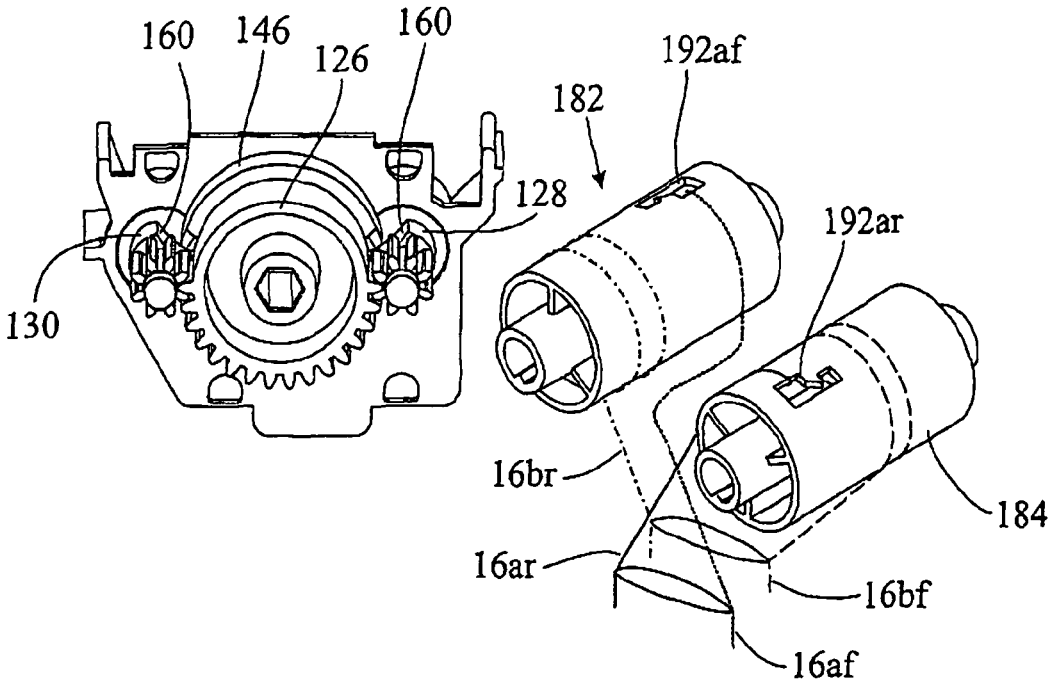
FIG. 41 is schematic, perspective view, partially broken away, of the blind of FIG. 29, showing the position of the drums and the routing of the tilt cables for a double pitch configuration, as well as the corresponding view of the indexing gear mechanism to more clearly indicate the relative rotational positions of the driven gears.
Figure 41:
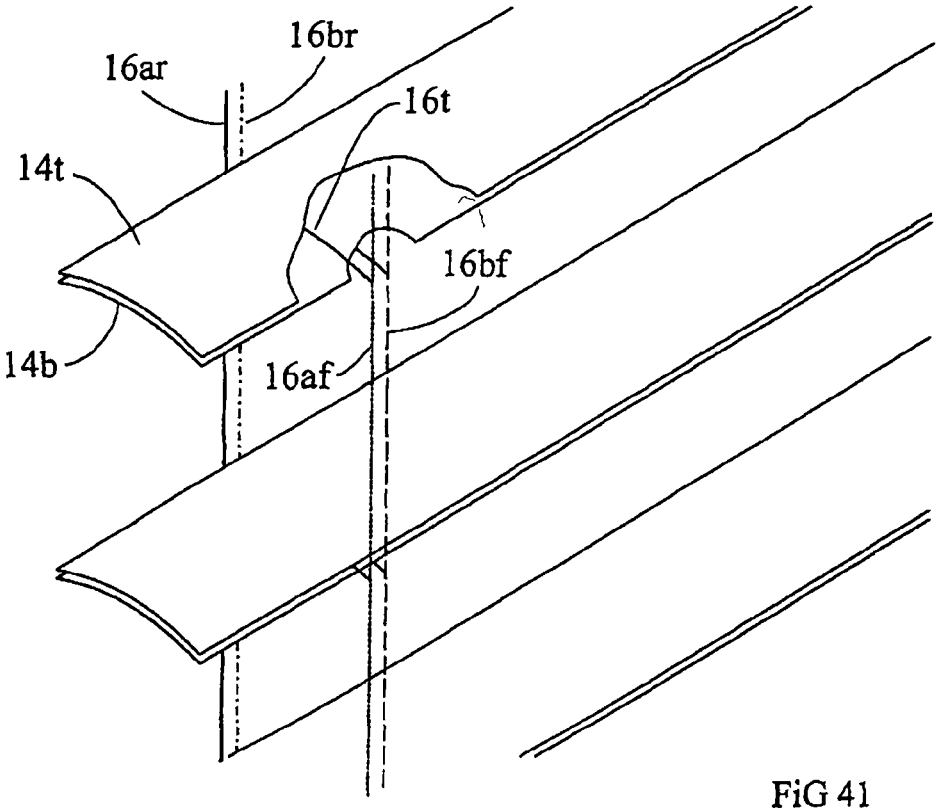
Figure 42:
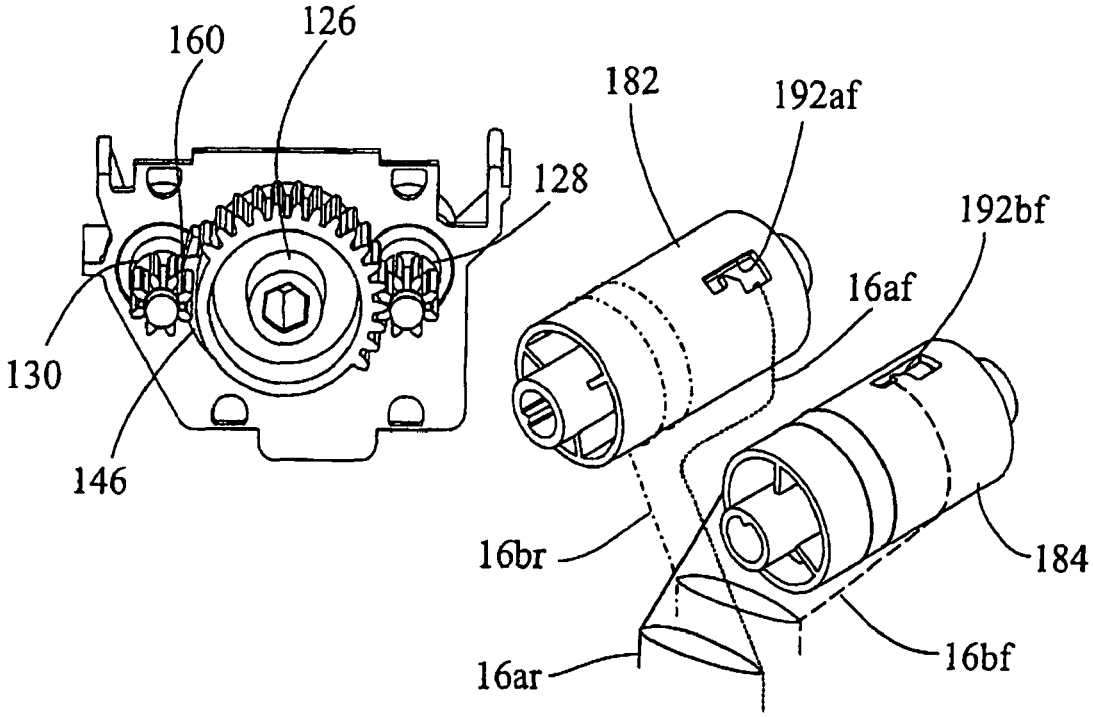
FIG. 42 is similar to FIG. 41 but showing the positions of the slats of the blind, of the drums, and of the indexing gear mechanism when the blind is closed room-side down.
Figure 42:
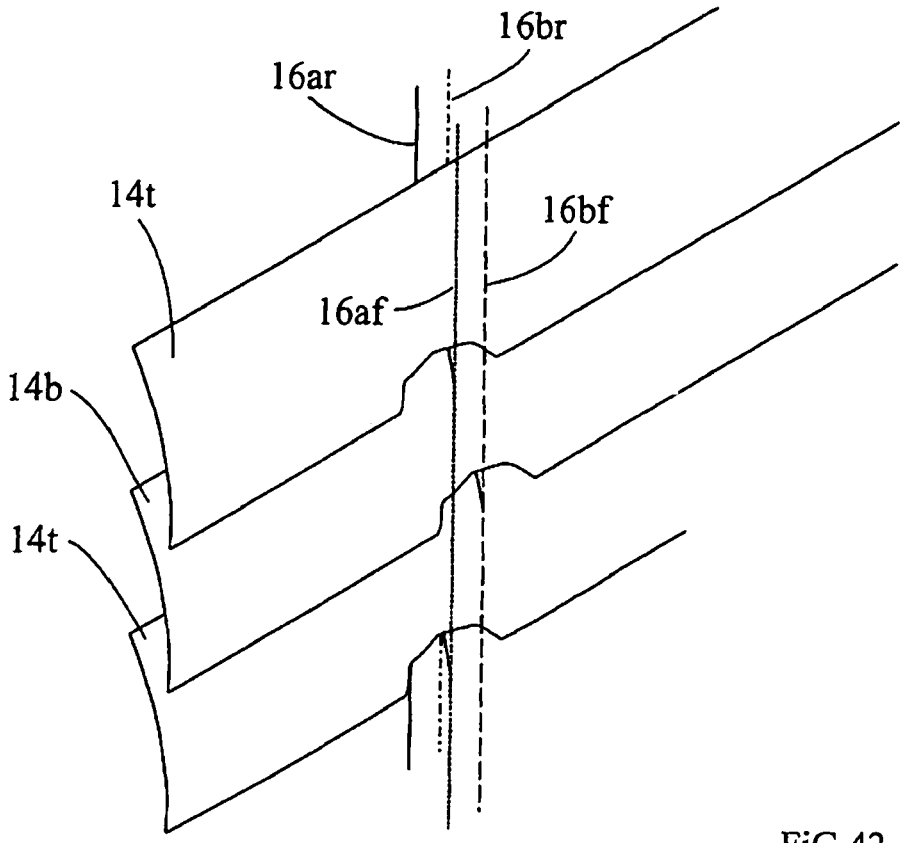
Figure 43:
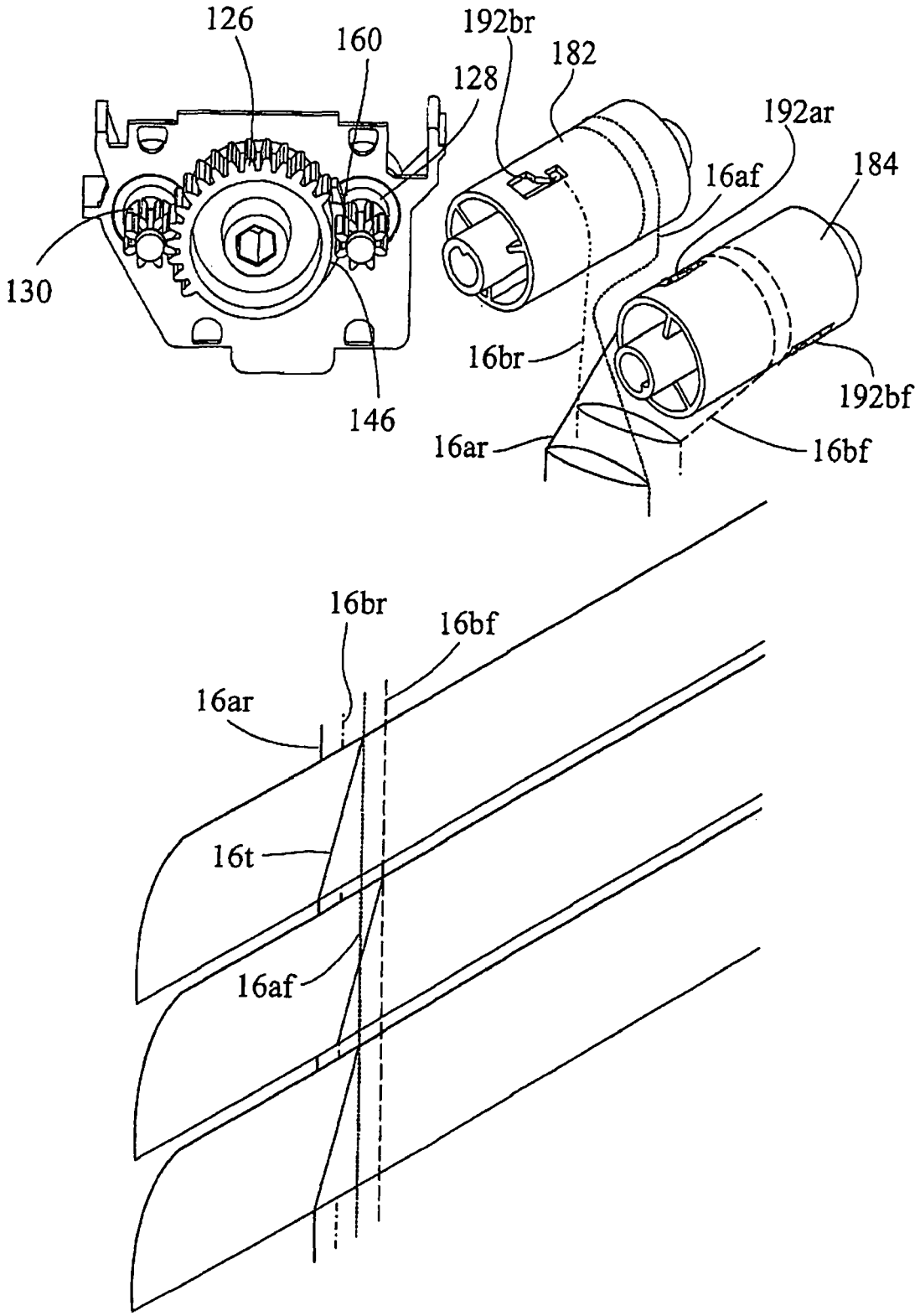
FIG. 43 is similar to FIG. 42 but showing the positions of the slats of the blind, of the drums, and of the indexing gear mechanism when the blind is closed room-side up.

FIGS. 41-43 depict the routing of the tilt cables 16 for a double pitch blind configuration. As has already been discussed above, in these three figures, and in all similar figures to follow, the routing of the cables 16 and the position of the tilt drums 182, 184 (particularly to depict the relative location of the tie-off points of the ends of the tilt cables 16 to the tilt drums 182, 184) are shown relative to the corresponding position of the slats 14 of the blind 120. For greater clarity, a perspective end view of the corresponding indexing gear mechanism 124 is included as part of these views (with the housing 132 removed for clarity) to show the orientation of the indexing gear 126 and of the driven gears 128, 130 corresponding to the orientation of the tilt drums 182, 184 and of the slats 14.

As was explained earlier, the tilt cables are generically designated as item 16, but are further identified by the following suffixes:

- "a" is for the first set of tilt cables, those supporting the upper (or top) slats 14*t* in each pair
- "b" is for the second set of tilt cables, those supporting the lower (or bottom) slats 14*b* in each pair
- "f" is for the front tilt cables, those on the room side of the blind
- "r" is for the rear tilt cables, those on the wall side (also referred to as the window side) of the blind
- 'x' is for an actuator tilt cable which is typically secured to one of the front or rear tilt cables 16

Referring to FIG. 41, the tilt drums 182, 184 are in their neutral position (as a reminder, this neutral position refers to the position of the tilt drums 182, 184 corresponding to the position of the driven gears 128, 130 where they are aligned with the indexing gear 126 as shown in FIGS. 32 and 33, with the concave sections 160 of the driven gears 128, 130 just about to engage the boss 146 of the indexing gear 126) and with the slats open in a double pitch configuration. The first room-side tilt cable 16*af* is routed counterclockwise around and is secured to the wall-side drum 182 at the slotted opening 192*af*. The first wall-side tilt cable 16*ar* is routed clockwise over and is secured to the room-side drum 184 at the slotted opening 192*ar*. The second room-side tilt cable 16*bf* is routed counterclockwise onto and is secured to the room-side drum 184 at the slotted opening 192*bf* (not shown in FIG. 41, but visible in FIG. 42). Finally, the second wall-side tilt cable 16*br* is routed clockwise onto and is secured to the wall-side drum 182 at the slotted opening 192*br* (not shown in FIG. 41, but visible in FIG. 43). In this routing and configuration of the tilt cables 16, the slats 14 are tilted open in a double pitch configuration as shown in FIGS. 41 and 29 when the drums and gears are in the neutral position.

Referring now to FIG. 42, as the indexing gear 126 is rotated counterclockwise from the neutral position (by pulling on one of the two tilt cords 24 which makes the tilter mechanism 26 rotate the tilt rod 28' counterclockwise), the wall-side driven gear 130 (and with it, its corresponding tilt drum 182, connected to the wall-side driven gear 130 by the tilt rod 28) just begins to rotate clockwise before its concave section 160 abuts the boss 146 of the indexing gear 126, preventing any further rotation of the wall-side driven gear 130. This condition is shown in FIG. 42 where the tie-off point 192*af* for the room-side tilt cable 16*af* of the top slat 14*t* is shown to have rotated just a few degrees in the clockwise direction, creating the overlap desired between adjacent pairs of slats 14 (as discussed earlier with respect to a previous embodiment 10). Thus, the first front and second rear tilt cables 16*af*, 16*br* secured to the wall-side tilt drum 182 remain essentially stationary.

However, as the indexing gear 126 is rotated counterclockwise from the neutral position, the toothed portion 162 of the room-side driven gear 128 engages the toothed portion 140 of the indexing gear 126, such that this room-side driven gear 128 (and its corresponding room-side tilt drum 184) are driven clockwise and continue to rotate in a clockwise direction for several rotations before its concave section 160 contacts the boss 146 of the indexing gear 126 to prevent any further rotation. The first rear tilt cable 16*ar* secured to the room-side tilt drum 184 at slotted opening 192*ar* winds up onto the room-side tilt drum 184, pulling up on the wall-side of the top slats 14*t*. At the same time, the second front tilt cable 16*bf* unwinds from the room-side tilt drum 184, lowering the room-side of the bottom slats 14*b*. The result is the tilted closed, room-side down configuration of the slats 14 as shown in FIG. 42.

FIG. 43 illustrates the position of the indexing gear 126, the driven gears 128, 130, and the tilt drums 182, 184 for the slats 14 of the blind in the tilted closed, room-side up configuration. In this case, the indexing gear 126 is rotated clockwise from the neutral position shown in FIG. 41. This causes the room-side driven gear 128 to begin rotating counterclockwise, but its concave portion 160 promptly abuts the boss 146 of the indexing gear 126, locking the room-side driven gear 128 (and its corresponding room-side tilt drum 184) from any further counterclockwise rotation. As a result, the first rear and second front tilt cables 16*ar*, 16*bf*, which are secured to the room-side tilt drum 184, remain essentially stationary. However, the wall-side driven gear 130 and its corresponding wall-side tilt drum 182 rotate counterclockwise for several rotations, raising the first front tilt cable 16*af* as it winds onto the wall-side tilt drum 182, and lowering the second rear tilt cable 16*br* as it unwinds from the wall-side tilt drum 182. The result is the tilting closed of the slats 14 in the room-side up configuration shown in FIG. 43.

Alternative Configuration for the Parallel Drum Design

Figure 44:
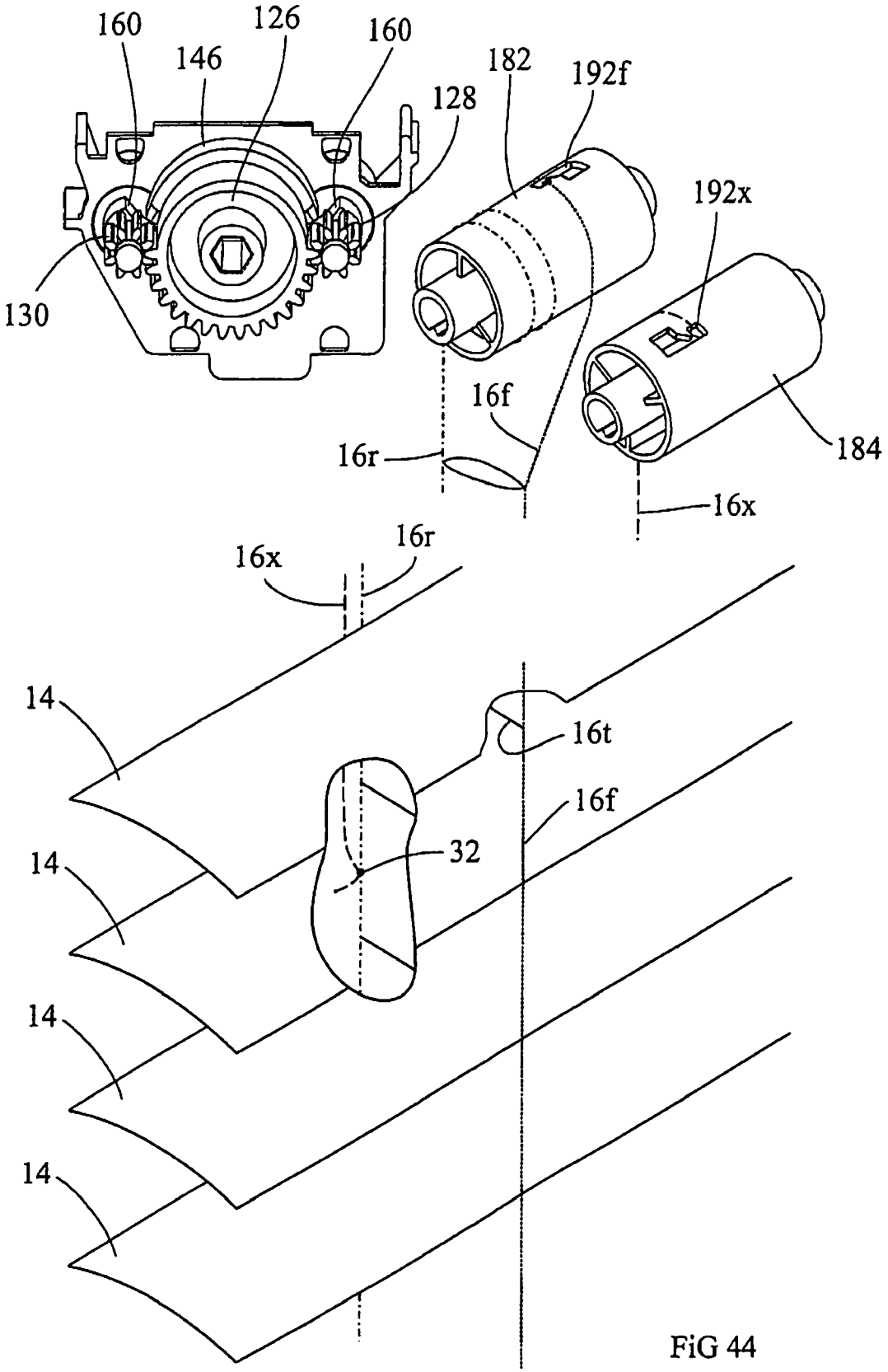
FIG. 44 is schematic, perspective view, partially broken away, of the blind of FIG. 29, showing the position of the drums and the routing of the tilt cables for a tilting configuration that permits part of the blind to be open while another part is closed, as well as the corresponding view of the indexing gear mechanism to more clearly indicate the relative rotational positions of the driven gears.
Figure 45:
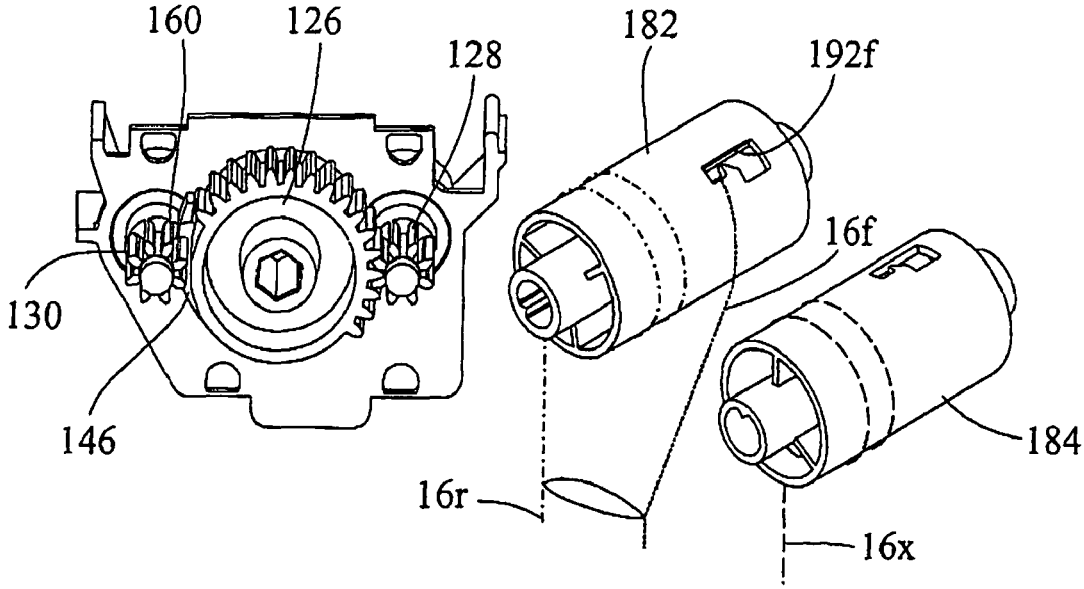
FIG. 45 is similar to FIG. 44 but shows the positions of the slats of the blind, of the drums, and of the indexing gear mechanism when the lower portion of the blind is closed room-side down while the upper portion of the blind remains tilted open.
Figure 45:
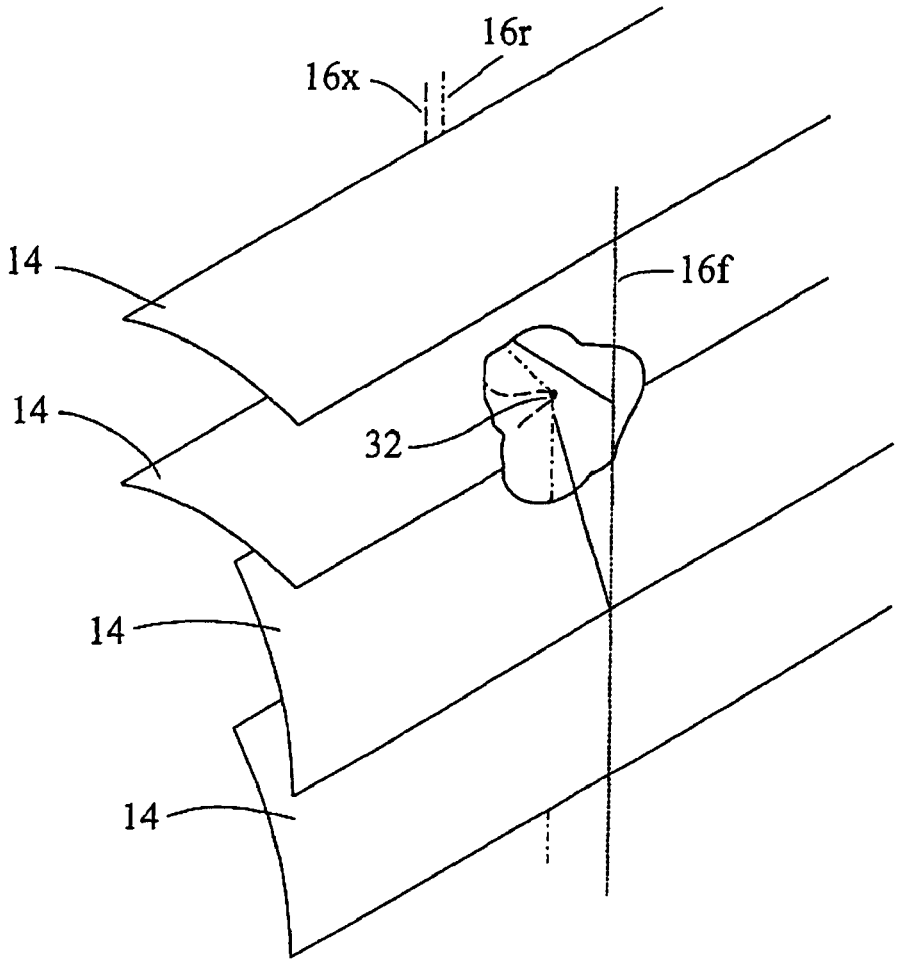
Figure 46:
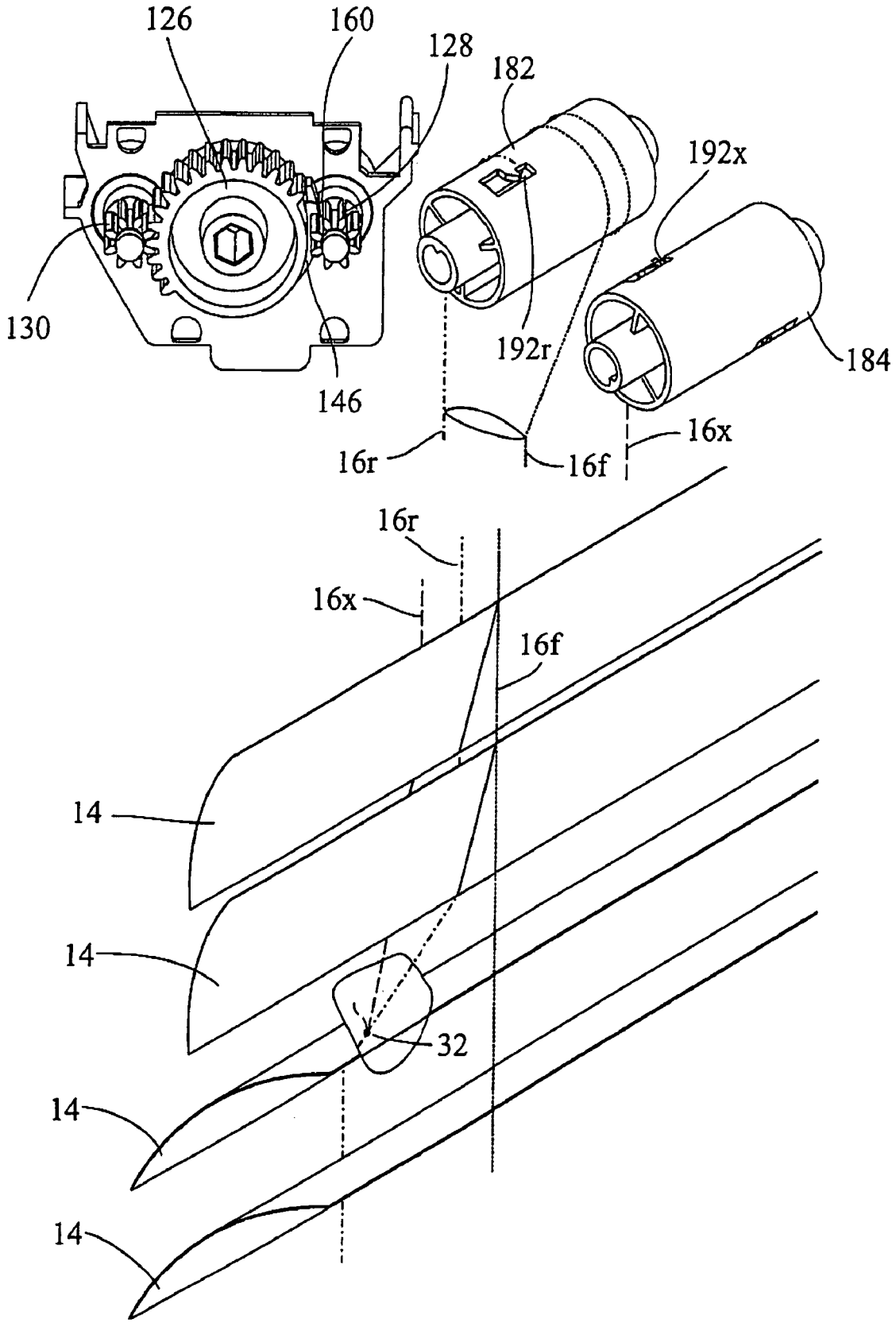
FIG. 46 is similar to FIG. 44 but shows the positions of the slats of the blind, of the drums, and of the indexing gear mechanism when the upper portion of the blind is closed room-side up while the lower portion of the blind remains tilted open.

FIGS. 44-46 depict an alternative routing of the tilt cables 16 on the same parallel drum mechanism described above in order to be able to tilt one portion of the blind closed while another portion remains open. Referring to FIG. 44, the hardware differences between this blind and the double pitch configuration blind in FIG. 41 are as follows:

Instead of having two sets of double-pitch ladder tapes at each tilt station, this blind has only a single ladder tape of standard pitch configuration, including front and rear cables and cross cords 16*f*, 16*r*, 16*t*. It also has an actuator tilt cable

16*x* secured to the rear tilt cable 16*r* at the knot or cord attachment clip 32. The routing of these tilt cables 16 is as described below.

The rear (wall-side) tilt cable 16*r* wraps clockwise around the wall-side tilt drum 182 and attaches to the wall-side tilt drum 182 at the slotted opening 192*r* (not visible in FIG. 44 but seen in FIG. 46). The front (room-side) tilt cable 16*f* wraps counterclockwise around the wall-side tilt drum 182 and attaches to the wall-side tilt drum 182 at the slotted opening 192*f*. The actuator tilt cable 16*x* wraps clockwise around the room-side tilt drum 184 and attaches to the room-side tilt drum 184 at the slotted opening 192*x*. In FIG. 44, the mechanism (indexing gear 126, driven drums 128, 130, and tilt drums 182, 184) is in its neutral position, and the slats 14 are all tilted open.

In FIG. 45, the indexing gear 126 has been rotated counterclockwise via the tilter 26 and the tilt rod 28', which rotates the driven gears 128, 130 (and their corresponding tilt drums 184, 182) in a clockwise direction. The wall-side driven gear 130 stops rotating almost immediately as its concave section 160 mates with the boss 146 of the indexing gear 126, while the room-side driven gear 128 (and its corresponding tilt drum 184) continues to rotate for several rotations. This means that the front and rear tilt cables 16*f*, 16*r* are not pulled upwardly or released from their drum 182 any substantial distance. However, the actuator cable 16*x*, which is attached to the room-side tilt drum 184 at 192*x*, winds onto the room-side tilt drum 184. This raises the actuator cable 16*x*, and it also raises the rear tilt cable 16*r* at the point 32 where the actuator cord 16*x* is attached to the rear tilt cable 16*r*, as shown in FIG. 45. The end result is the tilting configuration of FIG. 45, where the upper portion of the blind remains open while the lower section of the blind is tilted closed room-side down.

In FIG. 46, the indexing gear 126 has been rotated clockwise from its neutral position (via the tilter 26 and the tilt rod 28'), which rotates the driven gears 128, 130 (and their corresponding tilt drums 184, 182) in a counterclockwise direction. The room-side driven gear 128 (and its corresponding room-side tilt drum 184) begins to rotate counterclockwise and is immediately prevented from further rotation as the concave portion 160 of the room-side driven gear 128 mates with the boss 146 of the indexing gear 126. The actuator cord 16*x*, which is attached to the room-side tilt drum 184 thus remains essentially motionless.

The wall-side driven gear 130 continues to rotate counterclockwise, causing the wall-side driven drum 182 to rotate counterclockwise as well. This causes the front tilt cable 16*f* to wind up onto the wall-side tilt drum 182 while the rear tilt cable 16*r* unwinds from the wall-side tilt drum 182. However, since the actuator cord 16*x* is attached to the rear tilt cable 16*r* at the tie-off point 32, and since the actuator cord 16*x* remains substantially motionless, the rear tilt cable 16*r* drops only for those slats 14 which are above the tie-off point 32. Below the tie-off point 32, the actuator cord 16*x* holds on to the rear tilt cable 16*r*, preventing it from dropping. Thus, the slats 14 above the tie-off point are tilted closed, room-side up, while the balance of the slats 14 tilt closed only partially, approximately at a 45 degree angle.

It will be obvious to those skilled in the art that the location of the tie-off point 32 relative to the rear tilt cable 16*r* affects the point at which the "break" occurs between the slats which are tilted closed and those which remain tilted open. It will also be obvious that connecting the actuator tilt cable to the front tilt cable 16*f* rather than to the rear tilt cable as shown here would result in the blind tilting closed below the break point in the room side up direction rather than in the room side down configuration shown in FIG. 45.

Pleated Look Configuration for the Parallel Drum Design

Figure 47:
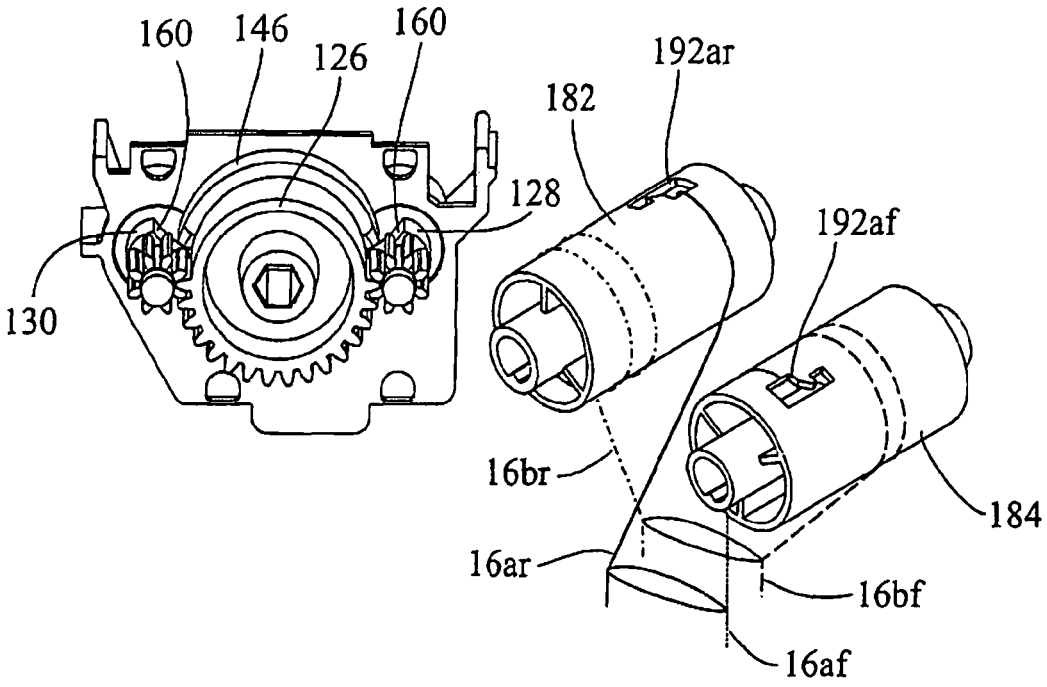
FIG. 47 is schematic, perspective view, partially broken away, of the blind of FIG. 29, showing the position of the drums and the routing of the tilt cables for a pleated look and double pitch configuration, as well as the corresponding view of the indexing gear mechanism to more clearly indicate the relative rotational positions of the driven gears.
Figure 47:
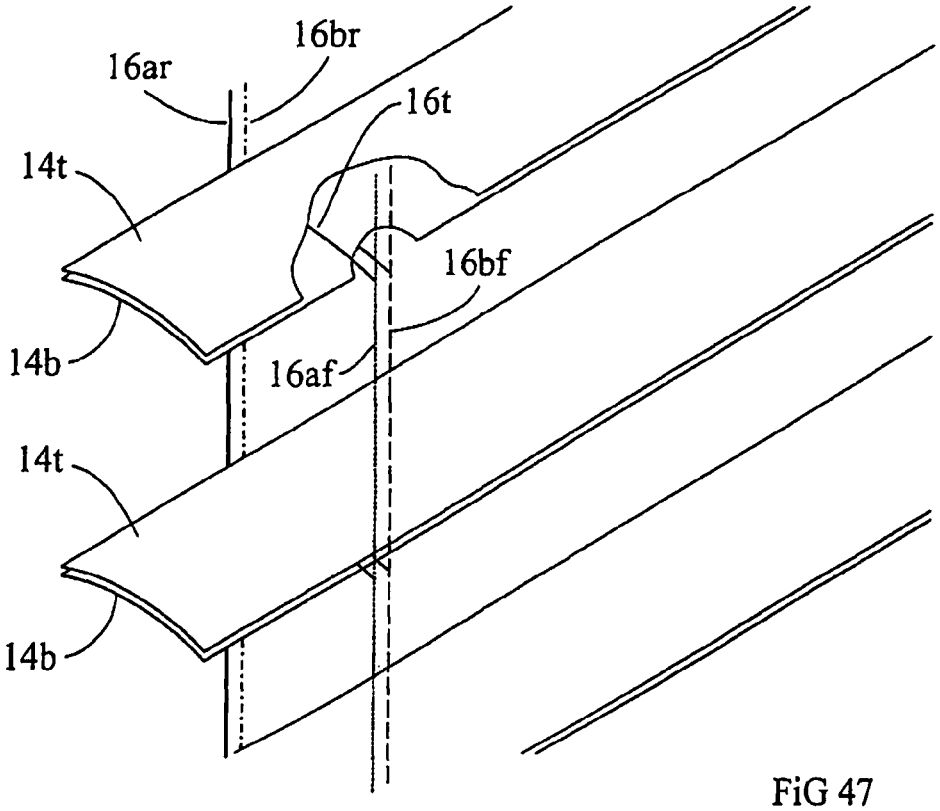
Figure 48:
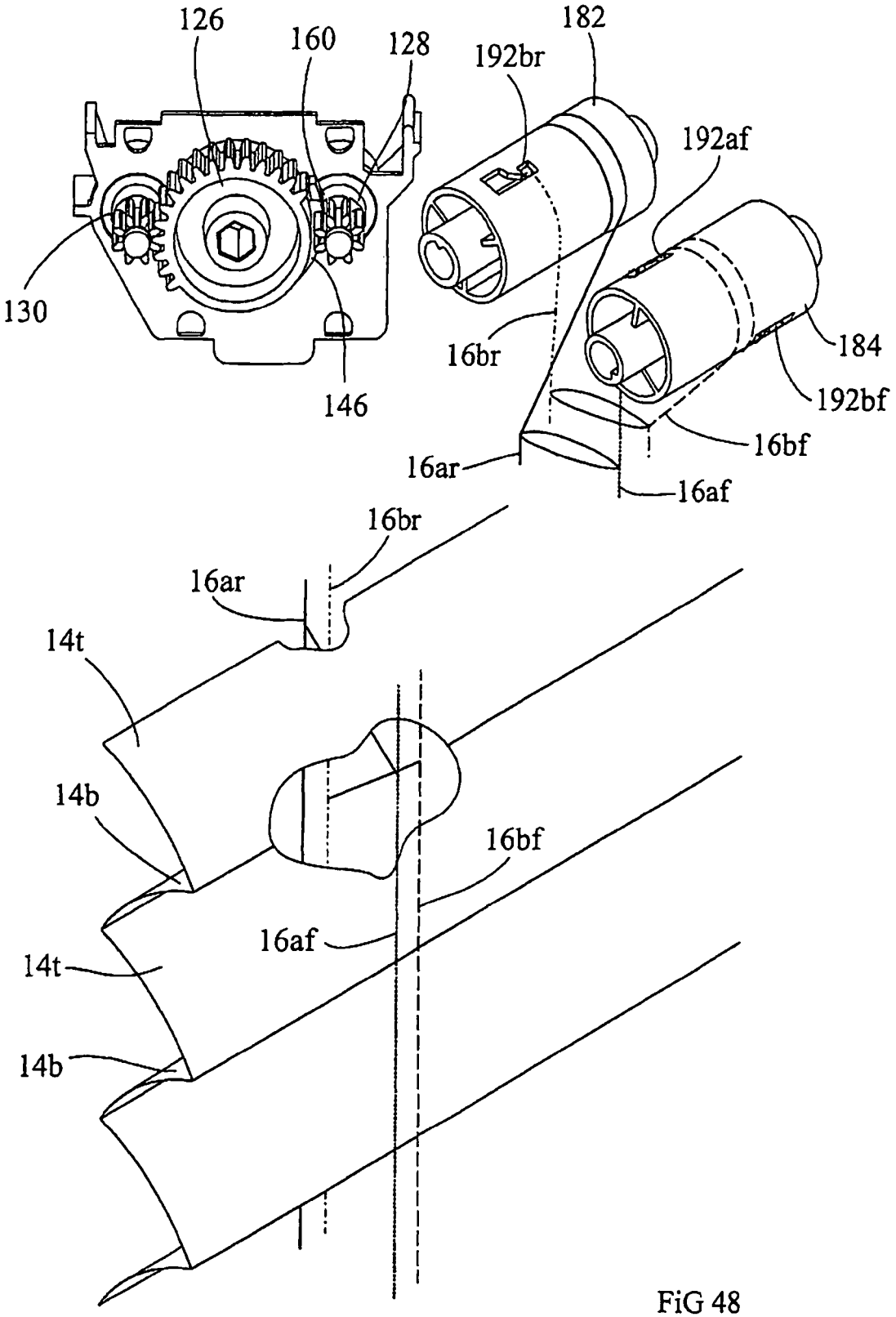
FIG. 48 is similar to FIG. 47 but shows the positions of the slats of the blind, of the drums, and of the indexing gear mechanism when the blind is pleated closed in one direction.
Figure 49:
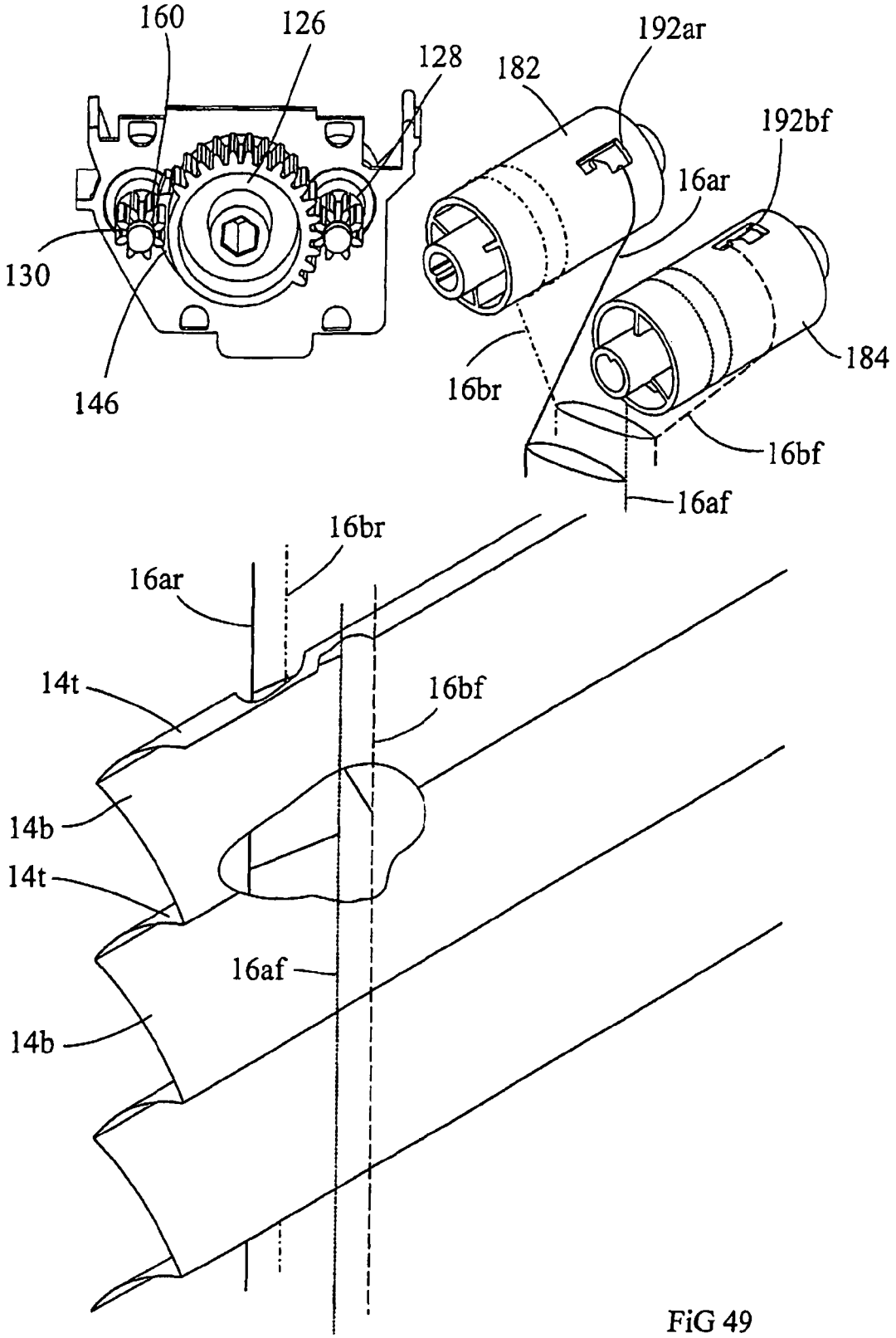
FIG. 49 is similar to FIG. 47 but shows the positions of the slats of the blind, of the drums, and of the indexing gear mechanism when the blind is pleated closed in the opposite direction.

FIGS. 47-49 depict an alternative routing of the tilt cables for a pleated look blind configuration. Referring to FIG. 47, there are no hardware differences between this pleated look configuration and the double pitch configuration of FIG. 41. The only differences are in the routing of the tilt cables 16.

The front tilt cable 16*af* of the top slats 14*t* wraps clockwise around and is secured to the room-side tilt drum 184 at the point 192*af*. The rear tilt cable 16*ar* of the top slats 14*t* wraps counterclockwise around and is secured to the wall-side tilt drum 182 at 192*ar*. The front tilt cable 16*bf* of the bottom slats 14*b* wraps counterclockwise around and is secured to the room-side tilt drum 184 at the point 192*bf*. Finally, the rear tilt cable 16*br* of the bottom slats 14*b* wraps clockwise around and is secured to the wall-side tilt drum 182 at the point 192*br*.

As in the case of the double pitch blind depicted in FIG. 41, the pleated look configuration also starts with the slats 14 in a double pitch configuration when the mechanism is in the neutral position as shown in FIG. 47. Referring now to FIG. 48, as the tilt rod 28' is rotated clockwise, it drives the indexing gear 126 clockwise, and the driven drums 128, 130 (and their corresponding tilt drums 184, 182) are urged to rotate counterclockwise. The room-side driven gear 128 and its corresponding room-side tilt drum 184 almost immediately are prevented from further counterclockwise rotation as the concave portion 160 of the room-side driven gear 128 mates with the boss 146 of the indexing gear 126. Therefore, the front tilt cables 16*af*, 16*bf*, which are secured to the room side drum 184, remain essentially stationary, and the fronts of the slats 14*t*, 14*b* remain essentially stationary.

The wall-side driven gear 130 and its corresponding wall-side tilt drum 182 continue to rotate counterclockwise for several rotations. This winds up the first rear tilt cable 16*ar* onto the wall-side tilt drum 182 and unwinds the second rear tilt cable 16*br*, thus causing the rear side of the upper slats to be raised and the rear side of the lower slats to be lowered, thereby resulting in the pleated look of FIG. 48, with the top slats 14*t* tilted room-side down, and the bottom slats 14*b* tilted room-side up.

FIG. 49 depicts the pleated look blind of FIG. 48 but tilted closed in the opposite direction. In this case, the tilt rod 28' has been rotated counterclockwise from the neutral position, rotating the indexing gear 126 counterclockwise and driving the driven gears 182, 184 clockwise. Since the wall-side driven gear 130 promptly stops, because its concave section 160 mates with the boss 146 of the indexing gear 126, only the room-side driven gear 128 and its corresponding room-side tilt drum 184 continue to rotate clockwise. In this instance, since the first and second rear tilt cables 16*ar* and 16*br* are attached to the wall-side tilt drum 182, and since the wall-side tilt drum 182 does not rotate, then the rear (wall-side) edges of the top and bottom slats 14*t*, 14*b* remain essentially stationary. At the same time, the front tilt cable 16*af* of the top slats 14*t* wraps onto the room-side tilt drum 184 and the front tilt cable 16*bf* of the bottom slats 14*b* unwraps from the room-side tilt drum 184, thereby raising the front edge of the top slats 14*t* and lowering the front edge of the bottom slats 14*b*, creating the pleated look shown in FIG. 49, with the upper slats in the room side up position and the lower slats in the room side down position.

Variable Radius Wrap Drum Design

Figure 50:
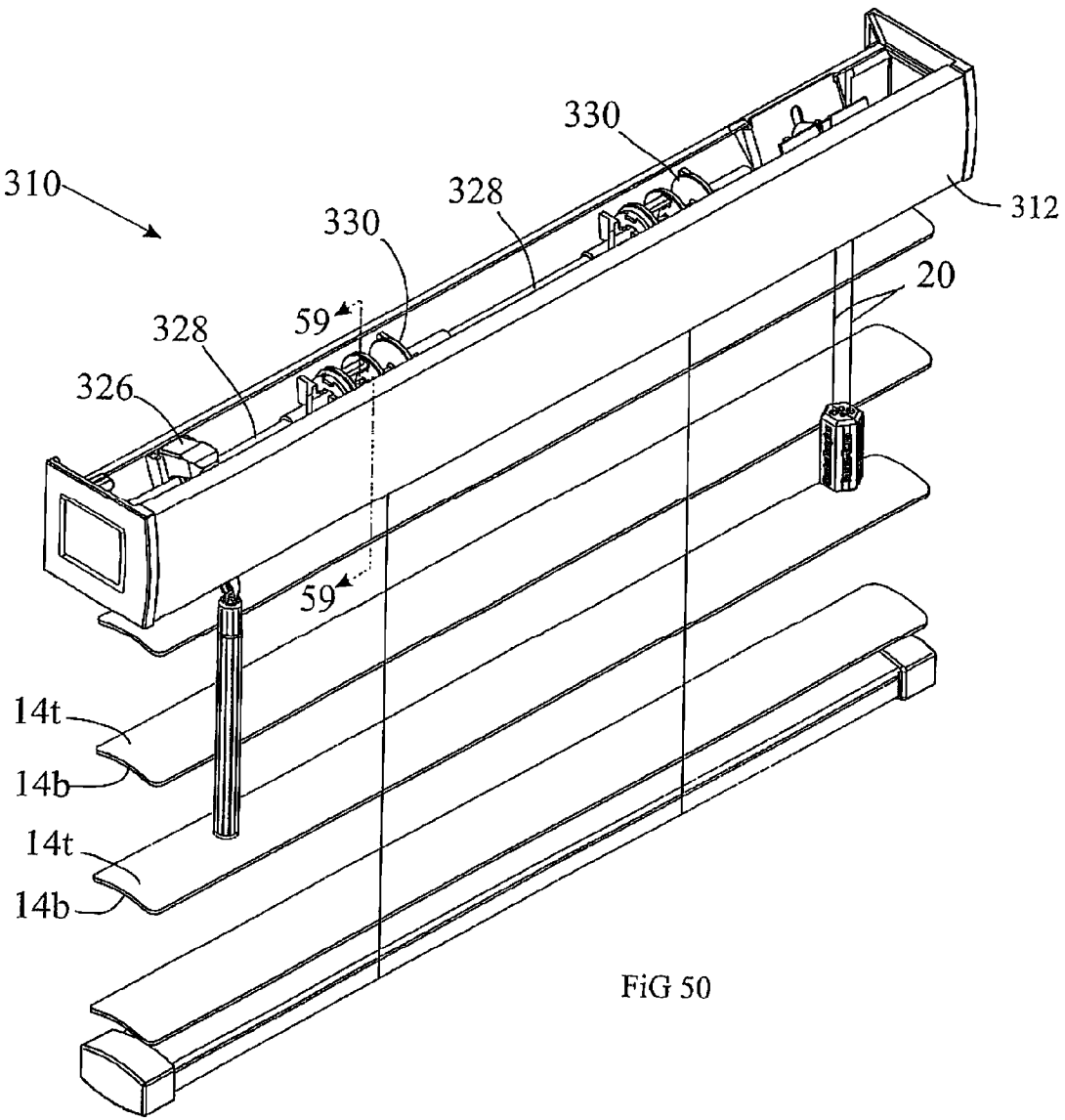
FIG. 50 is a perspective view of another embodiment of a blind system made in accordance with the present invention, with the blind open in a double pitch configuration.
Figure 51:
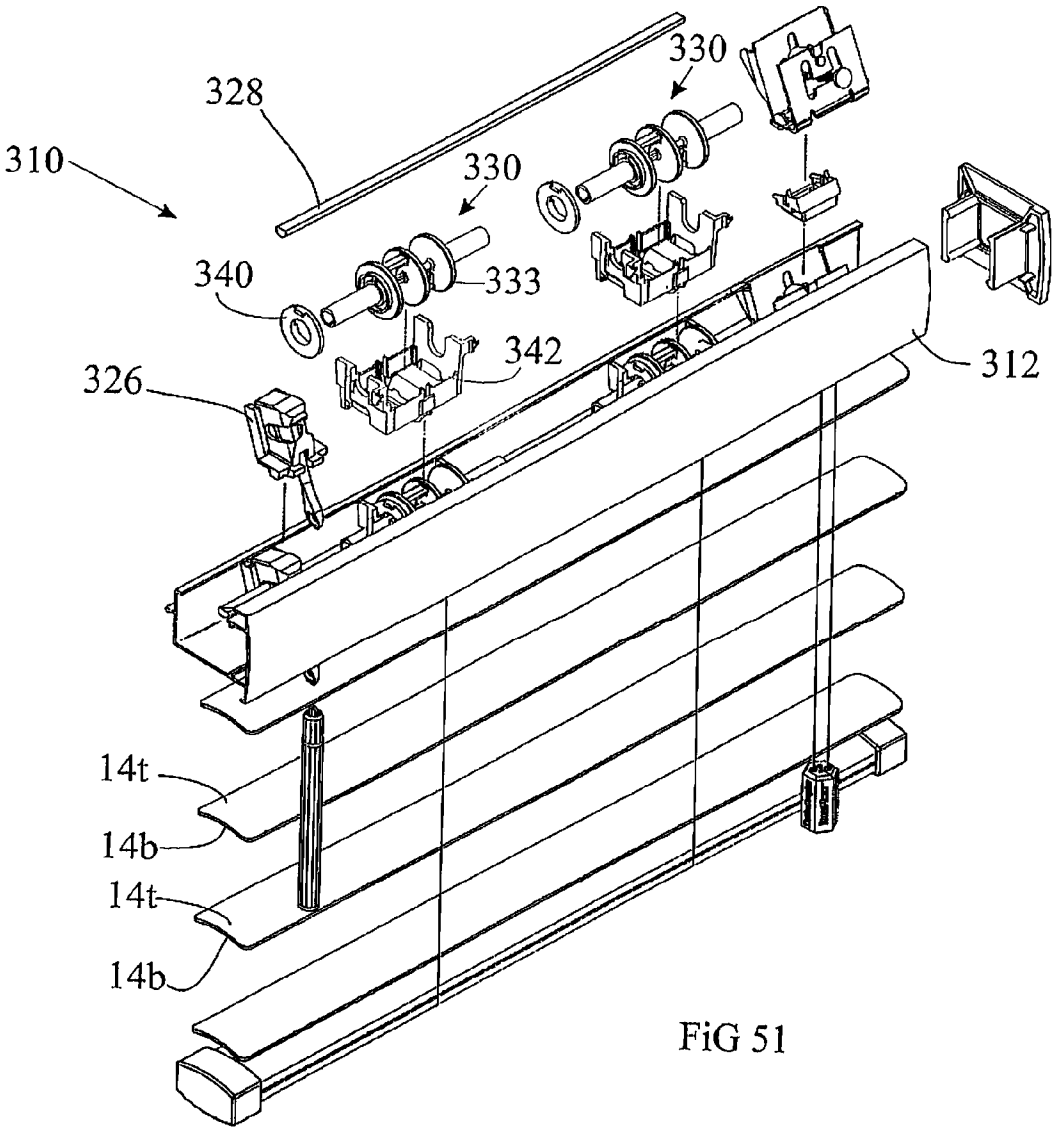
FIG. 51 is a perspective view of the blind of FIG. 50, with a partially exploded perspective view of the mechanism inside the head rail also shown above the blind.
Figure 52:
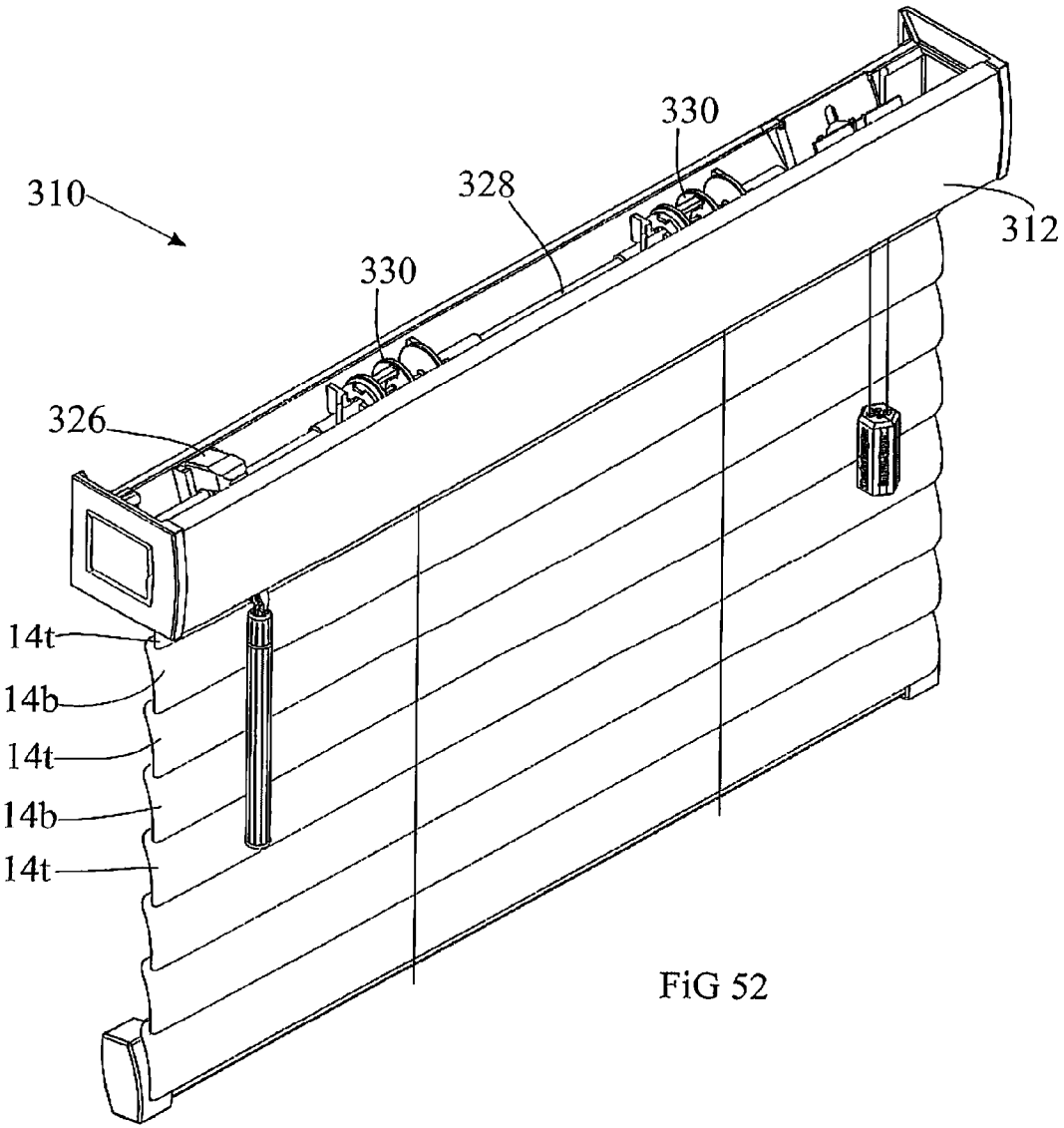
FIG. 52 is a perspective view of the blind of FIG. 50 with the blind shown in the closed position, room-side down.
Figure 53:
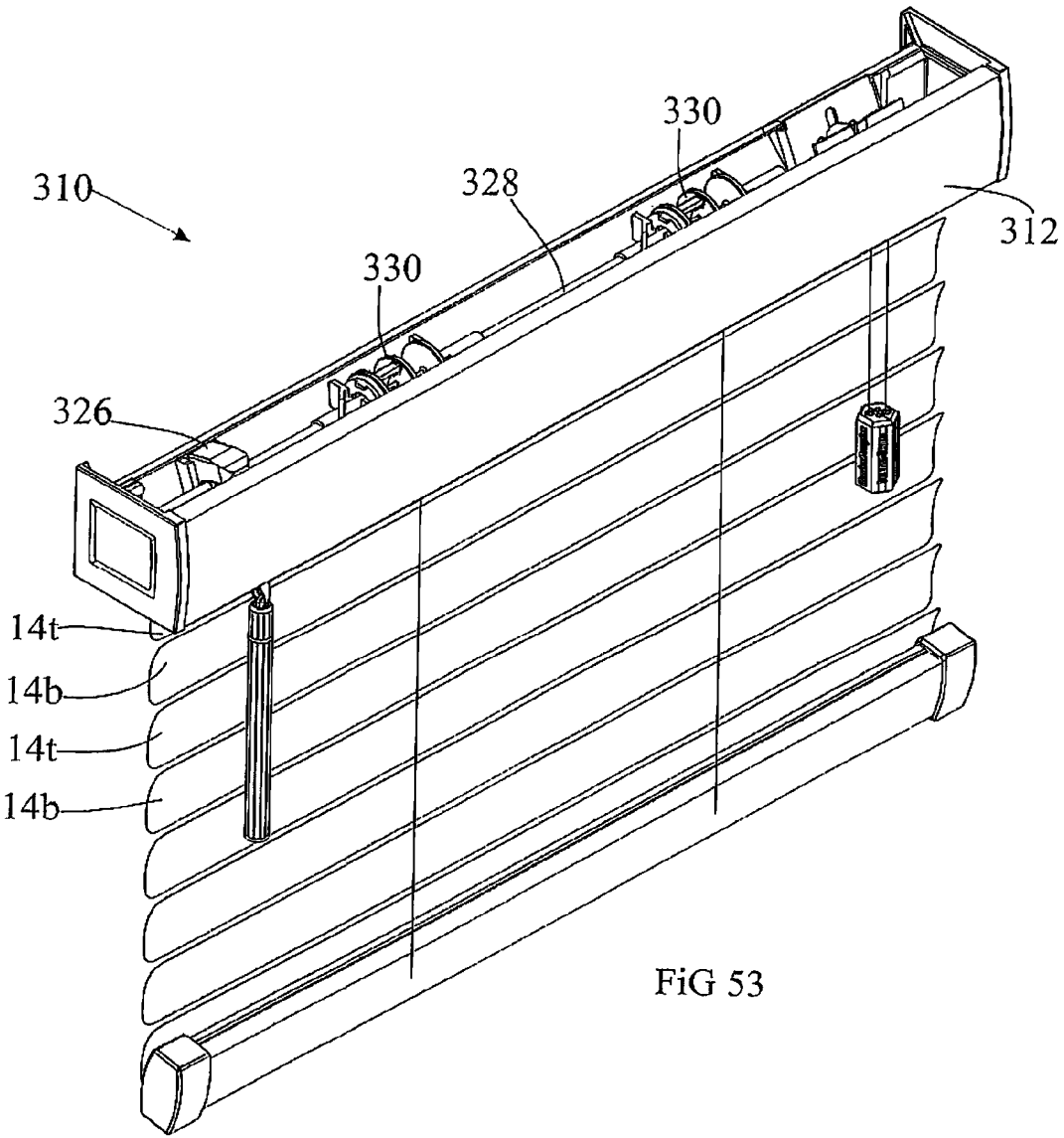
FIG. 53 is a perspective view of the blind of FIG. 50 with the blind shown in the closed position, room-side up.

Referring now to FIGS. 50 and 51, the blind 310 is very similar to the blind 10 of FIG. 1 except that, instead of using the tilt stations 30, the tilting function is accomplished using the tilt stations 330 which are functionally interconnected, via the tilt rod 328, to a wand-type tilter mechanism 326. Of course, other known tilter mechanisms, such as the tilter mechanism 26 of FIG. 1, could be used in this embodiment 310. These variable-radius-wrap tilt stations 330 are preferably used to elegantly accomplish a double-pitch blind configuration as shown in FIG. 50, which can close either room-side down as shown in FIG. 52 or room-side up as shown in FIG. 53.

Figure 54:
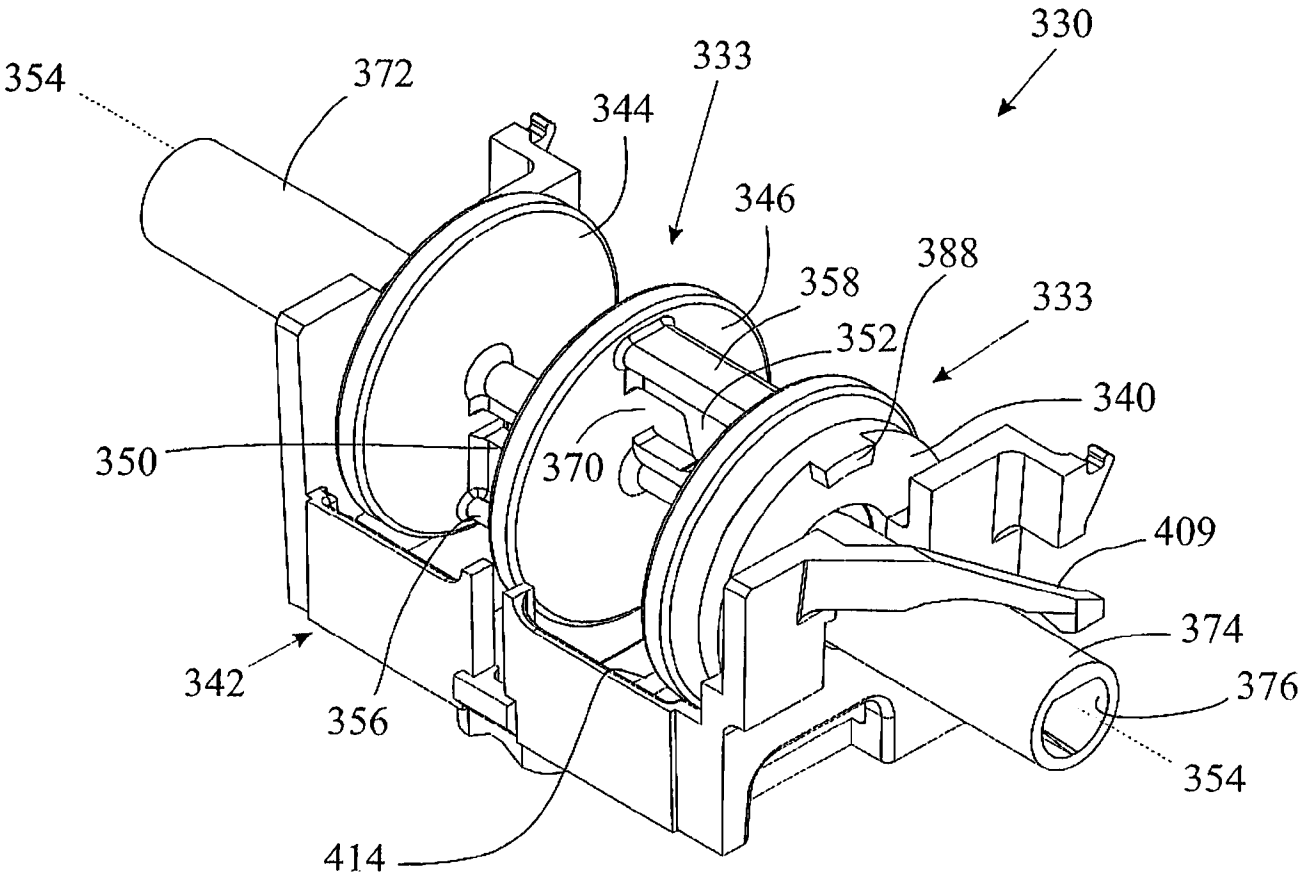
FIG. 54 is a perspective view of one of the tilt stations of FIG. 51.
Figure 55:
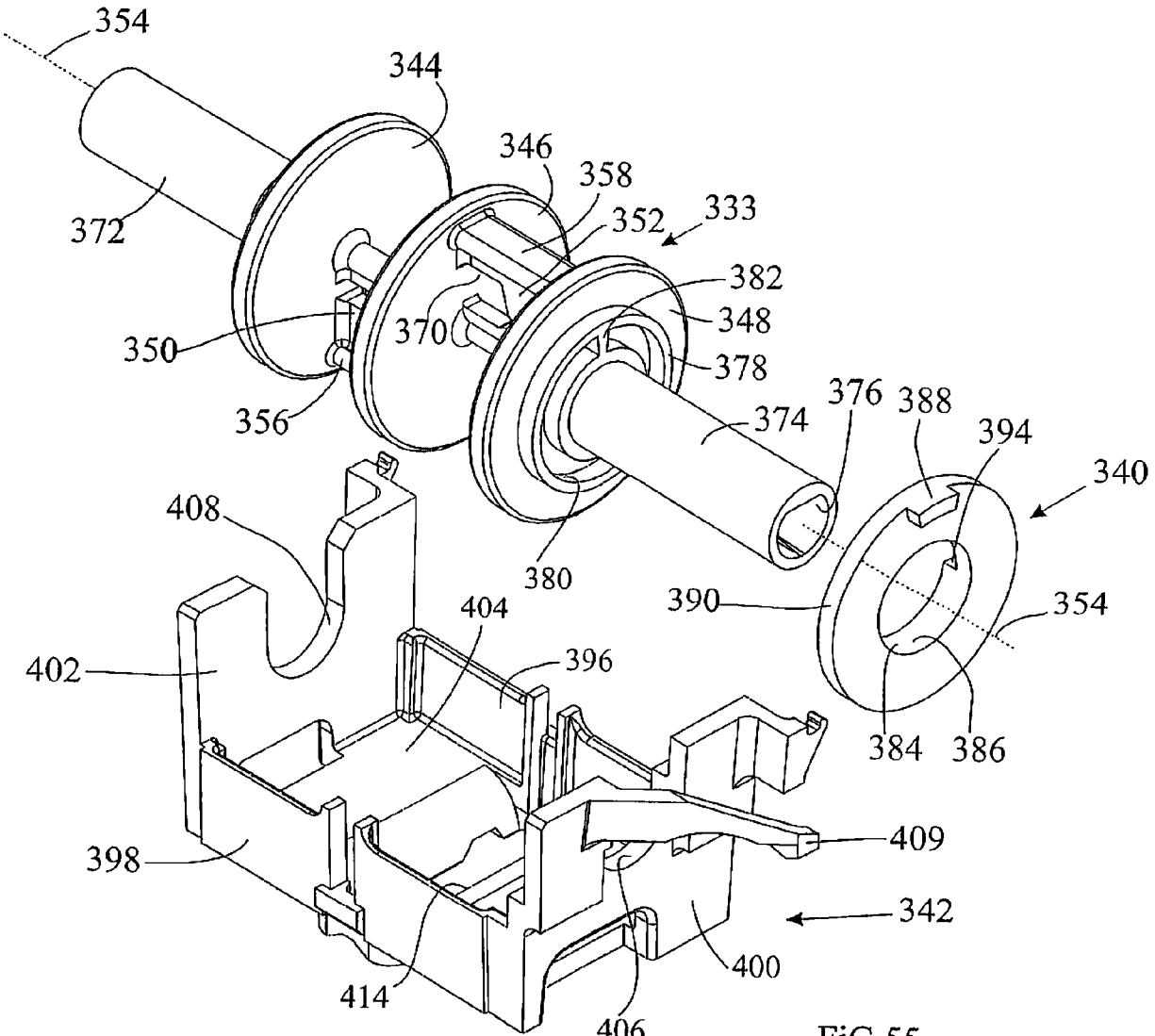
FIG. 55 is an exploded, perspective view of the tilt station of FIG. 54.
Figure 56:
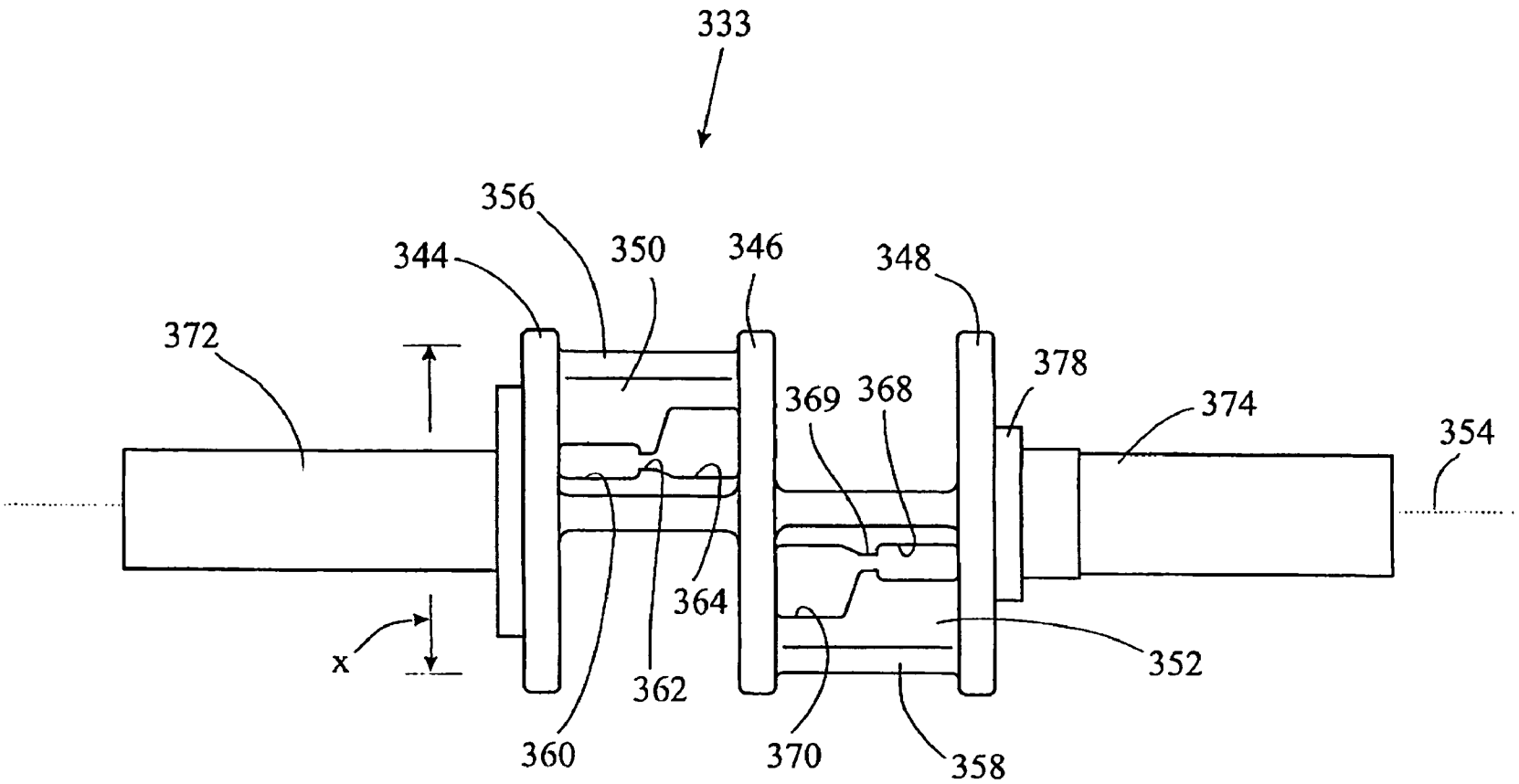
FIG. 56 is a side view of the drum portion of the tilt station of FIG. 55.

Referring to FIGS. 54-58, the variable-radius-wrap tilt station 330 includes a housing 342, a drum portion 333, and a stop washer 340. Referring now to FIGS. 55 and 56, the drum portion 333 is an elongated, substantially cylindrical element including three coaxial flanges 344, 346, 348 with a web 350 interconnecting the left flange 344 and the middle flange 346, and a web 352 interconnecting the right flange 348 and the middle flange 346. Each web 350, 352 is essentially a two-dimensional wall. The web 350 extends from the axis of rotation 354 of the drum portion 333 to the outer edges of the flanges 344, 346, at which point the web 350 terminates in an axially directed wrap surface 356 (See also FIG. 59) which extends from the first flange 344 to the middle flange 346. Similarly, the web 352 extends from the axis of rotation 354 of the drum portion 333 to the outer edges of the flanges 346, 348, at which point the web 352 terminates in an axially directed wrap surface 358 which extends from the middle flange 346 to the rightmost flange 348. It should be noted that the webs 350, 352 are 180 degrees out of phase with each other. That is, they extend in radially opposite directions to each other. Each web 350, 352 is fixed to the drum portion 333 so it rotates with the drum portion 333 and with the tilt rod that drives the drum portion 333. Each web 350, 352 also is eccentric relative to the axis of rotation of the drum portion 333. Thus, it may be seen that the drum portion 333 effectively defines two drums or spools which rotate in unison; the first drum 350 is between the flanges 344 and 346 (with tilt cables 16*bf*, 16*br* wrapping over the wrap surface 356 of this first drum 350), and the second drum 352 is between the flanges 346 and 348 (with tilt cables 16*af*, 16*ar* wrapping over the wrap surface 358 of this second drum) as described in more detail below.

The first web 350 defines a slotted opening, which includes a first portion 360, a necked-down portion 362, and a larger portion 364. As shown schematically in FIGS. 59 and 60, an enlargement, such as a knot or bead 366 may be attached to the end of each tilt cable 16 in order to readily secure the tilt cables 16 to the drum portion 333. During assembly, an enlargement 366 is pushed through the larger portion 364, and then the tilt cable 16 is shifted over through the necked-down portion 362 until the enlargement 366 is caught behind the first portion 360 of the slot, which has a smaller opening than the larger portion 364. The web 352 defines a similar slotted opening with a smaller portion 368, a necked-down portion 369, and a larger portion 370, used in the same manner. As described in more detail below, this same procedure is repeated to secure the two tilt cables 16*br*, 16*bf* (supporting the bottom slat 14*b* of a paired set of slats 14*t*, 14*b*) to the first web 350 (which may therefore also be referred to as the "lower slats" web 350), and to secure the two tilt cables 16*ar*, 16*af* (supporting the top slat 14*t* of a paired set of slats 14*t*, 14*b*) to the second web 352 (which may therefore also be referred to as the "upper slats" web 352).

The drum portion 333 further includes a first hollow shaft 372 which projects axially to the left from the leftmost flange 344. This shaft 372 terminates at the leftmost flange 344. Similarly, a second hollow shaft 374, which is coaxial with the first hollow shaft 372, projects axially to the right from, and terminates at the rightmost flange 348. Each of these shafts 372, 374 defines a non-cylindrically-profiled, inner, hollow core 376 designed to engage its respective segment of the tilt rod 328 such that rotation of the tilt rod 328 causes rotation of the drum portion 333. It should be noted that, because each of these shafts 372, 374 terminates at its respective flange 344, 348, the tilt rod 328 does not extend through the tilt station 330 and instead is made up of segments.

Looking at FIG. 55, at the juncture of the rightmost flange 348 and the second hollow shaft 374, there is a concentric ring 378 which defines an axially directed annular recess 380 which extends through almost a complete 360° circle except for a short radial discontinuity or stop 382. As described in more detail below, this annular recess 380 and stop 382 cooperate with the stop washer 340 to allow 360° of rotation of the drum portion 333.

Figure 57:
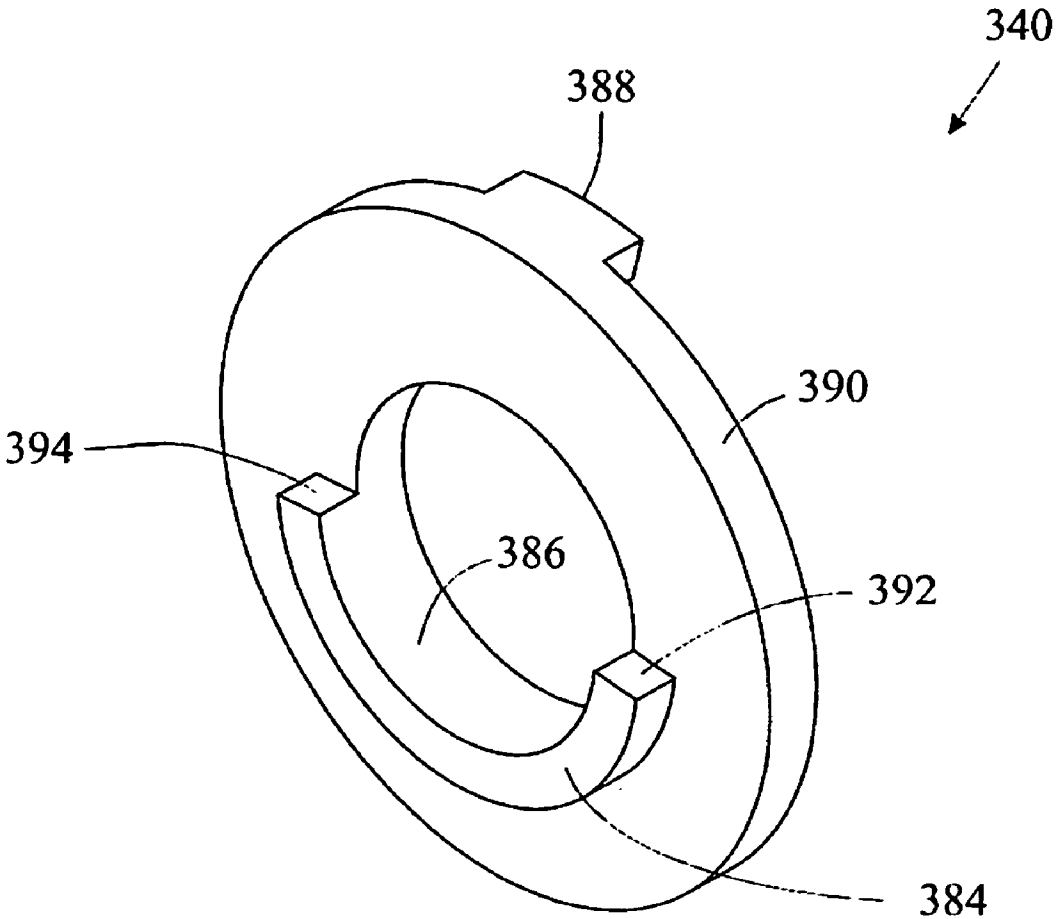
FIG. 57 is a perspective view of the back side of the stop washer of FIG. 55.

Referring now to FIGS. 55 and 57, the stop washer 340 defines a half-moon shaped shoulder 384 projecting axially to the left along its inner surface 386, which serves as a drum stop 384. It also defines a short arc length projection extending axially to the right at its outer surface, which serves as a housing stop 388. The stop washer 340 slides over the end of the second hollow shaft 374, and the half-moon shaped shoulder 384 rides in the annular recess 380 of the drum portion 333. The drum portion 333 can only rotate slightly less than 180° relative to the stop washer 340 before one or the other of the stops 392, 394 on the half-moon shaped shoulder 384 impacts against the stop 382.

Figure 58:
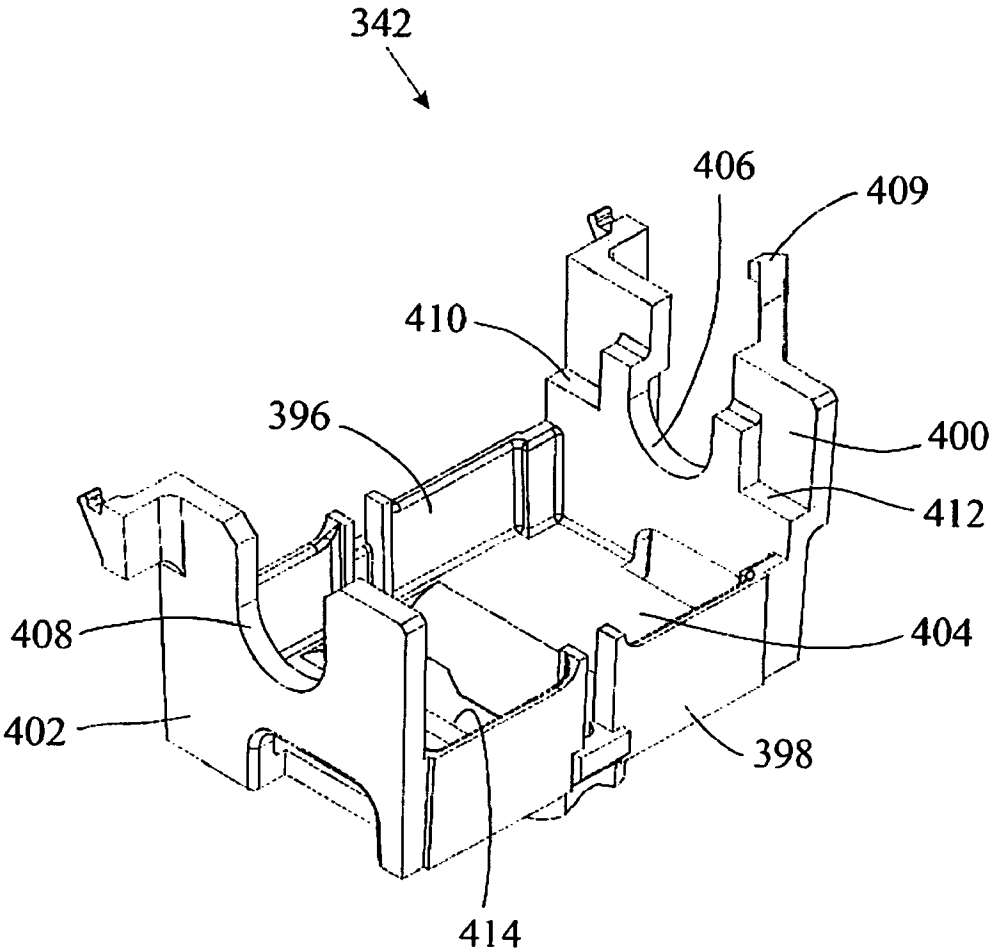
FIG. 58 is an opposite-end, perspective view of the housing of the tilt station of FIG. 55.

Referring now to FIGS. 55 and 58, the housing 342 includes two side walls 396, 398, two end walls 400, 402, and a bottom wall 404. The end walls 400, 402 define "U"-shaped saddles 406, 408 respectively, which provide rotational support for the drum portion 333 by supporting the hollow shafts 372, 374. An arm 409 extends axially at approximately a 45 degree angle from the plane defined by the end wall 400, and it projects over the centerline of the hollow shaft 374 once the drum portion 333 is mounted in the housing 342, thus preventing the drum portion 333 from lifting up out of the housing 342.

The axial distance between the end walls 400, 402 is slightly longer than the axial distance between the outer faces of the flanges 344, 348 (including also the thickness of the stop washer 340 mounted just outside of the flange 348), thus preventing the drum portion 333 from shifting very much in the axial direction relative to the housing 342.

As shown in FIG. 58, on either side of the saddle 406 there are two shelves 410, 412, which act as housing-limit-stops by cooperating with the limit stop 388 on the stop washer 340 to limit the degree to which the drum portion 333 is free to rotate in either direction as explained in more detail below.

The tilt station 330 is assembled as shown in FIG. 54, with the stop washer 340 mounted on the hollow shaft 374 such that the half-moon shaped shoulder 384 rides in the circumferential recess 380 of the rightmost flange 348. This assembly is then mounted into the housing 342 such that the hollow shaft 372 is rotationally supported on the "U" shaped saddle 408, and the hollow shaft 374 is rotationally supported on the "U" shaped saddle 406. The arm 409 projecting from the housing 342 and over the hollow shaft 374 prevents the drum portion 333 from accidentally lifting up from the housing 342.

The two shelves, or housing limits 410, 412 are positioned such that they allow rotation of the stop washer 340 across an arc distance of just over 180° before the housing stop 388 on the stop washer 340 impacts against one or the other of the housing shelves or limits 410, 412. As explained earlier, the drum portion 333 can only rotate slightly less than 180° relative to the stop washer 340 before one or the other of the stops 392, 394 on the half-moon shaped shoulder 384 impact against the stop 382 of the annular recess 380. Therefore, the combination of the stops 392, 394 on the stop washer 340 acting on the stop 382 of the drum portion 333, and the stops 410, 412 on the housing 342 acting on the stop 388 of the stop washer 340 results in a total allowable rotation of the drum portion 333 of 360°.

Referring now to Figures of 55 and 58, the bottom wall 404 of the housing 342 defines an elongated slotted opening 414 for the front and rear tilt cables to pass through the housing 342 and through corresponding opening(s) (not shown) in the head rail 312. The lift cords 20 (See FIG. 50) may also pass through this same opening 414 and down through the slats 14 until they reach the bottom rail, as is known in the industry.

At some point, either before or after the installation of the tilt drive assembly 330 onto the head rail 312, the tilt cables 16 are attached to the drum portion 333 according to the routing required to obtain the desired configuration as explained in more detail below. As already discussed above, to attach the tilt cables 16 to the drum portion 333, an enlargement 366 (such as a knot or bead) is secured to the end of the tilt cable 16, and this enlargement 366 is inserted behind the desired slotted opening 360 or 368 in the desired web 350, 352 respectively of the drum portion 333. The enlargement 366 prevents the tilt cable 16 from pulling out of the respective web 350 or 352 of the drum portion 333 and thereby quickly and effectively attaches the tilt cable 16 to drum portion 333.

Double Pitch Configuration for the Variable Radius Wrap Design

FIGS. 59-64 depict the routing of the tilt cables 16 for a typical double pitch blind configuration for these variable-radius-wrap tilt stations 330. As has already been discussed above, in these figures, and in all similar figures to follow, the routing of the cables 16 and the position of the drum portion 333 are shown relative to the corresponding position of the slats 14 of the blind 310. For greater clarity, a detailed, close-up view of the drum portion 333 is included as part of these views (with the housing 342 and the stop washer 340 removed for clarity) to show the orientation of the drum portion 333 and the routing of the tilt cables 16 corresponding to the orientation of the slats 14.

As was explained earlier, the tilt cables are generically designated as item 16, but are further identified by the following suffixes:

"a" is for the first set of tilt cables, those supporting the upper (or top) slats 14*t* in each pair "b" is for the second set of tilt cables, those supporting the lower (or bottom) slats 14*b* in each pair "f" is for the front tilt cables, those on the room side of the blind "r" is for the rear tilt cables, those on the wall side (also referred to as the window side) of the blind Note that, in general, two ladder tapes are defined for this variable-radius-wrap double pitch design, wherein the first ladder tape includes the tilt cables 16*af* and 16*ar* for the upper slats in each pair, and the second ladder tape includes the tilt cables 16*bf* and 16*br* for the lower slats in each pair.

Figure 60:
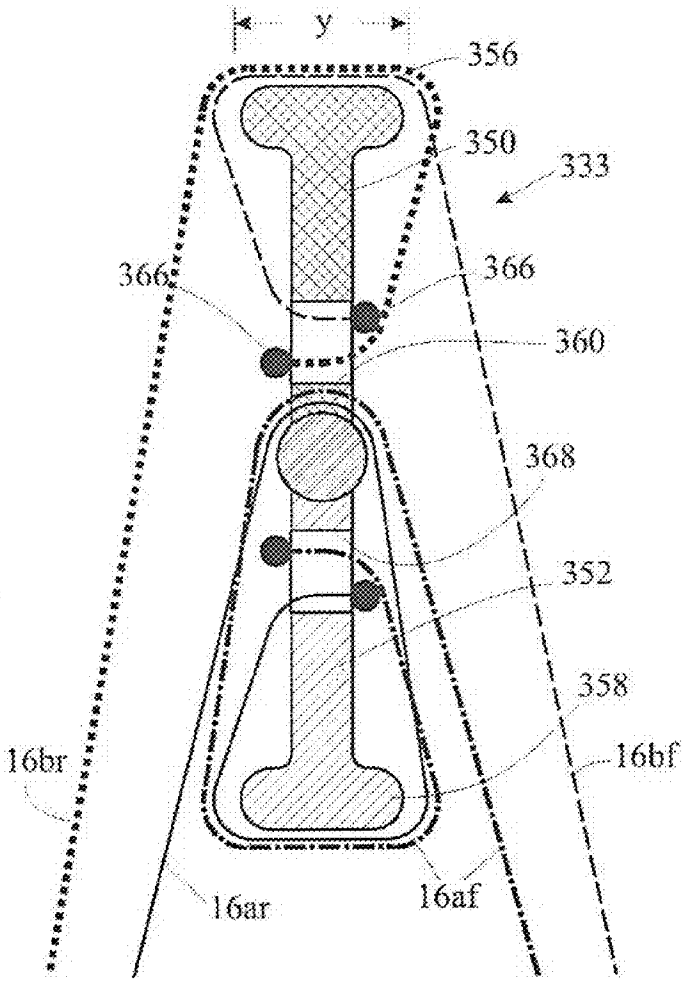
FIG. 60 is a detailed view of the drum of FIG. 59 showing the routing of the tilt cables.
Figure 59:
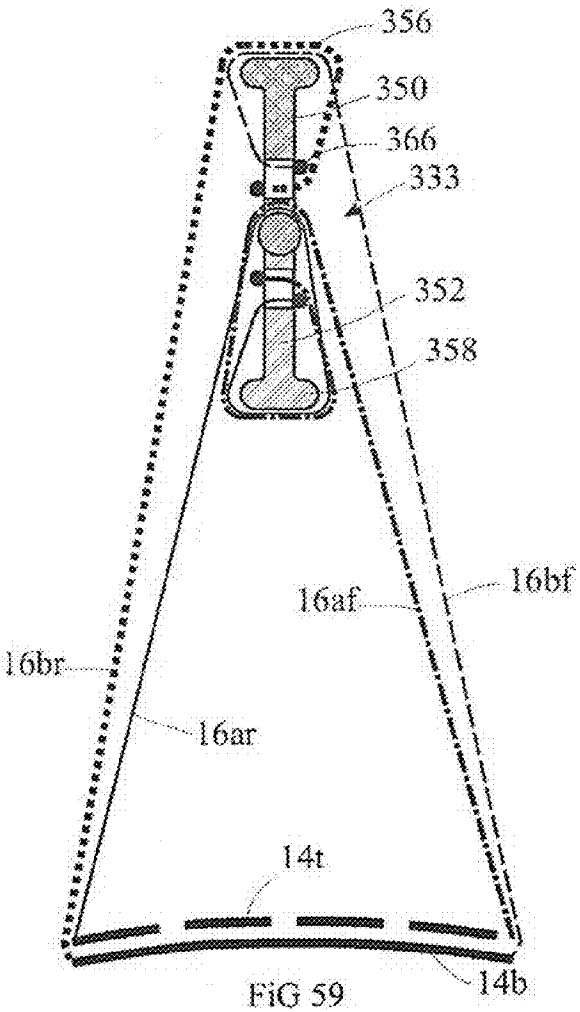
FIG. 59 is a schematic, sectional view, (with housings and head rail not shown for clarity) along line 59-59 of the blind of FIG. 50, showing the position of the drum and the routing of the tilt cables for a double pitch configuration.

Referring to FIGS. 50, 59, and 60, the drum portion 333 is in its neutral position. This neutral position refers to the position of the drum portion 333 corresponding to the position of the slats 14 in the blind 310 wherein the slats 14 are fully open in the double pitch configuration shown in FIG. 50, with adjacent pairs of slats 14*t*, 14*b* stacked against each other. In this double pitch arrangement, the open area between adjacent pairs of slats 14*t*, 14*b* is essentially twice the open area that would be achieved if the slats were spaced apart equally in a "normal" arrangement, thus the "double pitch" designation.

In this configuration (and as seen most clearly in FIG. 60), for the upper, or top slats 14*t*, the first room-side tilt cable 16*af* is routed clockwise (as seen from the vantage point of FIG. 60) from the opening 368 in the "upper slats" web 352, down and around the wrap surface 358, and back up through the inner edge of the web 352 to the room side of the top slats 14*t*. Similarly, the first wall-side tilt cable 16*ar* is routed counterclockwise (as seen from the same vantage point) from the opening 368 of the "upper slats" web 352, down and around the wrap surface 358, and back up around the inner edge of the web 352 to the wall side of the upper slats 14*t*.

On the other hand, for the lower, or bottom slats 14*b*, the second room-side tilt cable 16*bf* is routed clockwise from the opening 360 of the "lower slats" web 350, around the wrap surface 356 of the "lower slats" web 350, and down to the room side of the lower slats 14*b*. The second wall-side tilt cable 16*br* is routed counterclockwise from the opening 360 of the "lower slats" web 350, around the wrap surface 356 of the web 350 and down to the wall side of the lower slats 14*b*. In this routing and configuration of the tilt cables 16, the slats 14 are tilted open in a double pitch configuration as shown in FIGS. 50 and 51.

Figure 62:
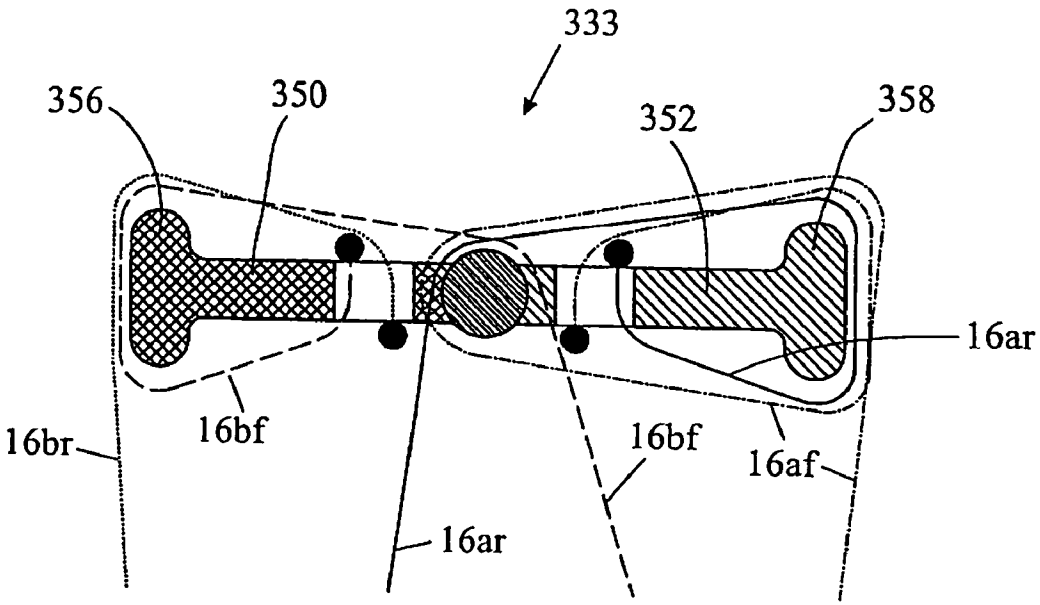
FIG. 62 is a detailed view of the drum of FIG. 61 showing the routing of the tilt cables.
Figure 61:
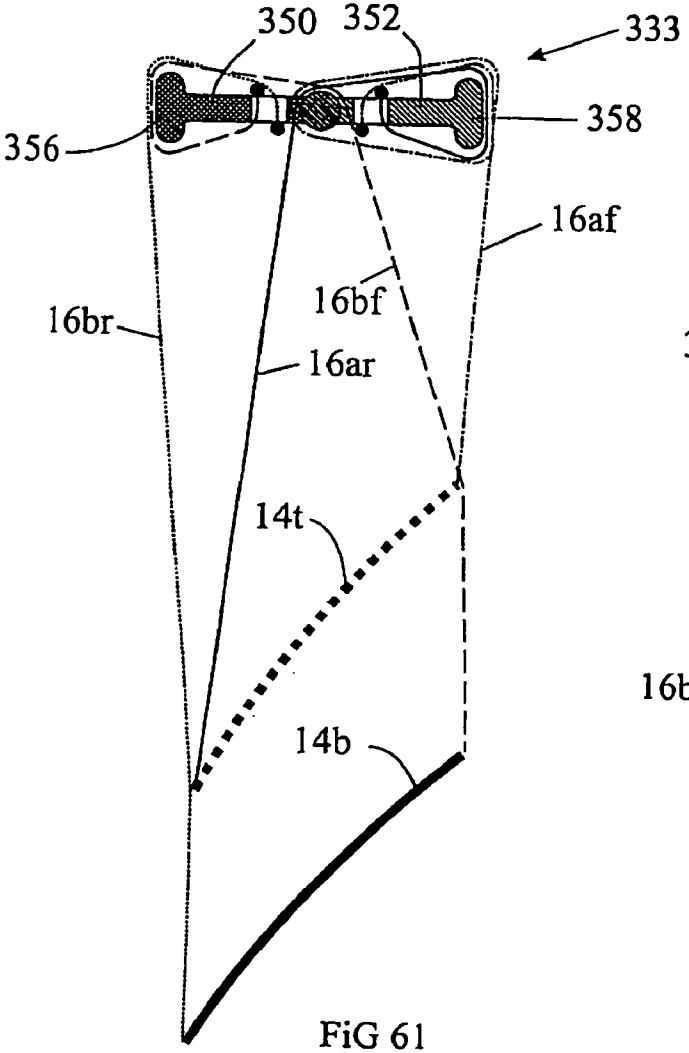
FIG. 61 is a schematic view, similar to that of FIG. 59, but for the blind in a partially closed, room-side up position, wherein the drum has been rotated counterclockwise 90 degrees.

Referring now to FIGS. 61 and 62, as the drum portion 333 is rotated counterclockwise from the neutral position (by turning the wand in a direction which makes the tilter mechanism 326 rotate the tilt rod 328 counterclockwise), the "lower slats" web 350 and its corresponding wrap surface 356 are lowered, while the "upper slats" web 352 and its corresponding wrap surface 358 are raised (relative to the axis of rotation 354 of the drum portion 333). This rotation affects the "apparent" lengths of the tilt cables 16 as explained below.

Figure 63:
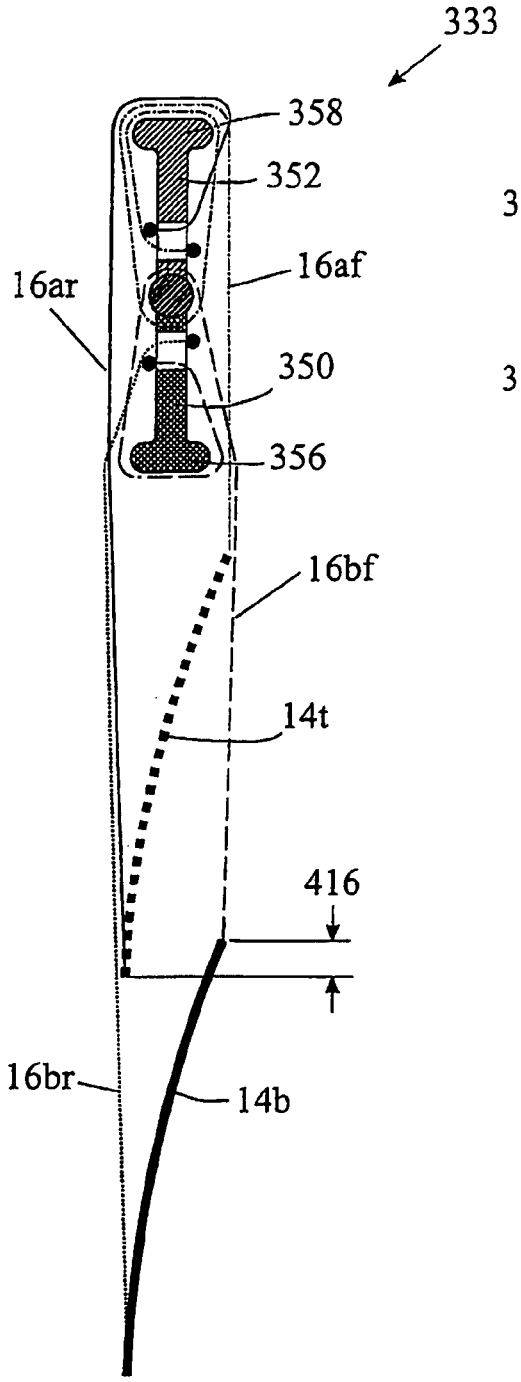
FIG. 63 is a schematic view, similar to that of FIG. 59, but for the blind in a fully closed, room-side up position (as in FIG. 53), wherein the drum has been rotated counterclockwise 180 degrees.
Figure 64:
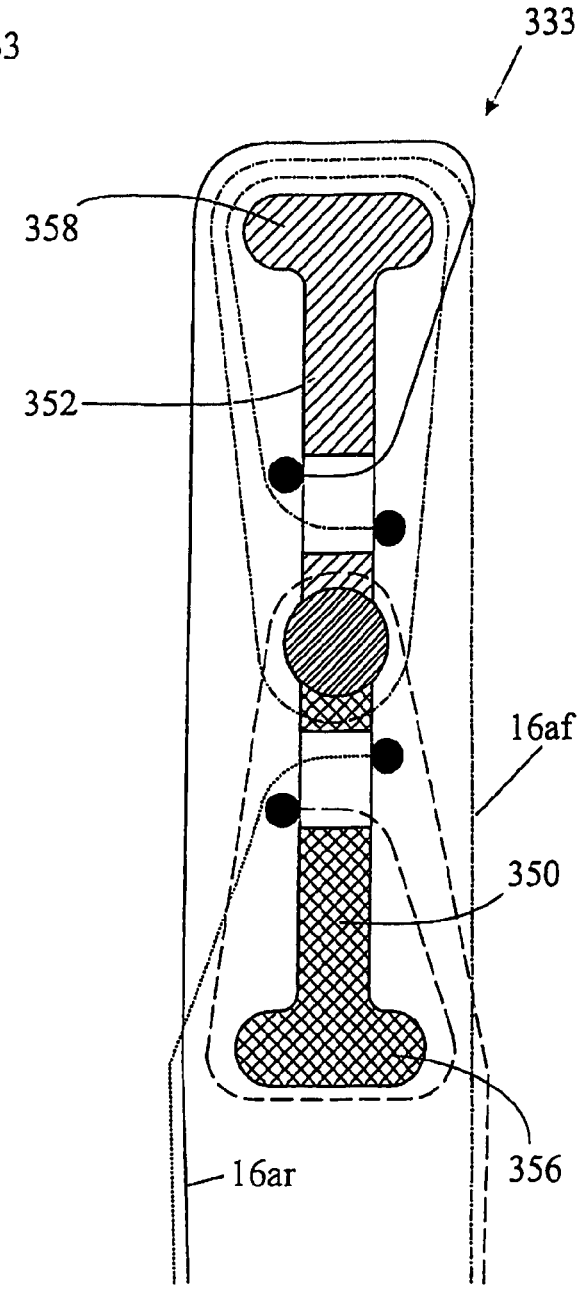
FIG. 64 is a detailed view of the drum of FIG. 63 showing the routing of the tilt cables.

FIGS. 61 and 62 show 90 degrees of counterclockwise rotation of the drum portion 333. The "apparent" length of the wall-side tilt cables 16*ar*, 16*br* is increased, while the "apparent" length of the room-side tilt cables 16*af*, 16*bf* is decreased. The result is a partial closing of the blind 310 in the room-side up position. Further rotation of the drum portion 333 to a full 180 degrees of counterclockwise rotation, as shown in FIGS. 63 and 64, results in an even further increase in the "apparent" length of the wall-side tilt cables 16*ar*, 16*br*, and a corresponding decrease in the "apparent" length of the room-side tilt cables 16*af*, 16*bf*. The effect is shown in FIG. 53, where the blind 310 is fully closed, room-side up.

It is interesting to note that the "apparent" length of the tilt cables 16 is changing by different amounts depending on the routing of the tilt cables 16 around the drum portion 333. For instance, the wall-side tilt cable 16*br* of the bottom slats 14*b* sees a larger change in relative position (a larger drop for the wall-side of the slats 14*b*) than the change in relative position of the room-side tilt cable 16*bf* (a smaller rise for the room-side of the bottom slats 14*b*). Similarly, for the top slats 14*t*, the room-side tilt cable 16*af* sees a faster rise than the drop of the wall-side tilt cable 16*ar*.

The reason for this difference in the change of length of the various cables is the routing of the tilt cables 16. Consider, for instance, the routing of the front and rear tilt cables 16*bf*, 16*br* of the lower set of slats 14*b* as the drum portion 33 is rotated in a counter-clockwise direction, as illustrated in FIGS. 60, 62, and 64. The length of different segments of the front tilt cable 16*bf* is essentially identical in all three views. That is, the length of the segment from the enlargement 366 to the wrap surface 356 is unchanged in all three views. Also, the length of the segment across the wrap surface 356 is unchanged in all three views. Finally, the length of the segment from the end of the wrap surface 356 to the slats 14*b* is shortened essentially only by the arc-length of the tilt cable 16*bf* which comes in contact with the inner edge of the web 350.

Contrast this small decrease in length of the front tilt cable 16*bf* with the considerably longer increase in length of the rear tilt cable 16*br* for the same bottom slats 14*b*. Comparing the views of FIGS. 60 and 64, the length of the rear tilt cable 16*br* increases substantially by the distance marked "X" in FIG. 56 plus the distance marked "Y" in FIG. 60 (in other words, substantially by the distance corresponding to twice the radius of the web 350 and its corresponding wrap surface 356 plus the width of the wrap surface 356)

In this embodiment, the magnitude of the change in "apparent" length of the tilt cables 16 is the same for both of the bottom rear and top front tilt cables 16*br*, 16*af*, both of which have the larger drop, and it is the same for both of the top rear and bottom front tilt cables 16*ar*, 16*bf*, both of which have the smaller drop. The result is an effect wherein the slats 14*t*, 14*b* not only rotate (or tilt) but also shift vertically relative to each other. Thus, the top slats 14*t* migrate upwardly as they tilt, while the bottom slats 14*b* migrate downwardly as they tilt. The slats all migrate just enough that, at the end of the tilting motion, the paired slats which were stacked right on top each other when in the fully open position (See FIG. 50) are now vertically separated such that only a small amount of vertical overlap 416 (See FIG. 63) exists between them.

To summarize, the "offset" nature of the webs 350, 352 (perhaps most evident in FIG. 56 wherein each web 350, 352 is offset from the axis of rotation 354 of the drum portion 333) and the fact that these webs 350, 352 are offset by 180 degrees relative to each other, result in the tilt cables 16 being wrapped upon their corresponding webs on a variable radius which depends upon the routing of the individual tilt cable, with some cables having a larger magnitude of "apparent" length change than others. As the drum portion 333 rotates in a second, opposite direction about its axis of rotation 354, the situation is reversed to allow the blind 310 to close room-side-down as shown in FIG. 52.

The rotation from the double pitch open configuration of FIG. 50 to the closed room-side up blind of FIG. 53 is accomplished in 180 degrees of counterclockwise rotation of the drum portion 333. Similarly, starting from the neutral drum portion 333 position shown in FIG. 59, a 180 degree clockwise rotation of the drum portion 333 will result in tilting of the blind to a room-side down configuration as shown in FIG. 52.

Finally, it should be noted that the variable-radius-wrap tilt stations 330 described herein do not necessarily need a stop washer 340 for operation. In the absence of any rotational limit stops for the drum portion 333, the user would simply have to judge when to stop tilting the blind closed. Also, other limit stops may be used to limit the rotation of the drum portion 333 to 360 degrees. Also, a simple limit stop (not shown) could be used directly between the housing 342 and the drum portion 333 (without the need for the stop washer 340) to achieve almost 360 degrees of rotation of the drum portion 333 resulting in almost (but not quite) complete closure of the blind 310 in at least one of the room-side up or room-side down directions. It may also be possible to limit the rotation of the tilt rod 328 or of the cord tilter 326 in order to indirectly limit the rotation of the drum portion 333.

While several embodiments have been shown and described, it is understood that it is not practical to describe all the possible variations and combinations that could be made within the scope of the present invention. It will be obvious to those skilled in the art that modifications may be made to the embodiments described above without departing from the scope of the invention as claimed.

What is claimed is:

1. A blind for selectively covering an architectural opening, comprising:

a head rail;

a plurality of slats suspended from the head rail, including a plurality of pairs of upper and lower adjacent slats;

first and second ladder tapes extending downwardly from said head rail, each of said first and second ladder tapes including a front tilt cord and a rear tilt cord, wherein the first ladder tape supports and is operatively connected to tilt the upper slats of each pair of upper and lower adjacent slats and the second ladder tape supports and is operatively connected to tilt the lower slats of each pair of upper and lower adjacent slats, each of said tilt cords having a first end;

a tilt rod in driving engagement with the first ends of the front and rear tilt cords of the first and second ladder tapes, wherein rotation of said tilt rod raises and lowers the front and rear tilt cords of the first and second ladder tapes to move the slats from a first position in which the upper and lower adjacent slats of each pair are stacked against each other in a double pitch open position to a second position in which the pairs of upper and lower slats are in a tilted closed position;

a tilt station including first and second eccentrics fixed relative to each other and rotatable about an axis of rotation;

said first ladder tape being attached to said first eccentric, and said second ladder tape being attached to said second eccentric, such that rotation of said tilt rod causes rotation of said eccentrics, wherein when said first and second eccentrics are rotated in a first direction, the front tilt cord of said first ladder tape and the rear tilt cord of said second ladder tape each travel substantially a same first magnitude, and the rear tilt cord of said first ladder tape and the front tilt cord of said second ladder tape each travel substantially a same second magnitude, wherein said first magnitude is larger than said second magnitude.

2. A blind for covering an architectural opening, as recited in claim 1, and further comprising means for limiting said rotation of said tilt station to substantially 360 degrees of rotation.

3. A blind for covering an architectural opening, as recited in claim 2, wherein said means for limiting rotation includes a tilt station housing for rotationally supporting said first and second eccentrics, and a stop washer rotationally mounted between said housing and said eccentrics, wherein said stop washer cooperates with said housing and with said eccentrics to limit rotation of said eccentrics.

4. A blind for covering an architectural opening, as recited in claim 3, wherein said tilt rod includes a plurality of tilt rod segments which rotate together about said axis of rotation.

5. A blind for covering an architectural opening, as recited in claim 4, wherein at least two of said tilt rod segments are functionally interconnected by said tilt station.

* * * * *